US006886740B1

(12) United States Patent
Craig

(10) Patent No.: US 6,886,740 B1
(45) Date of Patent: May 3, 2005

(54) APPARATUS FOR CALCULATING TIME PERIODS

(76) Inventor: Randall H Craig, 3200 N. Dobson Rd., #F7, Chandler, AZ (US) 85224

( * ) Notice: Subject to any disclaimer, the term of this patent is extended or adjusted under 35 U.S.C. 154(b) by 0 days.

(21) Appl. No.: 09/763,250

(22) PCT Filed: Nov. 22, 1999

(86) PCT No.: PCT/US99/27771

§ 371 (c)(1),
(2), (4) Date: Feb. 15, 2001

(87) PCT Pub. No.: WO00/77590

PCT Pub. Date: Dec. 21, 2000

Related U.S. Application Data

(60) Provisional application No. 60/139,693, filed on Jun. 15, 1999.

(51) Int. Cl.[7] ..... G06C 3/00

(52) U.S. Cl. ..... 235/85 FC; 235/88 RC; 235/88 R

(58) Field of Search ..... 235/85 FC, 88 RC, 235/88 R, 116

(56) References Cited

U.S. PATENT DOCUMENTS

| | | | | | |
|---|---|---|---|---|---|
| 3,771,716 | A | | 11/1973 | Sanchez | |
| 4,041,628 | A | | 8/1977 | Sasson | |
| 4,092,521 | A | | 5/1978 | Weisshaar | |
| 4,308,678 | A | | 1/1982 | Slobin | |
| 4,625,099 | A | | 11/1986 | Freedom | |
| 4,751,373 | A | * | 6/1988 | Ivey | 235/84 |
| 5,310,994 | A | | 5/1994 | Thabet et al. | |
| 5,496,070 | A | * | 3/1996 | Thompson | 283/2 |
| 5,837,197 | A | | 11/1998 | Porrazzo et al. | |

* cited by examiner

*Primary Examiner*—Karl D. Frech
(74) *Attorney, Agent, or Firm*—Oppendahl & Larson LLP

(57) ABSTRACT

A single axis rotatable disc calendar for calculating time periods and future dates based on current or past events is disclosed. In particular, calculators for determining fertility timing, testing and treatment dates have a base circular calendar (61) and one or more discs (58, 59, 60) containing information about menstrual cycles and ovulation events. The base circular calendar has 365 divisions (67) for the days in the year or 153 divisions for a shortened calendar excluding February. A separate February calendar with a leap February month is provided on the back of the base.

110 Claims, 57 Drawing Sheets

APPARATUS FOR CALCULATING TIME PERIODS

This application is a 371 of PCT/US99/27771 filed Nov. 22, 1999 which claims benefit of U.S. Provisional Application 60/139,693 filed Jun. 15, 1999.

BACKGROUND

1. Field of the Invention

The present invention relates generally to calendars, especially to a single axis rotatable disc calendar, and to methods of calculating time periods and future dates based on current or past events. More particularly, the invention relates to calculators for determining fertility timing, testing and treatment time periods and future event dates.

2. Description of the Prior Art

Many professions require the calculation of time periods in days, weeks and months, either forwards or backwards, for purposes of establishing a date or dates at some increment of time from a given start date, or from a particular event. Such calculations often require knowing the day of the week a calculated date falls on, or planning a schedule of events so that particular events fall on certain days of the week, or to avoid weekends. These calculations are often critical in terms of deadlines imposed by laws, rules or contracts. These calculations are complicated when time periods run for several months, which have different numbers of days, and especially for time periods running over February in a leap year. Professions requiring these types of calculations include law, banking, insurance, construction and medicine. In particular, the field of human fertility medicine involves many complex time period calculations.

Human fertility, infertility, and contraception evaluations are characterized by a large number of basic tests, the majority of which require accurate timing relative to the female menstrual cycle or ovulation cycle. Many contraceptive methods, fertility therapies, or infertility treatments are also dependent on menstrual cycle or ovulation timing.

Human fertility physiology is unique among the mammals, especially regarding the female system. The male system is a relatively simple design consisting of a continuous "conveyor belt" sperm production factory under the control of a non-cyclic hormone, testosterone, itself under the control of a non-cyclic central axis of lutenizing hormone (LH), follicular stimulating hormone (FSH), and GnRH hormones. In contrast, the female system is much more complex, consisting primarily of interdependent physiologic cycles designed to release a fertilizable egg cell at an optimal point in time to maximize successful reproductive potential. This system is characterized by endocrine negative and positive feedback cycles utilizing changes in the concentrations of estrogen and progesterone under the control of cyclic LH, FSH, and GnRH central axis hormones. The final product of these cyclic control systems is the female menstrual cycle. Hormone levels, anatomic changes, ovulation (and thus fertile periods), and embryo implantation patterns are integral parts of the menstrual cycle, and occur at specified points or ranges within the cycle. Pathologic alterations in the female reproductive systems also follow repeated patterns in the menstrual cycle, including hormone imbalances, abnormal (or absent) ovulation, uterine lining preparation problems, or embryo implantation difficulties. Because the normal and the pathologic components of the menstrual cycle occur in a predictable, repetitive temporal pattern, they can be described by algorithms, with each component tied to a relatively fixed landmark event in the cycle.

Several devices are known for calculating a variety of time periods and timing various things. U.S. Pat. No. 4,751,373 to Ivey discloses a time period calculator in which a wheel with 365 divisions for days of the year is further divided into weeks and months. A cursor is provided to accommodate a leap year.

U.S. Pat. No. 5,313,723 to Cregg discloses a perpetual calendar comprising two discs. One disc has a window with adjacent marks indicating the days of the week, and other marks indicating months and years. The second disc contains year tables and day grids. The user adjusts the two wheels to show the monthly calendar for any month of any year, including leap years.

Gestational calculating wheels are simple calculating devices used to determine the gestation age of a pregnancy for any calendar date, and to determine landmark events of a pregnancy such as the expected delivery date. These circular rotating scale calculators are made in a large variety of design formats. The basic design consists of a calendar date scale of one year length wrapped once around a circular scale containing 365 days. A single independently rotating scale attached to the center pin contains gestational week markings, along with other printed pregnancy information, tests, and treatments that are dependent upon gestational age. The gestational age circular scale always contains a label for the first day of the last menstrual period (LMP), and some have a label for ovulation or conception day. These gestational calculating wheels are used only for displaying pregnancy related information, not for fertility test or treatment information, and they have no markings for cycle days.

A Depo-Provera calculating wheel is often distributed to medical personnel who dispense the contraceptive drug Depo-Provera, which is administered as an injection given once every 12 weeks. This device is similar to the gestational calculating wheel, using the same calendar date scale, but its single independently rotating medication day wheel ranges over the entire circumference instead of a nine-month circumference. The medication day wheel contains four approximately equal spaced markings (12 weeks apart) indicating the times to schedule Depo-Provera injections during the year.

U.S. Pat. No. 4,092,521 to Weisshaar discloses a circular scale coaxial device made of 3 or 4 independently rotating scales that determine the fertile time periods and the "sterile" time periods during a menstrual cycle. The first disk displays a fixed 31-day calendar month wrapped around the entire circumference of a circular scale. The other disks display 31 cycle days, fertility periods, and sterility periods. An optional fourth disk is used to display a reverse cycle backward from the next following menstrual cycle. No labels for fertility tests or treatments are included.

U.S. Pat. No. 4,465,077 to Schneider discloses an electronic computer with keypad data entry which stores information from a patient's medical history, including past menstrual cycle dates, basal body temperature (BBT) charts, gynecologic disorders, and ovulation prediction indicators. It then statistically calculates the patient's fertility status and estimated chance of achieving pregnancy. This device is not used to time specific fertility tests or treatments.

U.S. Pat. No. 4,625,099 to Freedom discloses a circular scale coaxial device made of a 365-day calendar date scale and an independently rotating cycle day scale. The entire calendar year is wrapped once around the calendar date scale. An overlying cycle day scale is also divided into 365 equal days, with several menstrual cycles displayed as marked domains separated from each other by small "spacer" segments. The cycle domains have as few as 23 days or as many as 35 consecutive days each, with the remaining cycle domains having an incrementally larger number of days between these two extremes. Within each cycle domain, the cycle days are numbered consecutively from the first day of the last menstrual period. The only other labeled indicator marks "fertile" days for two days prior and two days after expected ovulation, and alerts the user to the optimum fertility period of the cycle. Presumably, the user will ignore all the other cycle domains and use only the one that contains her average cycle length.

U.S. Pat. No. 4,737,619 to Freedom discloses the addition of "non-fertility" labels to the device described above, and extends the range of cycle lengths in domains from 20 days to 35 days, instead of 23 days to 35 days.

U.S. Pat. No. 4,752,880 to Aeschlimann discloses an electronic calculator designed to store the patient's basal body temperature (BBT) data during a menstrual cycle. The calculator contains counters which allow entry of BBT data only at 24-hour intervals in order to improve accuracy.

U.S. Pat. No. 5,310,994 to Thabet discloses a non-complex circular scale device containing a calendar scale displaying the days of the month, and an independently rotating circular scale displaying the average number of days in the user's menstrual cycle. The simple design is intended for use in Third World countries, to identify fertile and non-fertile times of the menstrual cycle.

U.S. Design Pat. No. D389,587 to Porrazzo discloses an ornamental design for a slide device to display fertile times of the menstrual cycle.

U.S. Pat. No. 3,964,674 to Van der Gaast discloses a circular scale coaxial device containing a basic plate with "longest period" scale printed as a portion of the circumference, and two independently rotating middle and top plates onto which "shortest period" and "LMP day of month" pointers are printed. Data windows cut into the top plate reveal the first and last days of the fertile period for that cycle. Operation of this device is complicated due to confusing labeling and the use of three sets of date windows to be used with three sets of calendar months.

U.S. Pat. No. 4,350,878 to Schwartz discloses a circular scale coaxial device containing a base plate with menstrual period—basal temperature—ovulation scale printed on a portion of the circumference, a middle plate with a reversed single cycle day scale on a portion of its circumference, and a top plate circumferentially divided into two generic months, a 30-day and a 31-day, around the entire circumference. The middle plate is transparent to allow visualization of the alignment with the other plates. An optional second transparent plate can be added between the base plate and middle plate, upon which another ovulation range marked is printed to extend the use of the calculator for users with variable cycle lengths. This device is severely limited by its "two generic months" for calendar date application because it does not allow for 31 day-to-31 day transitions or for February/leap February transitions. The LMP and ovulation range markers are also severely limited by their fixed distance because they are both printed on the same scale and plate, although the optional second ovulation plate can partially overcome this problem.

U.S. Pat. No. 4,752,674 to Rosenwaks discloses a circular and spiral scale coaxial device containing a base plate with its circumference evenly divided into a 28-day scale, a transparent middle plate containing a spiral scale with over 4 turns upon which 3 generic months are printed (30-day then 31-day then 30-day), and a transparent top plate containing a 14-day "Donor" scale on half of the circumference along with rectangular arc data windows for reading results on the base plate scales. An In Vitro Fertilization egg donor cycle hCG ovulation trigger injection day can be rotated on the top plate to correspond with the recipient's LH surge cycle day, to determine the optimal day of subsequent embryo transfer into the recipient's uterus. This device also has a severely restricted calendar day scale that cannot accommodate a 31 day-to-31 day transition or February/leap February transition.

None of the prior art devices provide a simple, accurate, easy to read device for calculating time periods and future dates, which takes into account leap years and the varying month-to-month transitions. In particular, none of the prior art devices provides a device for easily and accurately determining and displaying the calendar date, weekday, and cycle day of nearly all fertility and family planning tests and therapies, which takes into account leap years and the varying month-to-month transitions. It is an object of the instant invention to provide such devices.

SUMMARY OF THE INVENTION

The calculating apparatus and methods of the invention provide a simple, accurate, easy-to-read means for calculating time periods and future dates, which take into account leap years and the varying month-to-month transitions. In accordance with an embodiment of the instant invention, the apparatus comprises a base with a circular display of first markings. The markings are divided into 153 equiangular parts disposed along substantially the entire periphery of the circular display, the 153 equiangular parts grouped into five segments disposed in clockwise fashion around the circular display. The first segment has 31 equiangular parts, the second segment has 30 equiangular parts and is labeled "April" and "September", the third segment has 31 equiangular parts and is labeled "May" and "October", the fourth segment has 30 equiangular parts and is labeled "June" and "November", and the fifth segment has 31 equiangular parts and is labeled "July" and "December". The first segment may be labeled "March" and "August", "August" and "January", "March", "August" and "January", or "February", "September" and "April". The base of the apparatus is preferably substantially planar and opaque.

In an alternative embodiment, the base comprises a circular display of first markings divided into at least 150 equiangular parts disposed along substantially the entire periphery of the circular display, the at least 150 equiangular parts grouped into at least five segments. The segments are arranged in either of two sequences. In one sequence, the first segment has 31 equiangular parts and is labeled "January", the second segment has 28 equiangular parts and is labeled "February", the third segment has 31 equiangular parts and is labeled "March" and "Leap January", the fourth segment has 29 equiangular parts and is labeled "Leap February", and the fifth segment has 31 equiangular parts and is labeled "Leap March". In the second sequence, the first segment has 31 equiangular parts and is labeled "Leap January", the second segment has 29 equiangular parts and is labeled "Leap February", the third segment has 31 equiangular parts and is labeled "Leap March" and "January", the fourth segment has 28 equiangular parts and is labeled "February", and the fifth segment has 31 equiangular parts and is labeled "March", respectively, in clockwise fashion around the circle. In an alternative embodiment, the circular display of markings is divided into 153 equiangular parts grouped into six segments, wherein a sixth segment comprising three equiangular parts is located between the first and fifth segment.

In a further embodiment, the apparatus has both of the above circular calendar displays, either on the same side of the base or on opposite sides of the base.

In another embodiment of the invention, one or more discs are rotatably joined at a central axis to the circular display portion of the base. The discs have a circular display of markings disposed along at least a section of the periphery thereof, the markings representing activities or events of interest. The events of interest may be related to a series of medical treatments, banking, law, construction or insurance.

In one embodiment in which the events are medical, the apparatus is adapted to determine physiologic phases and optimum time for fertility tests, treatments, and protocols based on menstrual or ovulation physiology. The apparatus comprises first and second discs adapted to be rotatably joined at a central axis to the circular display on the base. The first disc has at least a circular display of markings disposed along at least a portion of the periphery thereof, these markings representing the days of a menstrual cycle. One or more cycles with the same or different lengths may be represented. The second disc has at least a circular display of markings disposed along at least a portion of the periphery thereof, these markings representing events of interest relating to one or more menstrual cycles. In a further embodiment, the first disc further comprises additional markings disposed in a circular display, these markings representing initial steps in one or more physiologic phase or fertility test, treatment or protocol. The second disc further comprises additional markings disposed in a circular display, these markings representing the final steps in the physiologic phase, test, treatment or protocol from the first disc. In a modification of this embodiment, all of the steps of a phase, test, treatment or protocol on the first and second discs are the same color, and each phase, test, treatment and protocol is a different color. The base and the first disc are preferably opaque and the second disc is preferably transparent. The first and second discs may comprise a matched set, which is exchangeable with other disc sets containing steps for different fertility tests, treatments, protocols and physiologic phases. The menstrual cycles represented may be those of humans or non-human animals.

In a further embodiment, the apparatus also has an additional disc with at least a circular display of markings disposed along at least a portion of the periphery thereof. The markings are divided into equiangular parts labeled with the days of the week.

In a still further embodiment, the apparatus further comprises a mask which covers the unused portions of the calculator once a calculation is made. The mask is an opaque disc with a section cut out, and is the same size as the circular display on the base, and is adapted to be rotatably set in coaxial relation with the base and discs. The mask may be made of two sections which overlap to create an opening of variable size.

In an additional embodiment, the apparatus further comprises an indicator arm for indicating the possibility of pregnancy. The indicator arm comprises a transparent arm extending from the center of the calculator to at least the outer edge of the second disc, the arm adapted to be rotatably set in coaxial relation therewith, and having a first marker representing intercourse and a second marker representing the chance of sperm. The second marker extends from the first marker out to a distance of up to six units, representing up to six days, including the day indicated by the first maker. In use, the start of the last menstrual period on the first disc is aligned with the appropriate calendar day on the base, and the indicator arm is positioned such that the first marker is aligned with the day of the month of intercourse, and the possibility of pregnancy is determined by the overlap of the chance of sperm marker with a chance of egg marker on the first disc, wherein overlap indicates a possibility of pregnancy.

In another embodiment, the apparatus has a reversible locking means for securing the discs to the base. The locking means prevents the discs from rotating once they are aligned.

The first and second discs may be a matched set, exchangeable with other disc sets containing steps for different fertility tests, treatments, protocols and physiologic phases. The base and first disc may be opaque and the second disc may be substantially transparent.

In a still further embodiment, the apparatus is adapted for displaying information relating to fertility for a fraction of a year. The apparatus comprises a base and first and second discs rotatably joined at a central axis. The base has at least a circular display of first markings disposed along at least a section of the periphery of the circular display, the first markings divided into equiangular parts, the equiangular parts labeled with calendar days. The first disc has at least a circular display of second markings disposed along at least a portion of the periphery thereof, the second markings representing the days of a menstrual cycle, wherein one or more cycles are represented, the cycles having the same or different lengths. The second disc has at least a circular display of third markings disposed along at least a portion of the periphery thereof, the third markings representing events of interest relating to one or more menstrual cycles.

In a further embodiment, the first markings are disposed along the entire periphery of the circular display, the first markings divided into 365 equiangular parts, the equiangular parts labeled with days of the full calendar year. A second circular display of sixth markings disposed along the entire periphery of the circular display may be added to the base, the sixth markings divided into 366 equiangular parts, the equiangular parts labeled with days of the leap year.

In an additional embodiment, the apparatus is adapted to determine optimum time for achieving or avoiding pregnancy based on menstrual or ovulation physiology and a calendar or moon phases, wherein the calculator contains only non-letter, non-number symbols. The calculator comprises a base, first, second and third discs. The base has a circular display divided into equiangular parts, each representing a day in a moon phase, wherein the equiangular parts are present in one or more groups of 29 representing one or more moon phases. The first disc has the circumference thereof divided into equiangular parts similar to the base, wherein a symbol representing a significant day which occurs in cycles is located in the units at intervals according to the cycle, the first disc being smaller than the circular display on the base, and adapted to be rotatably set in coaxial relation therewith so that the outside edge of the first disc lies inside the units on the base. The second disc is also divided into equiangular parts similar to the base, with an annular display of first indicia disposed along substantially the entire periphery thereof, the first indicia representing the days at a menstrual cycle. One or more cycles are represented, the cycles having the same or different lengths. The second disc is smaller than the first disc and adapted to be rotatably set in coaxial relation therewith so that the outside edge of the second disc lies inside the symbols on the first disc. The third disc is divided into equiangular parts, similar to the base, with an annular display of second and third indicia disposed along substantially the entire periphery thereof, the second indicia representing the days of a menstrual cycle and the third indicia representing a fertile period. The third disc is smaller than the first disc and adapted to be rotatably set in coaxial relation with the base, first and second discs so that the outside edge of the third disc lies inside the symbols on the first disc. In use, the symbol representing a significant day on the first disc is aligned with the appropriate moon phase on the base, and the first disc is affixed to the base. The last menstrual cycle on the second disc is then aligned with the corresponding day on the first disc and base, according to the significant days. The next menstrual cycle on the third disc is then aligned with the corresponding day on the first disc, according to the significant days, causing the third indicia representing a fertile period on the third disc to be aligned with their corresponding day read from the base and first disc. The significant days are preferably religious and are represented by religious symbols. The first and second indicia are preferably red wedge-shaped symbols with a large end on the first day of the menstrual period, and a tapered end on the last day of the menstrual period. The third indicia are preferably baby-shaped symbols, and range from faintly printed through darkly printed and back to faintly printed according to the chance of conception, wherein the darker the symbol the greater chance of conception. In a further embodiment, the base further comprises symbols representing specific times of the year, which may include planting, harvesting, seasons and religious or tribal ceremonies.

In an another embodiment, the apparatus comprises a preferably planar base with one or more parallel linear displays. The base has slits to receive one or more sliding adjustable scales. The linear displays may be divided into segments representing days of the week, days of the month, months of the year, or days of a menstrual cycle. One or more menstrual cycles may be represented, and the cycles may be of different lengths. One of the linear displays may represent events relating to the menstrual cycle, the events being aligned with the appropriate cycle day. The sliding adjustable scales are parallel and adjacent to the linear displays.

In further embodiments, the days of the week, days of the month, months of the year or days of menstrual cycles are listed in segments on one or more sliding adjustable scales. The segments representing days of the week, days of the month and menstrual cycle days are preferably the same size to allow for alignment. A fourth sliding adjustable scale may be added which displays events relating to ovulation.

In an additional embodiment, one of the sliding adjustable scales comprises multiple scales with 28, 29, 30 and 31 days, the scales being attachable end-to-end to provide any month-to-month transition.

In a further embodiment, the apparatus comprises a base and a calendar module. The base has first and second parallel linear displays, the first linear display is divided into first segments, the first segments are labeled with the days of a menstrual cycle. One or more menstrual cycles are represented, wherein the menstrual cycles may be of different lengths. The second linear display represents events relating to specific menstrual cycle days. The calendar module comprises a calendar strip divided into second segments which are labeled with the days of the year, and the days of the year are labeled with the corresponding month. The calendar module is attachable to the base such that the calendar strip is parallel to the first and second linear displays. The first and second segments are the same size so that the days of the year align with the menstrual cycle days. The calendar module may also include a weekday strip listing the days of the week. The calendar strip may list a 365 day year, or a 366 day leap year. The calendar module may also include a menstrual cycle day strip with longer cycles than those on the base. The base may also have slits which receive at least one sliding adjustable scale, the sliding adjustable scale having a display of events relating to ovulation.

BRIEF DESCRIPTION OF THE DRAWINGS

FIGS. 25A–25C show slide-rule type calendars and a photocopied permanent record on the calendar.

DETAILED DESCRIPTION OF THE INVENTION

The time period and future date calculator of the invention may be adapted to any type of date calculation depending on what events are printed on the discs. The invention will be described in terms of the fertility timing, testing, and treatment calculator embodiment. While the following discussion relates to the menstrual cycle of a human, the invention may be modified to represent the menstrual cycle and associated fertility timing, testing and treatment events of a non-human animal. Examples of non-human animals for which the invention may be modified include cattle, horses, pigs, sheep, and dogs, as well as exotic zoo animals. The calculator may be especially useful for managing captive breeding programs for endangered animals.

Menstrual Cycle Components

The average length of the human menstrual cycle is 28 days, but the normal range for this value is generally between 26 and 38 days. Cycle length is defined as the number of days from the start of one menstrual period to the start of the following menstrual period. Physiologic events within the cycle tend to occur in the same chronological order for all cycles, and are thus somewhat predictable. When these organized chronological events are disrupted by abnormalities or pathology, the reproductive efficiency or integrity of the cycle is diminished or lost, resulting in fertility problems.

Figure 1A:
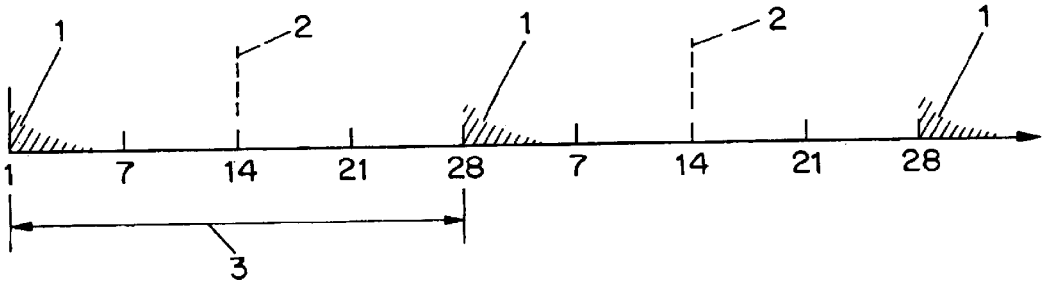
FIGS. 1A and 1B are graphs showing the phases and physiologic events of a classic, normal menstrual cycle.
Figure 1B:
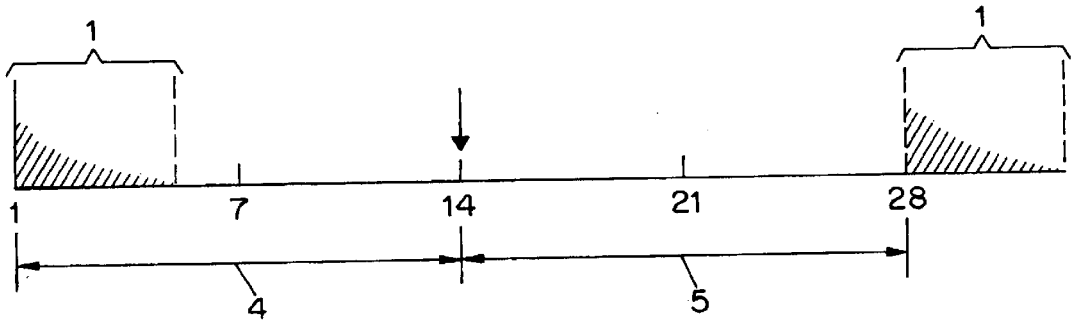
Figure 2:
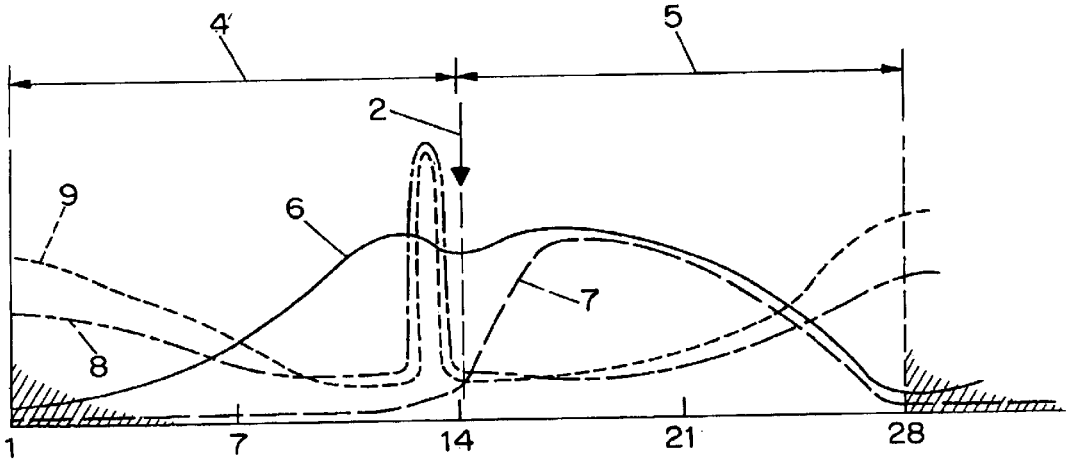
FIG. 2 is a detailed graph of the physiologic events of a classic, normal menstrual cycle.

A classic, normal menstrual cycle of 28 days 3 has, as key events, onset of menstrual period 1 and ovulation 2, which divides the menstrual cycle approximately in half (FIG. 1A). Physiologic events are divided into the follicular phase 4 lasting approximately 14 days, and the luteal phase 5 lasting approximately 14 days (FIG. 1B). FIG. 2 illustrates the timing of physiologic events including cyclic changes in the primary steroid hormones estrogen, including estadiol 6, and progesterone 7, and cyclic changes in the associated central axis control gonadotropin hormones LH 8 (lutenizing hormone) and FSH 9 (follicle stimulating hormone).

Changes in gonadotrophic and steroid hormones during the menstrual cycle are carefully choreographed and represent the primary driving forces of the other physiologic and anatomic changes in the cycle. Foremost among these changes is the development of the oocyte (egg cell) in the ovary and its subsequent release from the ovary (ovulation). The oocytes lie inside a tiny cyst called the follicle. During the menstrual cycle, the follicle rapidly increases in size, produces the hormone estradiol, then ruptures open to release the egg. It the fills with a blood clot mixed with its internal cells to become a corpus luteum, and then produces the hormone progesterone along with estradiol for the remainder of the cycle. At the end of the cycle it shrinks down and disappears. The follicular and luteal phases are each divided into early, mid and late phases. The early follicular phase is characterized by high FSH and LH, low estradiol and very low progesterone. The mid follicular phase is characterized by decreasing LH and FSH, increasing estradiol and very low progesterone. The late follicular phase is characterized by a small increase in progesterone, high estradiol and a very high surge of LH and FSH. This surge occurs immediately before ovulation. During this time the initially immature oocyte begins to mature, undergoes ovulation, and then enters the fallopian tube to wait for sperm fertilization. The early luteal phase is characterized by a rapid increase in progesterone, continued high estradiol and low LH and FSH. High progesterone, high estradiol and increasing LH and FSH are characteristic of the mid luteal phase. The late luteal phase is characterized by decreasing progesterone and estradiol and increasing LH and FSH.

Figure 3:
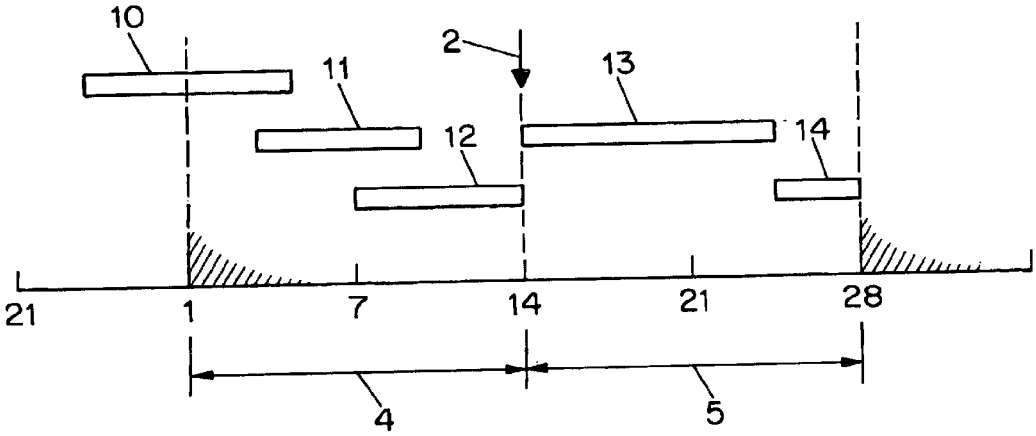
FIG. 3 shows the stages in oocyte development during a classic, normal menstrual cycle.

At the end of the previous menstrual cycle and during the early part of the active menstrual cycle, a number of follicles and their respective oocytes are recruited into the cycle (usually 15 to 20 primordial follicles). During the mid-follicular phase one of the follicles achieves dominance over the others. As the other follicles shrink and disappear, the dominant follicle rapidly grows larger until the oocyte is nearly mature. These events occur just before, during, and after the menstrual period and continue through the follicular phase, ending at the time of ovulation. This part of the menstrual cycle is therefore subdivided into three sub-phases. FIG. 3 shows a time line starting with day 21 of the previous cycle and extending through the follicular phase 4 and luteal phase 5 of the active cycle to the beginning of the following cycle. The three sub-phases are: the Recruitment sub-phase 10 from prior cycle day 24 until active cycle day 5, then Dominance sub-phase 11 from active cycle day 3 until day 10, and then Growth sub-phase 12 from active cycle day 7 until day 14 ovulation. After ovulation, the luteal phase is subdivided into two sub-phases. The first is the Luteogenesis sub-phase 13 from active cycle day 14 ovulation until day 25, followed by the Luteolysis sub-phase 14 from active cycle day 25 until day 28 when the corpus luteum shrinks and disappears. (FIG. 3).

Near the end of the follicular phase, the LH and FSH hormones drop to their lowest levels of the entire cycle, then suddenly increase very rapidly to extremely high levels. This endocrine event is known as the "LH surge" 15 and lasts less than one day, after which the LH and FSH hormones rapidly decrease to their original levels. The LH surge produces two physiologic effects, final maturation of the oocyte, and triggering of ovulation.

Ovulation is the physical release of the oocyte from the ovary. Prior to ovulation, the oocyte is contained within the cyst-like follicle on the surface of the ovary. This follicle ruptures open at the time of ovulation, expelling the oocyte into the end of the fallopian tube. The oocyte then waits at this position for sperm to arrive and, hopefully, be fertilized.

Figure 4:
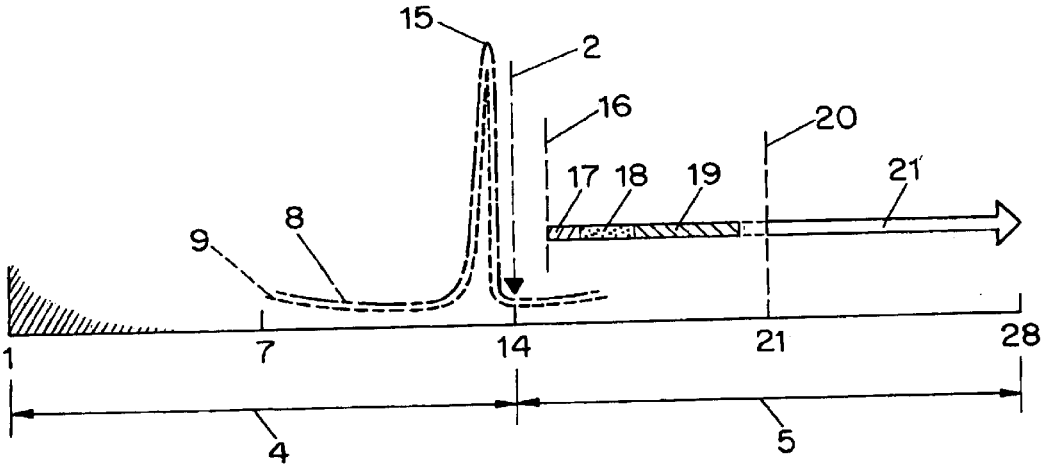
FIG. 4 shows the physiologic stages before and after fertilization.

If fertilization 16 occurs, the oocyte becomes a zygote 17 (fertilized egg) and gradually moves down the fallopian tube toward the uterus. During the next 5 to 7 days the zygote cell divides into a multicelled morula 18, and then into a hollow ball of cells called the blastocyst 19. At this time, it completes the journey down the fallopian tube and enters the uterine cavity. After remaining in the uterus for a day or so, the blastula hatches out of its thin protein shell (the zona) and then implants into the lining of the uterine wall. Implantation 20 occurs approximately 7 days after ovulation, and once implanted the blastocyst becomes an embryo 21 (FIG. 4).

Figure 5:
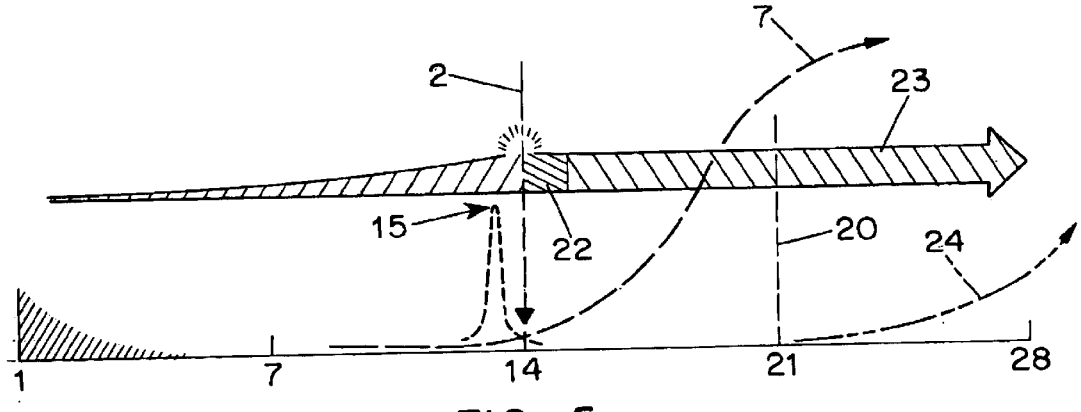
FIG. 5 illustrates the physiologic phases before and after ovulation.

Immediately after ovulation, the emptied ovarian follicle fills with blood mixed with internal granulosa cells. From the influence of the LH surge one day before ovulation, the granulosa cells in the follicular blood clot turn yellow and start to produce large amounts of progesterone hormone. The physiologic term for this transformation is lutenization 22 and results in the formation of the corpus luteum 23 ex-follicle on the ovarian surface. Progesterone hormone is essential to the development and maturation of the lining of the uterus, the endometrium, in preparation for embryo implantation. If implantation occurs, the embryo's placenta starts to produce β-hCG hormone 24 a few days later. This hormone enters the maternal blood stream, and can be measured as the primary component of a pregnancy test (FIG. 5).

When an implanted embryo grows large enough to develop a heart beat, it becomes a fetus. If fertilization or implantation does not occur, the corpus luteum will rapidly shrink and disappear at the end of the luteal phase, resulting in a rapid decline in progesterone production and estradiol production. Once progesterone and estradiol reach very low levels, the next menstrual period begins, completing the menstrual cycle.

In summary, the basic components of the menstrual cycle are:

| | |
|---|---|
| Menstrual Period | Ovulation |
| Cycle Day | Luteal Phase-Increasing progesterone |
| Follicular Phase | Luteogenesis Sub-phase |
| Recruitment Sub-phase | Luteolysis Sub-phase |
| Dominance Sub-phase | Fertilization |
| Growth Sub-phase | Zygote |
| Increasing Estradiol | Morula |
| Decreasing LH and FSH | Blastocyst/hatching |
| Small Increase in Progesterone | Implantation |
| LH Surge | Embryo - β-hCG increases or Decreasing Progesterone and Estrogen |
| | Next Menstrual Period |

Timing of Fertility Tests

A large number of fertility related tests are used to evaluate many of the physiologic functions of mammalian reproduction. Because of the intrinsically coordinated chronological physiology of the menstrual cycle, the timing of most of these fertility tests during the cycle is critical. Tests must be done at the proper time during the cycle in order to have meaningful or useful results.

Fertility tests can be grouped into several broad categories, depending on the basic goal desired. These categories include:

1. Education. A series of tests and/or the related physiologic principles can be arranged chronologically within the menstrual cycle for educational purposes. Students, medical personnel in training, and the general public can benefit from a well organized display of reproduction physiology information designed to clarify the relationship between the basic components of the reproductive cycle. An example would be outlining the various sub-phases of the follicular and luteal phases and their relation to the menstrual period and LH-surge.

2. Contraception Timing. Oocytes and sperm have very limited viable lifespans (about 1 day and up to 6 days respectively) which must overlap properly to allow fertilization and conception to occur. Natural contraception methods work by restricting sexual intercourse to periods excluding the oocyte/sperm overlap phase. A visual graphic based method clearly demonstrating the timing of oocyte and sperm lifespan overlap would increase the accuracy and efficacy of natural contraception based on intercourse timing.

3. Conception Timing. Is the converse of contraception timing as described above. Couples desiring to achieve pregnancy (and who have no fertility medical problems) often wish to conceive at a specific convenient time of the year. This targeted conception timing relies on the same physiologic principle of overlapping the life spans of oocytes and sperm by proper timing of sexual intercourse. Conception family planning would benefit from the same visual graphic based method used for contraceptive planning described above.

4. Infertility Test Timing. Accurate results for most infertility medical tests are obtained only if the tests are done at a specific time during the menstrual cycle. Some tests, such as a hysterosalpingogram x-ray, may be appropriately done any time during a period lasting several days at a certain point in the menstrual cycle. Other tests, such as FSH blood tests for a clomiphene challenge test, must be done on only one exact day of the cycle. A graphic based method for timing these tests would improve the accuracy and compliance and reduce the rate of erroneous results or expensive retesting.

5. Infertility Treatment Timing. Most specific treatments for infertility are effective only if they are done at specific times during the menstrual cycle to coincide with appropriate physiologic events. For example, insemination requires placement of sperm into the uterus at or very near the time of ovulation in order to maximize the chance of fertilization of the oocyte. Accurate timing of infertility medical treatments using a graphic based method can improve the success rate (pregnancy rate) of these therapies.

Timing of conception, contraception, and infertility tests and treatment is a relatively well established science. Timed intercourse, tests, and treatments are somewhat standardized, and are determined by menstrual physiology events. The best dates for scheduling these events are usually determined by physically counting out days on a calendar, medical flow sheet, or by subtracting dates mathematically. Nearly all infertility tests and treatments can be grouped into two basic categories: 1) those that are related to physiologic events determined by the menstrual period (specifically the first day of the menstrual period), and 2) those that are related to the day of ovulation and subsequent ovulation associated physiologic events. These tests and treatments can be equivocally timed by the LH-surge because of its fixed relation to the time of ovulation.

Common Fertility Tests

Figure 6:
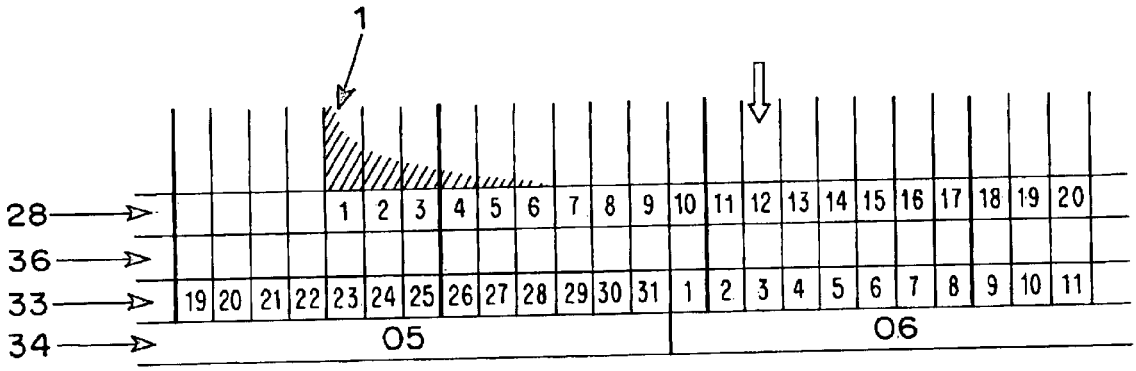
FIG. 6 shows a menstrual cycle tracked on a standard calendar.
Figure 7:
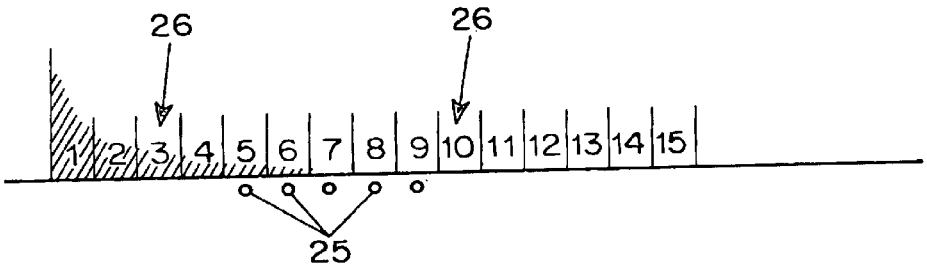
FIG. 7 illustrates a Clomiphene challenge schedule based on the days of the menstrual cycle.

Examples of commonly performed fertility tests include, but are not limited to:

1) Tests Related to the Menstrual Period a) Cycle Day. The medical convention for timing events in the menstrual cycle is to compare the day of the event (or test) to the first day of the Last Menstrual Period (LMP). The first day of a menstrual period is labeled Cycle Day 1 (or CD1), and subsequent days of that menstrual cycle are correspondingly numbered in chronological order—Cycle Day 2, Cycle Day 3, etc. When the following menstrual period starts, the cycle day numbering system starts anew.

b) Calendar Day: This is the standard commonly used date of the month and year which is referenced to the menstrual Cycle Day. A subset of calendar days is the weekday (Monday through Sunday). FIG. 6 illustrates a menstrual period 1 charted on a standard calendar. The cycle days 28, weekdays 36, calendar days 33 and months 34 are shown on the calendar. As shown in FIG. 6, the Late Menstrual Period begins May 23rd, Friday, and Cycle Day 12 is June 3rd, Tuesday (open arrow).

c) Baseline LH and FSH blood tests. The gonadotropin hormones LH and FSH are important guides to determine the ability of the ovary to produce viable oocytes or help achieve regularity in menstrual cycle length. Usually, the FHS level (and occasionally a simultaneously drawn LH level) is obtained on cycle day 1, 2, or 3 in order to obtain physiologically meaningful results.

d) Follicular Phase Sub-Phases. The sub-phases are tied to the menstrual period. Approximate cycle days for these sub-phases are generally:
Recruitment—prior Cycle Day 24 to Cycle Day 5
Dominance—Cycle Day 3 to Cycle Day 10
Growth—Cycle Day 7 to Cycle Day 14 (or ovulation)
These days are general and some authorities will have minor adjustments. The sub-phases tend to overlap.

e) Clomiphene Challenge Test. This test is used to estimate the Ovarian Reserve, which is a physiologic concept used to describe the ability of the ovary to produce viable oocytes, or the resistance of the ovary to fertility drugs. FIG. 7 is a time line of cycle days 1–15 with the menstrual period indicated by the diagonal lines. A patient takes the fertility drug Clomiphene 25 (usually a 100 mg dose each day for Cycle Days 5, 6, 7, 8, and 9) and thus FSH blood tests 26 done on one or two days (typically Cycle Days 3 and 10). The FSH results are added together to obtain a final test result.

f) Semen Analysis. A sperm count can be done anytime during the menstrual cycle. However, the sperm specimen may be useful for other tests or treatments later in the cycle (i.e. sperm count results available before these other dependent tests are done may be very helpful in planning the rest of the cycle tests, and therefore it is convenient to obtain a semen analysis during the early or mid follicular phase of the cycle (Cycle Day 1 to 10).

g) Hysterosalpingogram x-ray (HSG). This is a radiology test which entails injection of radiocontrast (x-ray dye) through the cervix and into the uterine cavity. The dye will then travel through the fallopian tubes reaching the pelvic cavity. An x-ray picture will reveal the size and shape of the uterine cavity along with a trace of the inside of the fallopian tubes. It is designed to check for polyps or defects inside the uterus, or for blocked fallopian tubes. This test should be done after the menstrual bleeding has stopped (or else the dye will get into the blood stream) and before ovulation (or else the dye will blow the oocyte out the end of the fallopian tube). In general most HSG x-rays are therefore done between Cycle Days 6 and 10.

h) Estrogen Blood Tests. These tests are commonly done during treatment cycles when the patient is taking or injecting high dose or gonadotropin fertility drugs (such as Pergonal, Gonal-F, and Follistim). This is usually the case when the patient undergoes In Vitro Fertilization or similar therapy. Several estrogen blood tests (for estradiol) are usually done on specific cycle days during these advanced therapy cycles.

i) Ovarian Fertility Ultrasound Tests. Progress in the development of the ovarian follicle containing the oocyte is often monitored by ultrasound tests during the follicular phase of the cycle. The ovarian follicle diameter increases in size until ovulation, and ultrasound evaluation and measurement of the diameter is used to evaluate oocyte maturity and to determine when the other tests or treatments should be scheduled. Typical ultrasound tests are done on cycle days 1 through 3, cycle day 7, cycle day 10, and/or days beyond 10 on an as-needed basis.

j) Start Day for Urine LH-Testing. Commercial test kits (Ovukit, Ovuquick, First Response, Clear Blue Easy, etc.) are available to the public and are designed to determine when the physiologic LH-surge appears in the patient's urine. This is used to determine the day of ovulation. A typical urine LH test kit consists of plastic sticks or filter paper sensitized to the LH hormone. The test material is dipped into the patient's urine once per day for several consecutive days, then subjected to a simple chemical treatment. When the LH hormone appears in the urine at high concentrations (during the LH-surge) the treated material turns color, marking the time of ovulation. A good urine LH test kit will usually "turn color" the day before evaluation. Because the test kits are expensive, it is economically advantageous to delay the testing period until the chance of ovulation LH-surge (usually randomly between cycle days 11 and 18) is high enough to make testing feasible. The start day or daily urine LH testing is generally around cycle day 10 or 11, but may range between cycle days 7 to 14 depending on the individual characteristics of the patient's menstrual period. These same principles can be applied to blood LH surge.

k) Calculation of Endometrial Biopsy Test Results. An endometrial biopsy test is used to evaluate the condition and maturity level of the lining of the uterus (endometrial lining) and is usually done at the end of the luteal phase. Although the timing of the endometrial biopsy test is usually determined by urine-LH surge or ovulation day, the results of the endometrial biopsy test are often based on the first day of the following menstrual period. Calculation of the endometrial biopsy test result is therefore based on a "negative" back calendar cycle day.

2) Tests Related to the Ovulation Day. Because ovulation day is rigidly and closely linked to the serum (and urine) LH-surge, this series of tests can be timed by the urine-LH test kit results. Similarly, ovulation day can be determined by serial follicular ultrasound tests, or can even be triggered by an hCG hormone injection, so this series of tests can also be timed by serial ultrasound or hCG ovulation trigger injection.

a) Luteal Phase Sub-phases. The luteal phase (after ovulation) is subdivided into two sub-phases, luteogenesis, which lasts from ovulation (approximate cycle day 14) until cycle day 25, and luteolysis, which lasts from approximately cycle day 25 until the end of the menstrual cycle (approximately cycle day 28). Because these sub-phases are determined by certain ranges of days after ovulation, and because ovulation tends to be a random event sometime between cycle days 11 and 18, the luteal sub-phases and other timed events of this series of tests are generally labeled as occurring "so many days after the urine LH-surge" or hCG ovulation trigger injection instead of the "cycle day."

b) Oocyte Fertilization. This generally occurs the day after the urine LH-surge, or occurs approximately 40 hours after the hCG ovulation trigger injection. Once the oocyte has ovulated, it has a fertilization window of approximately 28 hours long before it undergoes degeneration.

c) Embryo Development. A fertilized egg undergoes several stages of development:
   1. Zygote—single celled fertilization egg—lasts 24 hours.
   2. Multi-cell Pre-Embryo—2, 4, 8, 16, 32 cell stages with each cell division about 10 hours long.
   3. Morula—solid multicell embryo for 3 to 10 days after ovulation.
   4. Blastocyst—hollow sphere of cells after the morula stage, usually 5 to 8 days after ovulation.
   5. Hatching—of the blastocyst out of the zone shell occurs approximately 7 to 8 days after ovulation.

d) Embryo Implantation. This usually occurs 7 days after fertilization, which is 8 days after ovulation. The "Pre-Embryo" becomes an official "Embryo" at the time of implantation.

e) Mid-Luteal Progesterone (MLP) Blood Test. This determines whether adequate production of the hormone progesterone occurs after ovulation, and is drawn in the middle of the luteal phase. The MLP test is typically done 5 to 7 days after the urine LH-surge or the hCG ovulation trigger injection.

f) Endometrial Biopsy. The inside lining of the uterus, where embryo implantation takes place, is called the endometrial lining. A small biopsy of this lining is useful for determining its level of maturation, whether it is ready for implantation, summarizes the effect of all of the progesterone in the luteal phase on the uterus, and whether an infection is present which might increase the chance of a miscarriage. As much of the luteal phase as possible should pass before the endometrial biopsy test is done, but if too much time passes the next menstrual period may start a day or two early and ruin the test. The optimal time for the endometrial biopsy is therefore approximately 11 to 12 days after urine LH-surge or hCG injection.

g) Pregnancy Tests. If the patient achieves pregnancy, the placenta begins to make the hCG hormone in the luteal phase. The hCG hormone, especially its β-subunit (β-hCG), reaches a high enough concentration in the blood or urine to be measurable by common pregnancy tests (FIG. 5). The serum blood test for β-hCG is the most sensitive, and will turn positive as early as 5 days after implantation. The common urine test for β-hCG (a "home" pregnancy test) will turn positive as early as 7 to 8 days after implantation. If the serum β-hCG is positive, its concentration is measured and often compared to a second β-hCG concentration 2 or 3 days later. The rate of change in the β-hCG concentration is useful in determining whether the pregnancy is at risk for twins, triplets, miscarriage, or ectopic implantation.

h) Early Pregnancy Ultrasound Tests. Approximately 2½ to 3 weeks after implantation, an early pregnancy grows large enough to be visualized by an ultrasound test. Ultrasound measurements done to calculate the age of the pregnancy are usually of the length of the fetus or diameter of the gestational sac (placenta) and are typically expressed in terms of "gestational age." The gestational age is the time since the first day of the last menstrual period and is therefore two weeks longer than "conceptual age" which is the time elapsed since fertilization. The first gestational ultrasound can be done at 5½ weeks gestational age, approximately 3½ weeks after urine LH-surge or β-hCG injection (or In Vitro Fertilization). Additional ultrasound tests can be done every few days or weeks afterward if indicated.

i) Early Pregnancy Landmarks. These are measured after the day of oocyte fertilization, and are therefore tied directly to the day of urine LH-surge or hCG ovulation trigger injection. Most of these pregnancy stages are illustrated in FIG. 4:
   1. Fertilization—is one day after urine LH-surge or 1 to 1½ days after hCG injection.
   2. Zygote Stage—extends for 24 hours after fertilization.
   3. Morula Stage—generally extends for 3–4 days after zygote stage.
   4. Blastocyst Stage—extends for 4 to 5 days after morula stage.
   5. Embryo Hatching—from the zona shell occurs 6 to 7 days after fertilization, during the blastocyst stage, and about 1 day before embryo implantation.
   6. Embryo Implantation—occurs at the end of the blastocyst stage, approximately 7 days after fertilization.
   7. Pre-Embryo Phase—extends from fertilization to implantation.
   8. Embryo Phase—extends from implantation until the time that a heartbeat is detected by ultrasound tests.
   9. Fetus—Fetal phase extends from the time that a heartbeat is detected on ultrasound tests until delivery of the baby.

j) Other Tests. A number of other tests are done during or after the luteal phase; some are uncommon or specialty tests. These tests can also be timed on certain days after ovulation.

k) Post Coital Test. This test measures the ability of the sperm to travel through the mucus in the cervix on the way to the uterus, and eventually to the fallopian tubes. Best results are obtained on the day of ovulation, so this test is usually done one day after the urine LH-surge or the hCG ovulation trigger injection.

3) Fertility Treatments Related to the Menstrual Period.

a) Fertility Drugs. Most female fertility drugs are taken on predetermined cycle days in order to achieve optimal results. Most of these drugs belong to five general classes—Clomiphene, gonadotropins, GnRH analogs, Ovulation triggers, and Steroid enhancers.
   1. Clomiphene pills. These are usually taken on cycle days 5, 6, 7, 8, and 9 (days 5–9) as 50 mg pills. Doses ranging from ½ pill (25 mg) each day up to 5 pills (250 mg) each day. Alternate cycle days for clomiphene include days 3–7 or days 4–8 or even days 3–9.
   2. Gonadotropins. These include the natural hormones LH and FSH (often labeled hLH and hFSH to designate the h=human form of the hormones). Commercial names for these drugs include Pergonal or Repronex (½ hLH and ½ hFSH), and Follistim or Gonal-F (hFSH only). These drugs are administered as injections in doses in increments of 75 IU (international units). One 75 IU dose=1 "amp" (ampule) of medication, and typical doses range from ½ amp (37 IU) up to 8 amps (600 IU) on specific cycle days, usually starting on cycle day 3 and extending every day or every other day through most of the follicular phase of the cycle.

3. GhRH analogs. These are also labeled "GnRHa", are drugs based on the natural GnRH hormone which controls the physiologic production of LH and FSH hormones in the pituitary gland. These drugs are administered as injections or nasal sprays in doses ranging from 1/50 mg twice daily up to 1 mg per day, usually starting during the previous menstrual cycle luteal phase, up to the current cycle day 2, and continuing until ovulation. Commercial names include Lupron and Syneril.
4. Ovulation Triggers. These may include the natural hormone LH (not yet commercially available), but currently the hCG hormone is packaged as an ovulation trigger in the form of a single one-time injection. Ovulation is triggered by the hormone approximately 40 hours after the injection. This hormone will also mature the oocyte so that it is ready for fertilization by the sperm. Commercial names include Profasi or Sterus.
5. Steroid Enhancers. The steroid hormones estrogen, progesterone, and cortisol are sometimes used to enhance the action of other fertility drugs. Estrogen in the form of ethinyl estrogen is used to boost the endometrial lining in mid to late luteal phase, progesterone can be used to trigger the LH-surge or suppress ovarian cysts, and cortisol derivatives such as dexamethasone or predisone can be used to increase the effect of clomiphene or reduce miscarriage rates.

b) Hysterosalpingogram x-ray (HSG). This involves injecting x-ray contrast (dye) through the cervix and into the uterus and fallopian tubes, then exposing one or more x-ray films. This test should be done after the end of the menstrual period, but before a possible early ovulation, generally between cycle days 6 and 10.

c) Certain Surgical Procedures. Some procedures such as laparoscopy have cycle day limitations to avoid disrupting a potential pregnancy in the luteal phase, or to obtain the best visualization environment. The endometrial lining is often best viewed by hysteroscopy during the mid-follicular phase.

d) Timed Intercourse or Intercourse Restrictions. Natural family planning conception or contraception are usually based on cycle days from the last menstrual period, not on ovulation tests. By the time an ovulation test tums positive, it is generally too late to restrict intercourse because sperm already present in the uterus can live long enough to last until ovulation.

4) Fertility Treatments Related to the Ovulation Day a) Timed Intercourse. Natural family planning conception (but not contraception) can be more accurately planned or scheduled by ovulation tests in order to maximize the chance of fertilization of the egg. Timed intercourse (abbreviated TIC) is most efficiently done the day after the urine LH-surge or one to two days after the hCG ovulation trigger injection.

b) IntraUterine Insemination. This involves injecting a washed sperm sample directly into the uterine cavity at the time of ovulation. The IntraUterine Insemination (IUI), or the closely related IntraCervical Insemination (ICI) is typically done the day after the urine LH-surge, or about 36 hours after the hCG trigger injection.

c) Egg Capture (E.C.). This is a high tech procedure required for in Vitro Fertilization, G.I.F.T., or Z.I.F.T. procedures, and involves aspirating oocytes from ovarian follicles using an ultrasound-guided or laparoscopy-guided needle. Very accurate, careful timing is required so that the oocytes have time to mature, but not enough time to begin ovulation. Egg Capture is usually done 34 to 36 hours after hCG trigger injection.

d) G.I.F.T. Laparoscopy. This is a high tech fertility treatment that requires egg capture and gamete transfer to be done under laparoscopic guidance. As noted above, this surgery is done 34 to 36 hours after hCG trigger injection.

e) Embryo Transfer (E.T.). This is a high tech in Vitro Fertilization procedure which entails careful injection of a few embryos into the uterine cavity, usually 2 to 5 days after egg capture.

f) Frozen Embryo Transfer (F.E.T.). This entails injecting embryos left over from previous In Vitro Fertilization cycles (kept in frozen storage) into the uterine cavity. Depending upon the specific FET-cycle protocol used, the embryos are transferred on a specific cycle day, or on a day determined by ultrasound monitoring, urine LH-surge, or hCG injection.

g) Progesterone Hormone. This hormone is taken to enhance the luteal phase tissue response of the uterus to improve implantation or reduce miscarriage. Progesterone in the form of vaginal suppositories, injections, gels, or microencapsulated pills is usually started the day after TIC or insemination, the day of embryo transfer, or a few days before frozen embryo transfer.

h) Other Therapies. These may include speciality drugs to reduce the chance of miscarriage or improve embryo implantation. These include heparin and low-dose aspirin.

In summary, numerous tests and fertility treatments are optimally done at specific times during the menstrual cycle. Some are done at times determined by the first day of the menstrual period (cycle days), while others are done a specified number of days before or after the ovulation day.

The Calculating Device

The various time period restrictions for fertility tests and treatments are established by menstrual or ovulation physiology. During the last few decades, scheduled dates for these tests and therapies have been determined by counting cycle days on calendars, sometimes with the assistance of graphical aides such as flow sheet, calendar charts, basal body temperature charts, or gestational wheels. Pocket electronic calculators and calendars have also proven beneficial in determining optimal dates for scheduling and performing tests and treatments. However, all of these commonly used methods involve some means of physically counting days on a calendar or chart, or physically entering data into a calculator or computer. The methods are time consuming and subject to error propagation. A simple, easy to use, intuitive graphic device capable of rapidly calculating and displaying the optimal time to perform all of the various fertility tests and treatments would be very useful for physicians, students, medical personnel, and the general public to improve reproduction and contraceptive efficiency. The instant invention achieves these goals in the form of a simple calculating device which accurately determines timing of fertility tests and treatments, contraception methods, and natural family planning. The device is easy to use and read, and accommodates variations in menstrual cycles and fluctuations of the time of ovulation in different women.

In achieving the instant invention, several problems were overcome. Starting with a slide-rule calculator format, one problem was bridging cycle days over calendar dates at the end of each month, because months have different lengths ranging from 28 to 31 days. Another problem was adjusting for variability of timed tests that are dependent upon each other.

The first problem was addressed by using a single cycle day scale to be adjusted along multiple different calendar date scales, each representing a boundary between months of standard lengths. Examination of the yearly calendar revealed five typical transitions between months:

```
       Dec. Jan. Feb. Mar. Apr. May June July Aug. Sept. Oct. Nov. Dec.
days   31---31---28---31----30---31---30---31--31---30---31----30--31
           w  Z1   Z2    x     y    x    y    w   x    y     x    y

where: w = 31-31 x = 31-30 y = 30-31 Z1 = 31-28 Z2 = 28-31
```

Figure 8:
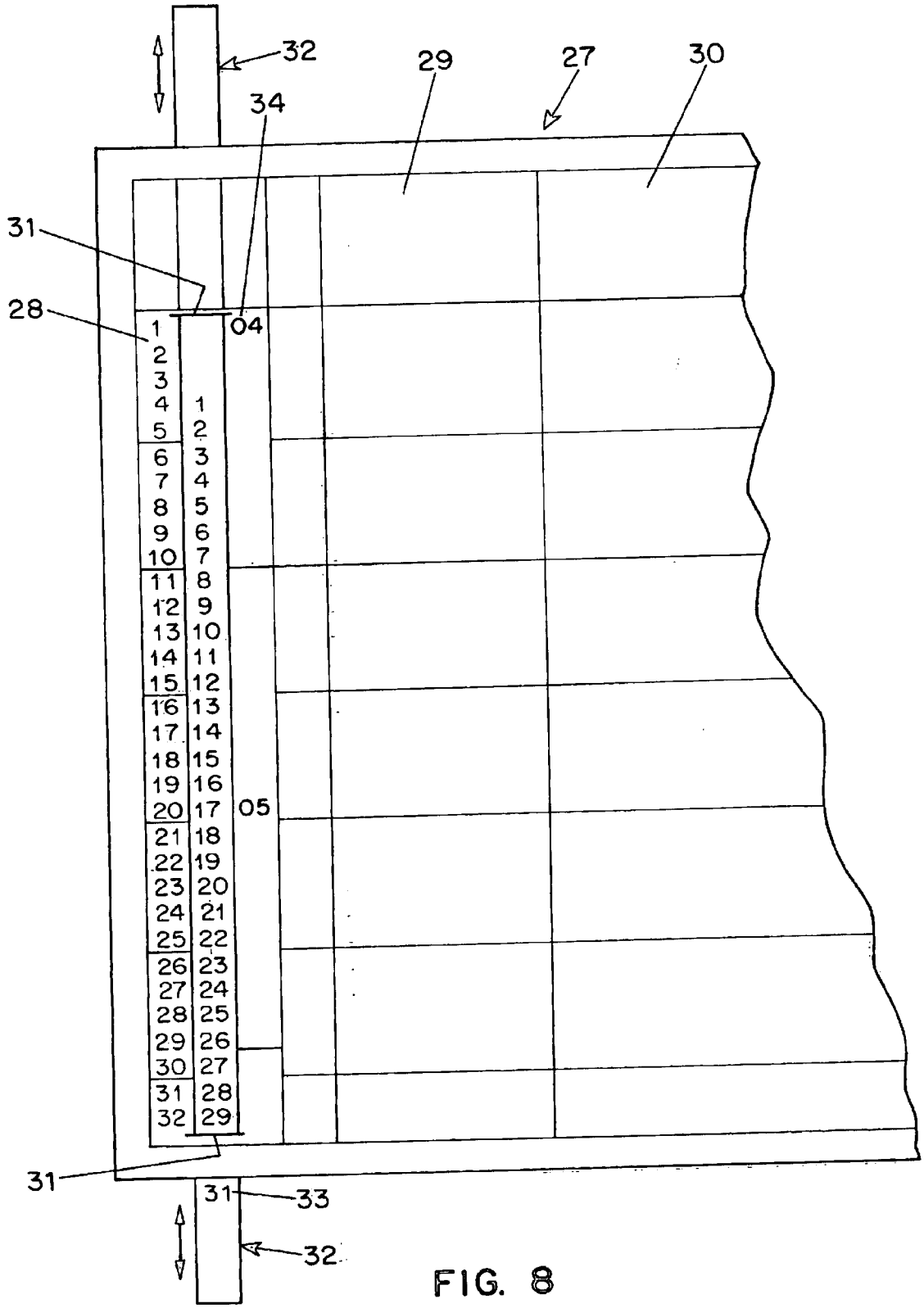
FIGS. 8, 9, 10A and 10B show slide-rule type calendars.
Figure 9:
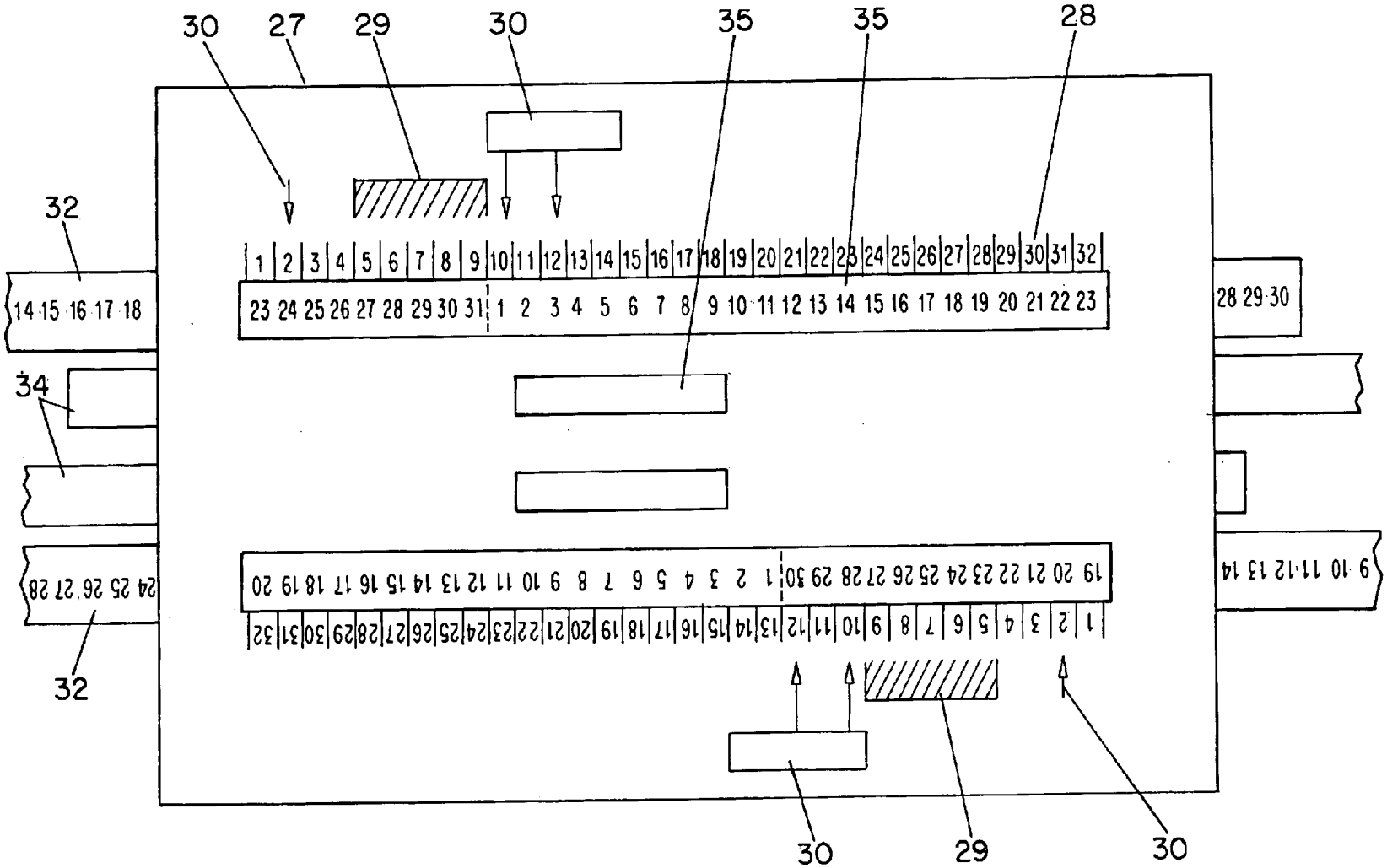
Figures 10A, 10B:
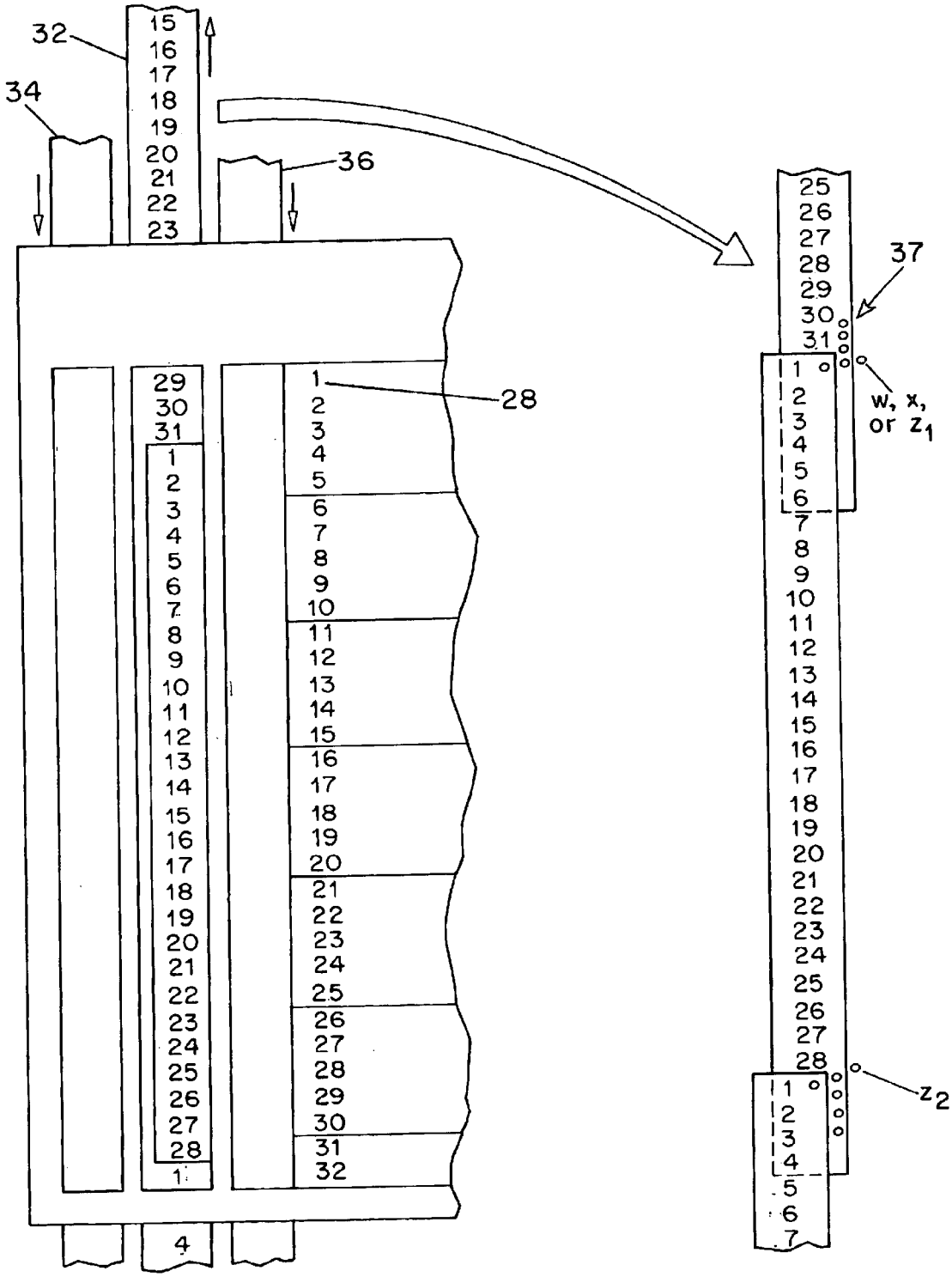

The slide rule calculator was made using a base 27 printed with fixed cycle days 28, medications 29 and tests 30 (FIG. 8). Slits 31 cut in the base receive a sliding adjustable strip 32 with calendar days 33 printed on it. The months 34 may be printed on an additional sliding adjustable strip. Because most menstrual cycle lengths (about 28 days) are shorter than calendar month lengths (30 to 31 days), the menstrual cycle usually will not cross over more than one month to month boundary. Slide rule designs incorporating 4, 5, or 6 windows 35 (for w, x, y, $z_1$, $z_2$, and $z_1$–$z_2$) accommodates standard menstrual cycles, each window having its own cycle day scale (FIGS. 9, 10A and 10B). An additional sliding adjustable strip with the days of the week 36 may be added. In order to accommodate the different month-to-month transitions (w, x, y, $z_1$, $z_2$), the date strip is made of adjustable overlapping strips 37 (FIG. 10B). Fertility tests and treatments done on certain cycle days are printed on the cycle day scale. Operation of the slide rule calculator involves sliding the calendar day scale along the cycle day scale until the first day of the menstrual period is aligned to the proper calendar date using the appropriate calendar transition month (w to $z_2$), then reading the calendar dates for each test or treatment where they are aligned with the labeled cycle day. A separate, independently sliding weekday scale 36 labeled Monday through Sunday (as a repetitive—MTWTFSS) was added alongside the other two scales, and, when properly adjusted along the calendar date scale, allows for minor changes in scheduling tests and treatments to avoid weekends or other "blackout" days.

Figure 24A:
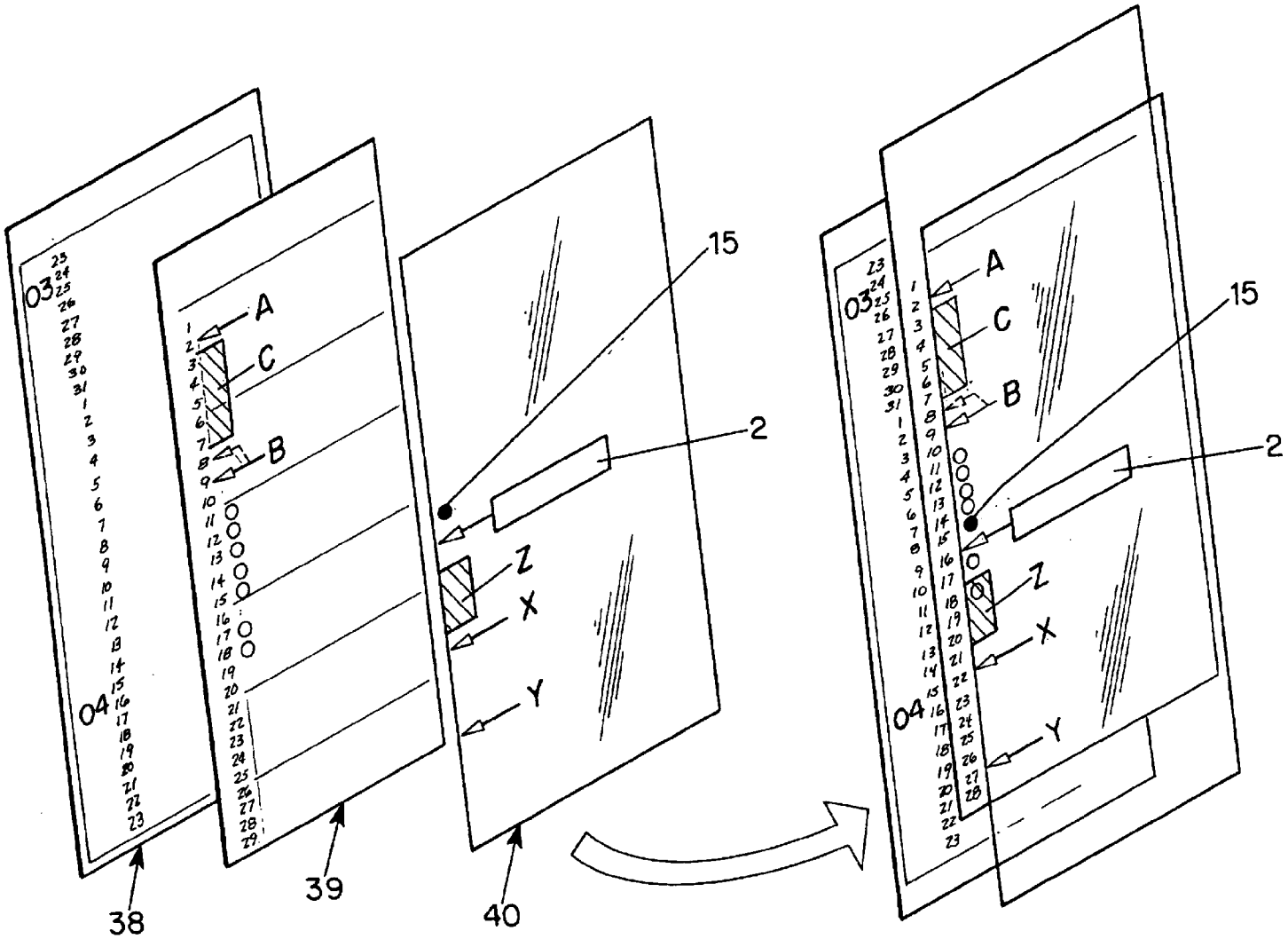
FIGS. 24A and 24B show the assembly of slide-rule type calendars for fertility tests and treatments.

The second basic problem to be overcome was adjusting for variability of timed tests that are dependent upon each other. That is, some tests cluster into related groups (e.g. clomiphene pill days and FSH blood test days are rigidly fixed to specific cycle days), and other tests are not directly dependent on each other's specific timing (e.g. the day of Intrauterine Insemination is not related to the timing of clomiphene pill days). However, only two inter-related groups of tests actually exist: 1) those related directly to the menstrual cycle which are scheduled on specific cycle days, and 2) those related directly to ovulation which are scheduled a specific number of days before or after ovulation day. In order to properly time or schedule tests from both of these groups, a slide rule calculator was designed with one fixed calendar date scale 38 and two independently adjustable sliding scales, one for cycle days 39 with related cycle day dependent tests A and B, and medication C printed on it, and one for ovulation day 40 with LH surge 15, ovulation 2 and related ovulation day dependent tests X and Y, medication Z printed on it (FIG. 24A). The calendar and cycle day scales are preferably opaque and the ovulation day scale is preferably transparent.

To use this calculator, the first day of the menstrual period is located on the calendar date scale and Cycle Day #1 on the cycle day scale is aligned with the appropriate calendar date by sliding the cycle day scale into the proper position. Once an ovulation test is positive (or ovulation trigger injection given), the ovulation day scale is moved into its proper position to align with the appropriate calendar date. For example, as shown in FIGS. 24A and 24B, if the menstrual period starts on March 25th, the cycle day scale is adjusted along the calendar date scale (Mar–Apr) until cycle day #1 aligns with "March 25." When the urine LH-surge is positive on April 8th, the ovulation day scale is adjusted until the LH-surge marker aligns with "April 8." The calendar dates for any and all of the fertility tests and treatments can now be read directly from the marked positions on the cycle day and ovulation day scales.

Figure 24B:
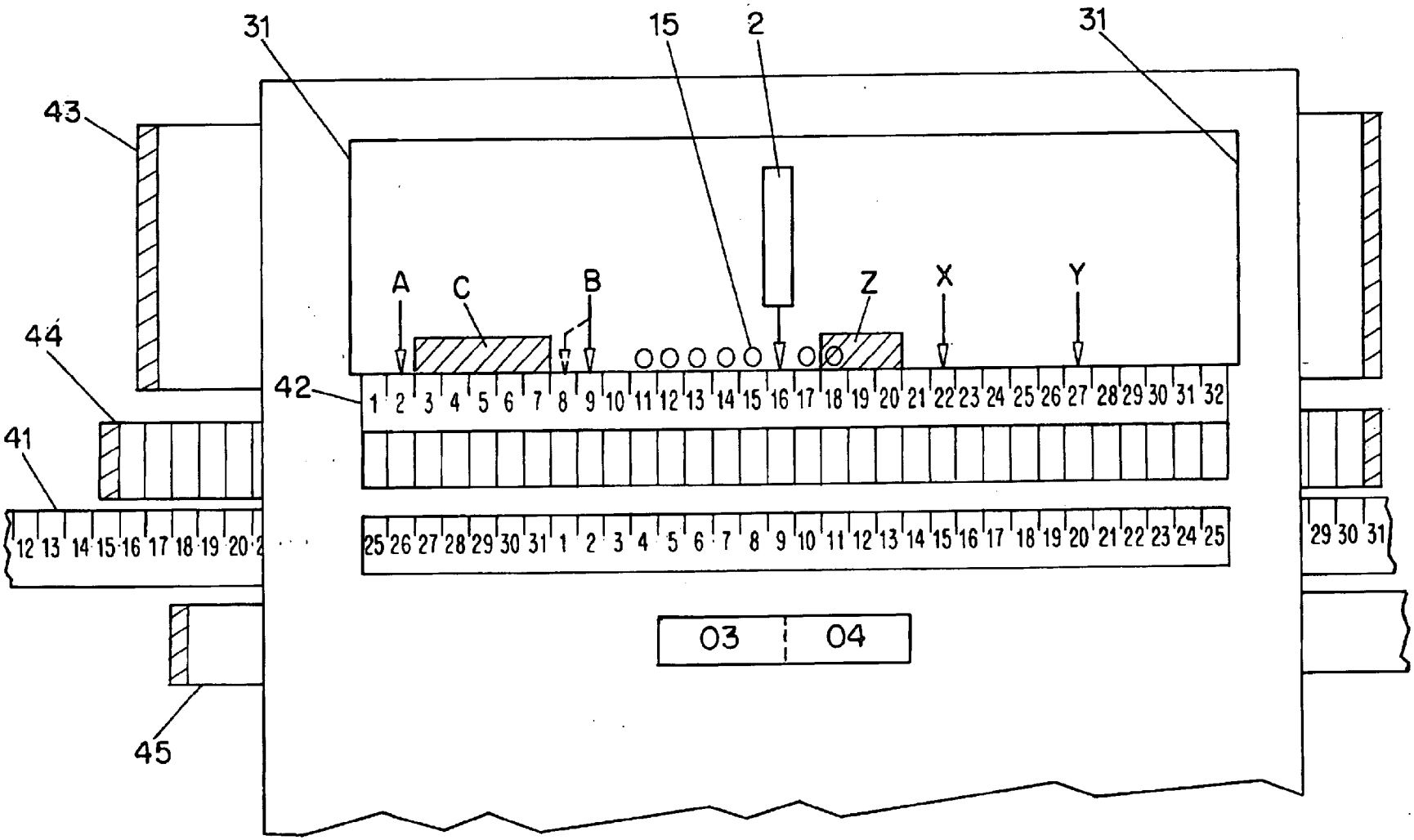

Another embodiment of the side rule calculator uses four scales, calendar date scale 41, fixed cycle day scale 42 with related cycle day dependent tests A and B, and medication C printed on it, ovulation day scale 43 with related ovulation day dependent tests X and Y, medication Z printed on it, and weekday scale 44, in four or five windows (w–$z_2$) (FIG. 24B). Any of the four scales can be assigned the "fixed" scale, with the others the sliding scales arranged in any order, A particularly desirable arrangement is a fixed calendar data scale, then weekday scale, then cycle date scale, and then ovulation day scale. An additional, optional month sliding scale 45 can be included. One problem encountered with this system was the fact that because ovulation day is variable along the cycle day, occasionally early ovulation would adjust the ovulation day scale so far down the cycle day scale that some of the cycle day tests or treatments would be covered-up and hidden by the ovulation day page. A solution to this problem was to print the ovulation day scale on transparent plastic or celluloid, so the underlying page and scale with its markings and tests can be seen regardless of the position of the ovulation day scale.

Figure 23:
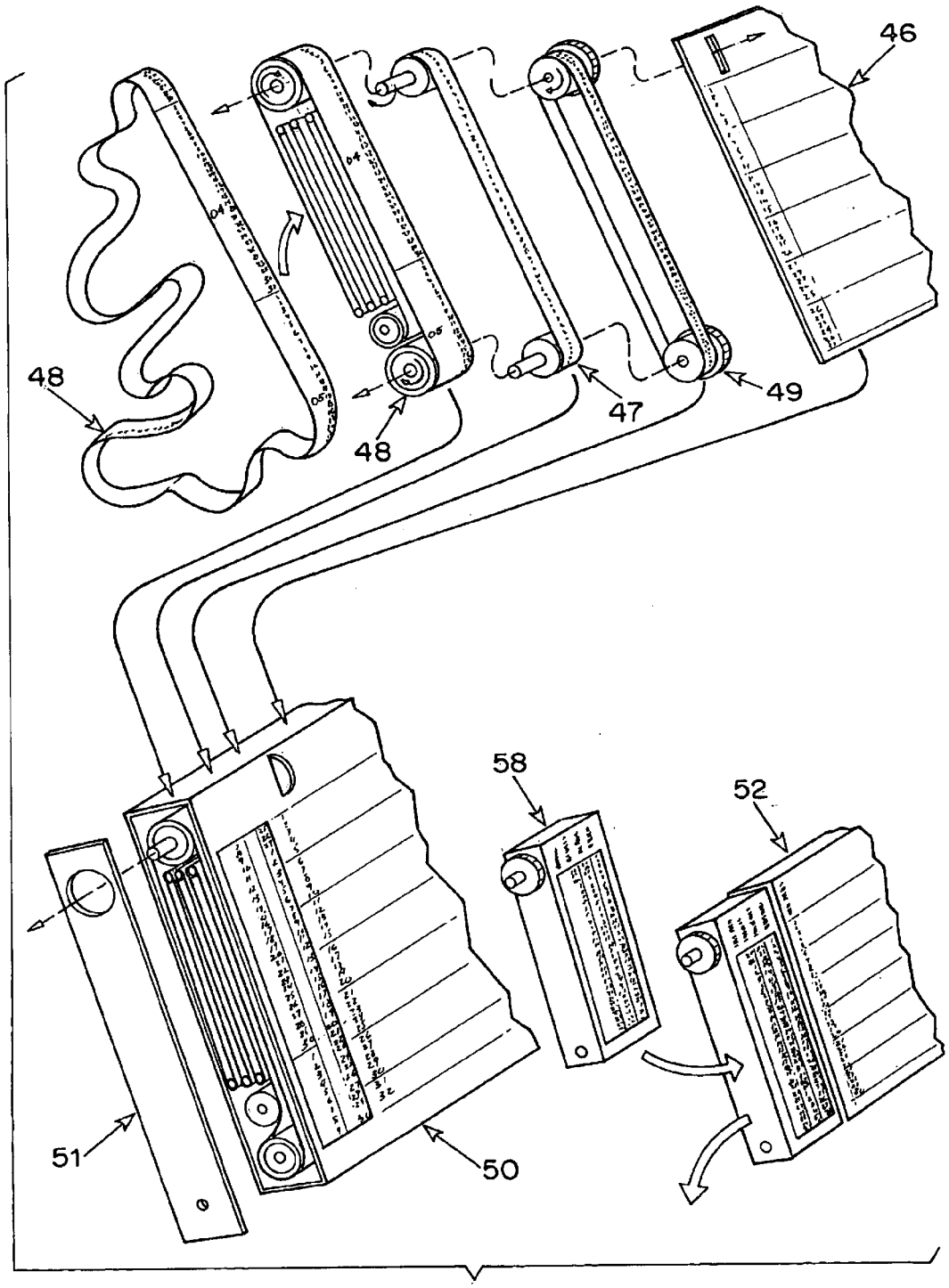
FIG. 23 shows the assembly of an exchangeable leap year module for a slide-rule type calendar.

A further embodiment of the slide rule calculator is a modular calendar with an exchangeable leap year calendar module (FIG. 23). A fixed cycle day plate 46 with cycle days consecutively numbered from 1 to at least 32 along the edge attaches to an exchangeable calendar module. The calendar module has a weekday strip 47 with each end attached to rotating cylindrical rollers, with weekday notation (MTWTFSS) printed in a vertical column. The cylindrical rollers are connected to another set of rotating cylindrical rollers holding a circular calendar strip printed with either the standard 365 day calendar or the 366 day leap year calendar 48. In another embodiment, the calendar modules are exchangeable to allow for use in either a regular 52 or leap year 53. An optional adjusted cycle day strip with longer cycles may be added 49. The cycle day plate 46 and calendar module are contained in a housing 50 with a removable end cover 51 for replacing the calendar strips.

Figure 25C:
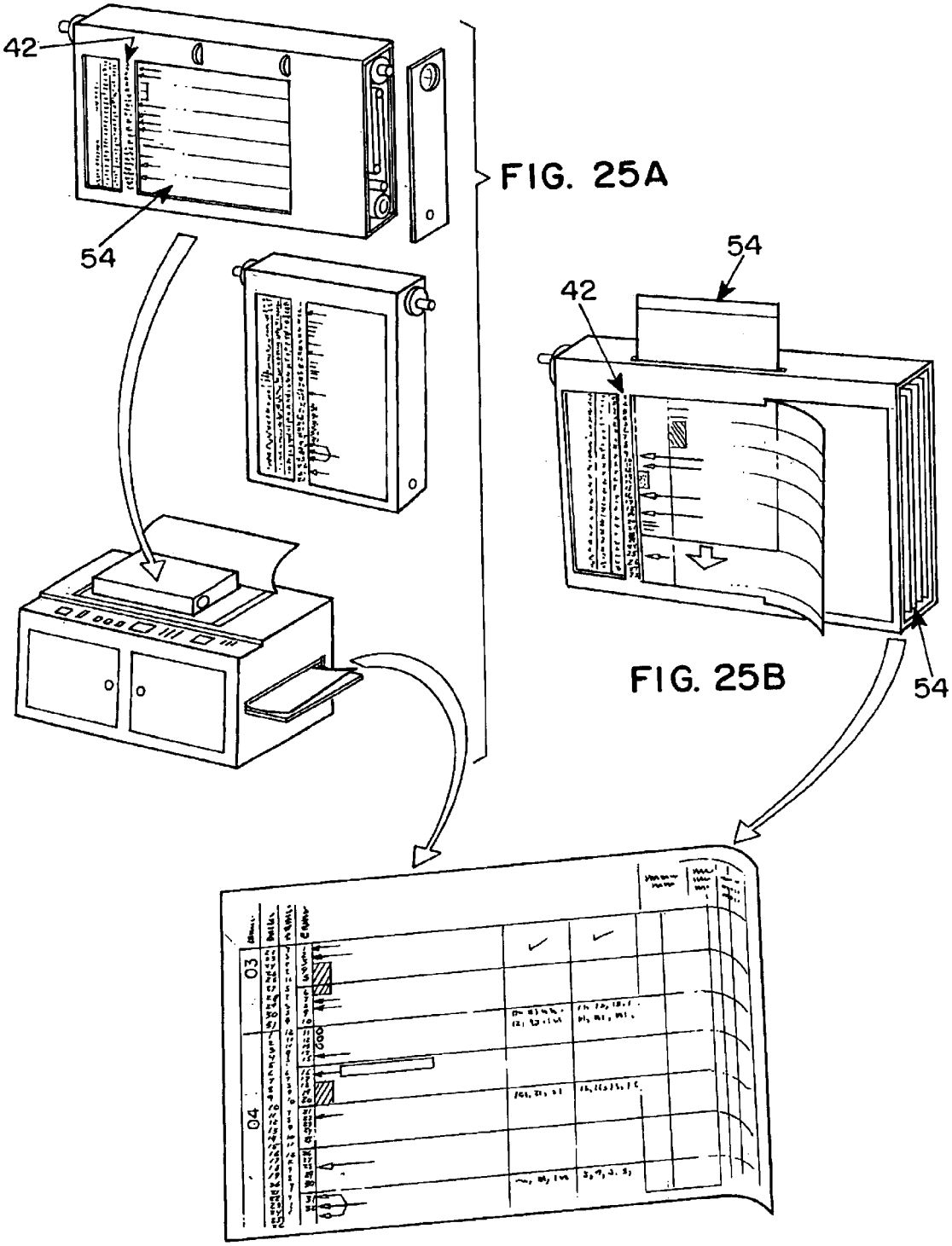

The modular calendar also preferably includes ovulation day cards 54 listing various testing, treatment and physiologic phases. The ovulation day cards are lined up with the corresponding cycle day 42 (FIGS. 25A–25C). Once a calculation is made, the module is photocopied to achieve a permanent record (FIG. 25C).

Although the linear side rule fertility calculator functions well for most menstrual cycle on most calendar days, a problem remained. Some of the longer menstrual cycle (over 31 days) would occasionally overlay two month-to-month boundaries defeating the $x–z_2$ system of linear calendar date scales. Longer fixed cycle day scales with long rectangular windows for sliding scales would solve part of this problem, but multiple new calendar date scales derived from various combinations of $w–z_2$ would be needed and tracked, significantly increasing the complexity of the calculator.

Figure 11:
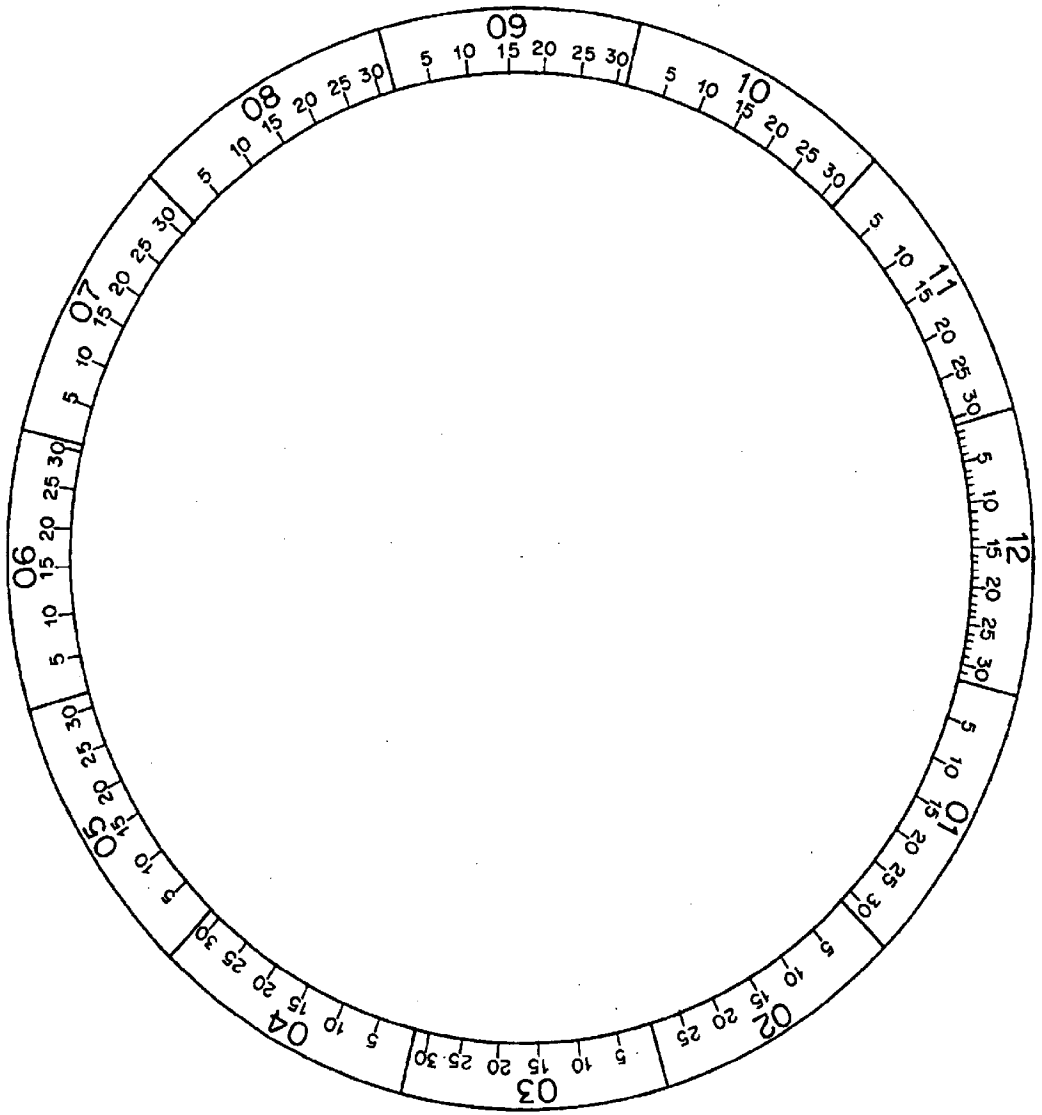
FIG. 11 shows a 365 day calendar base.

A solution is a circular side rule calculator, with the calendar day scale consisting of a circle divided into 365 equal days (FIG. 11). The absolute dates clustered into months chronologically arranged around the circle would automatically allow any adjustable scale (also printed on concentric circle divided into 365 days) to align with the calendar scale, preserving all month-to-month boundaries perfectly. Each day occupies less than 1° of arc, so an easily readable scale with markers or written information corresponding to various days would have to be 18 to 24 inches in diameter, which is large for a portable calculator, but is suitable for wall or desk calculators.

Figure 14:
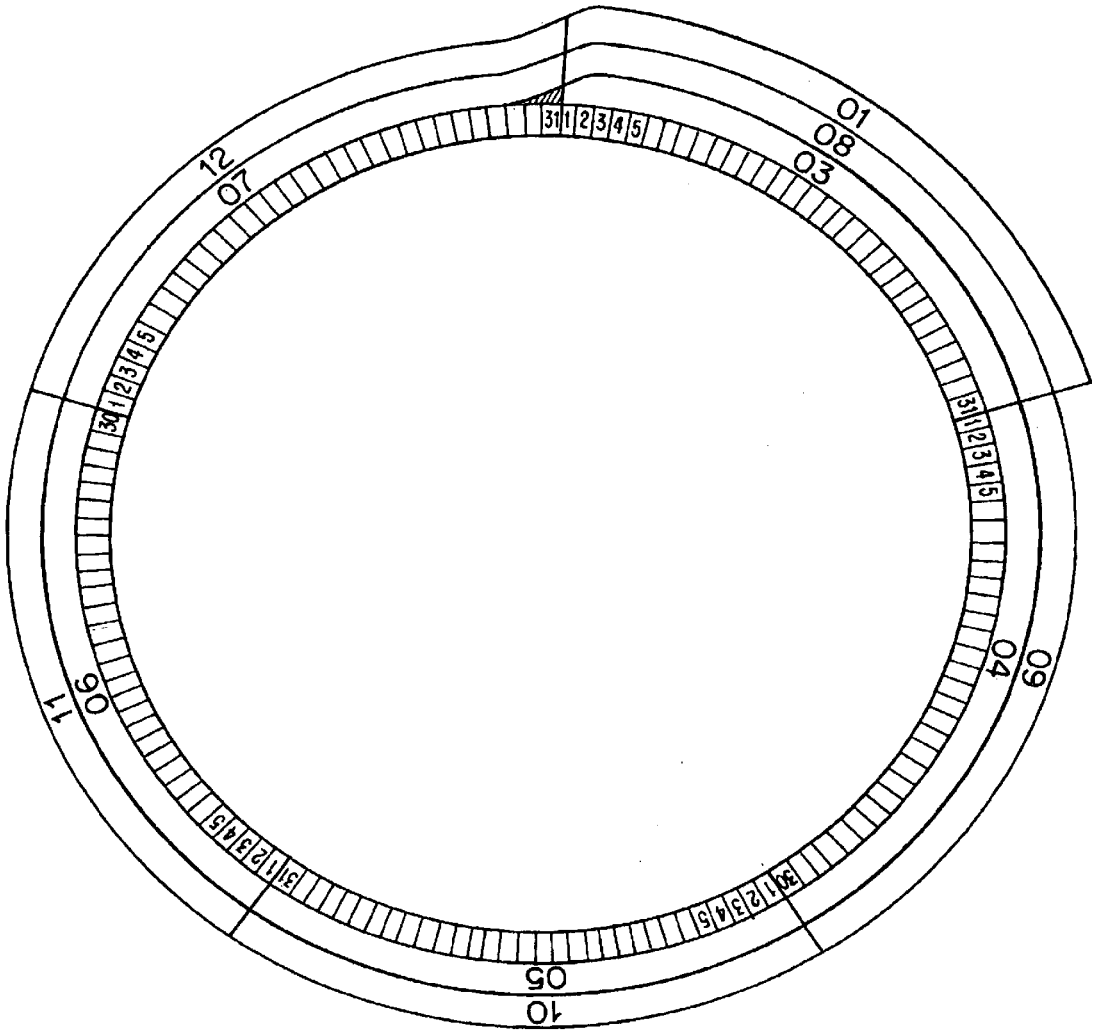
FIG. 14 shows the 153 day base with March through January represented.

In researching ways to obtain a circular calculator of small size to be portable, while having the days of sufficient size to be easily read, it was discovered that the same pattern of month lengths from March to January repeats exactly, so these months can be bent into a circle of "5 months" circumference. With the exception of February, a "spiral" circular arrangement of chronological months can be made that preserves all month-to-month boundaries perfectly and yields high day size resolution (FIG. 14). The months from March to January can be separated into two groups of months with 31, 30, 31, 30 and 31 days, which total 153 days. This produces a "day size" of 2.35° of arc, nearly 2½ times larger than a 365 divided circle, so a readable circular fertility calendar can be reduced to around 8 inches in diameter.

Figure 37A:
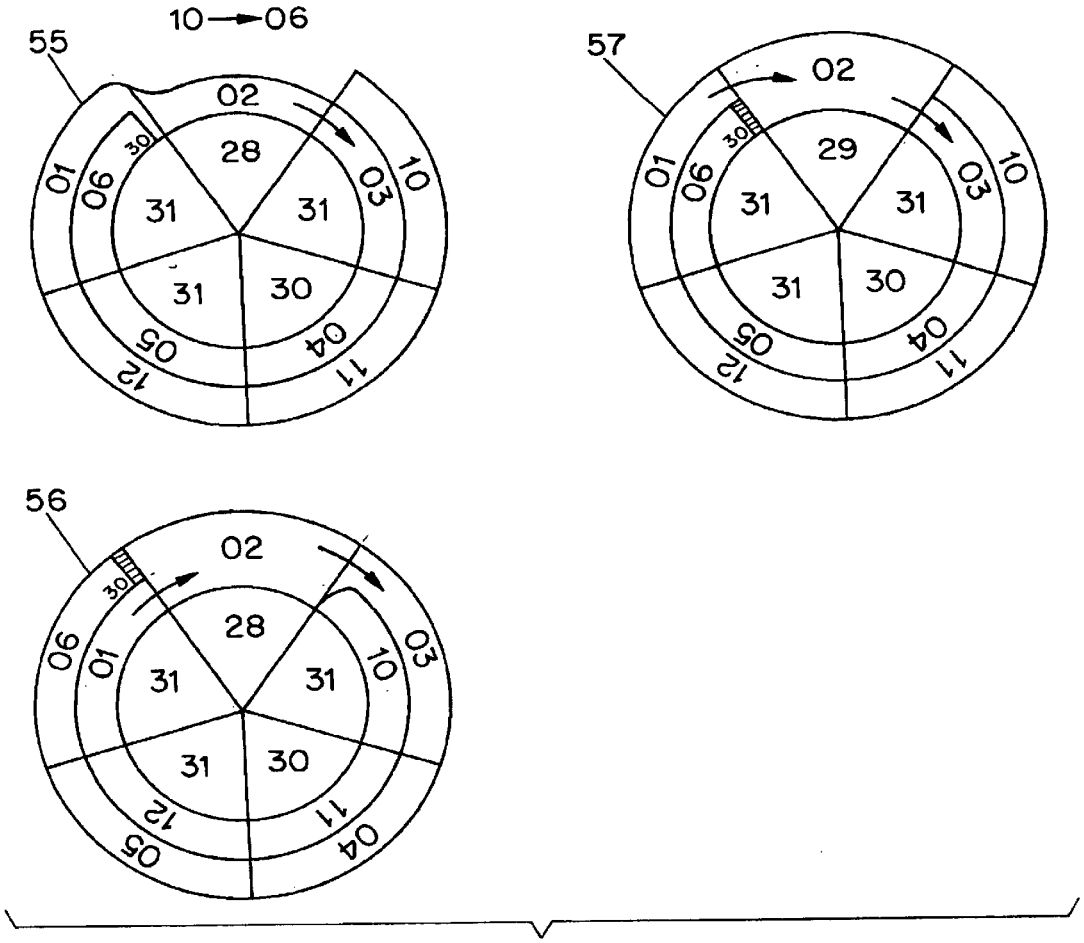
FIGS. 37A and 37B show alternate embodiments of the calendar with 151 and 150 days, respectively.

An alternative version of the base calendar, having the months from October to June, is shown in FIG. 37A. This produces a base with 151 days around the circular calendar. The months can be labeled to spiral from the outside to the inside 55, or from the inside to the outside 56. A corresponding leap year plate 57 is made simply by changing the February month from 28 to 29 days.

Figure 12:
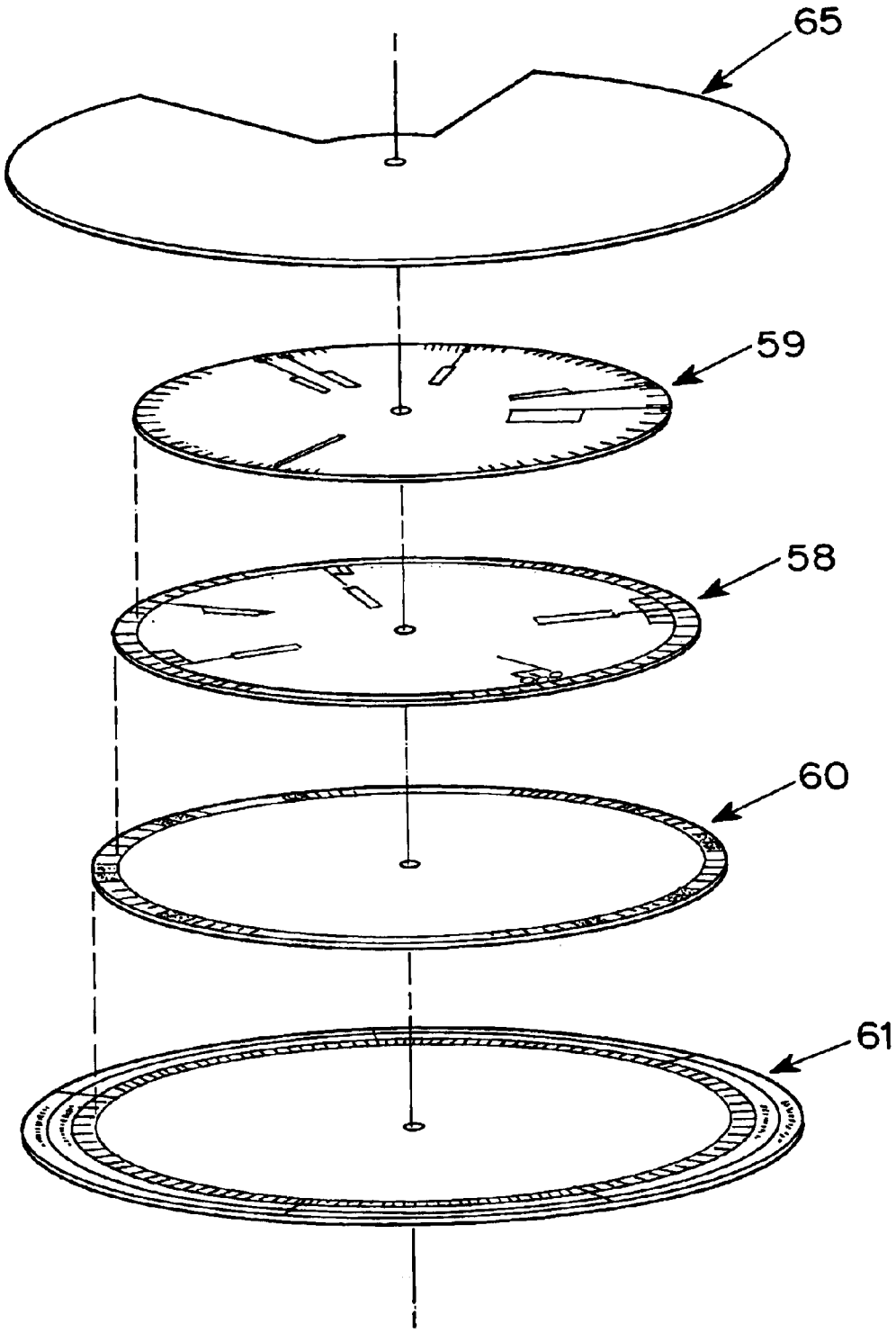
FIG. 12 illustrates the assembly of the calendar base, optional day of the week disc, middle disc, top disc and mask.
Figure 13A:
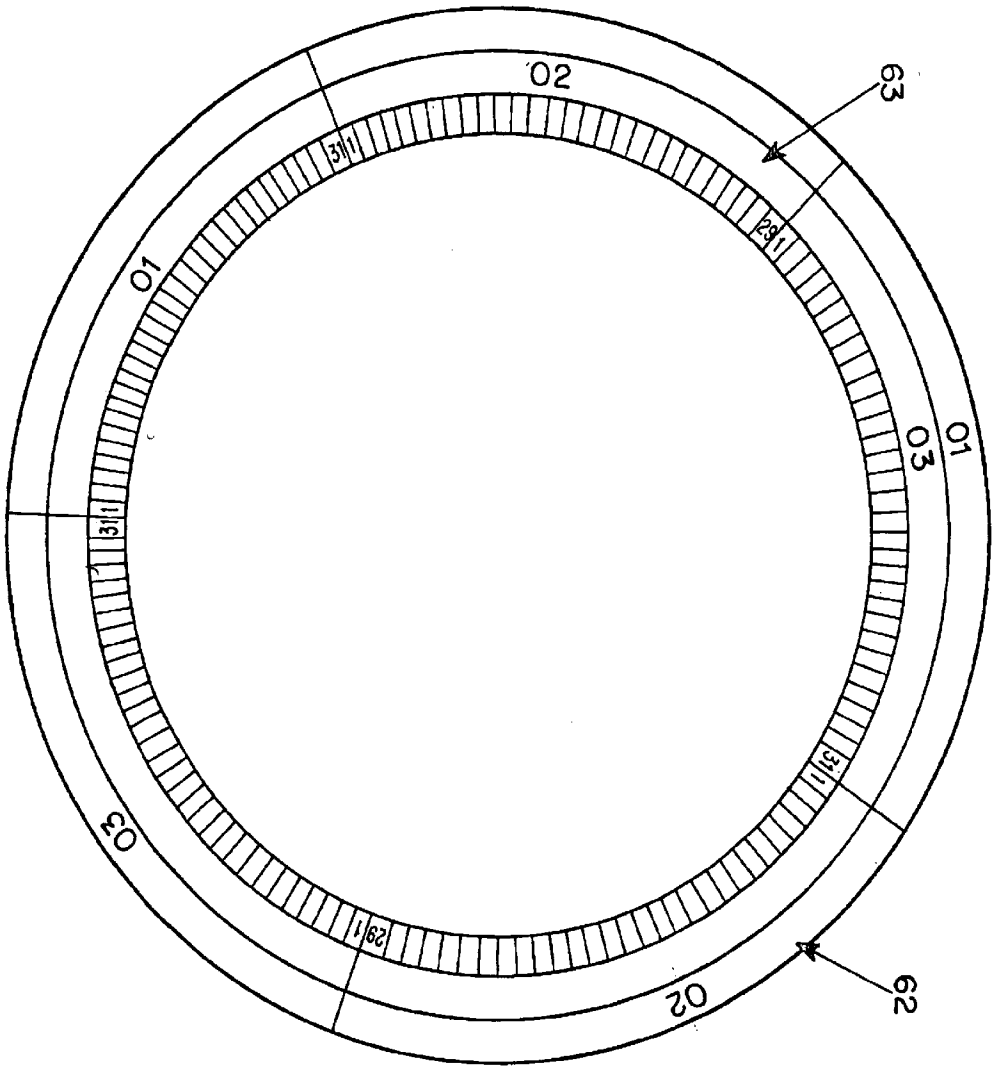
FIGS. 13A and 13B show the 150 and 153 day scales for February and leap year February and the months before and after.
Figure 37B:
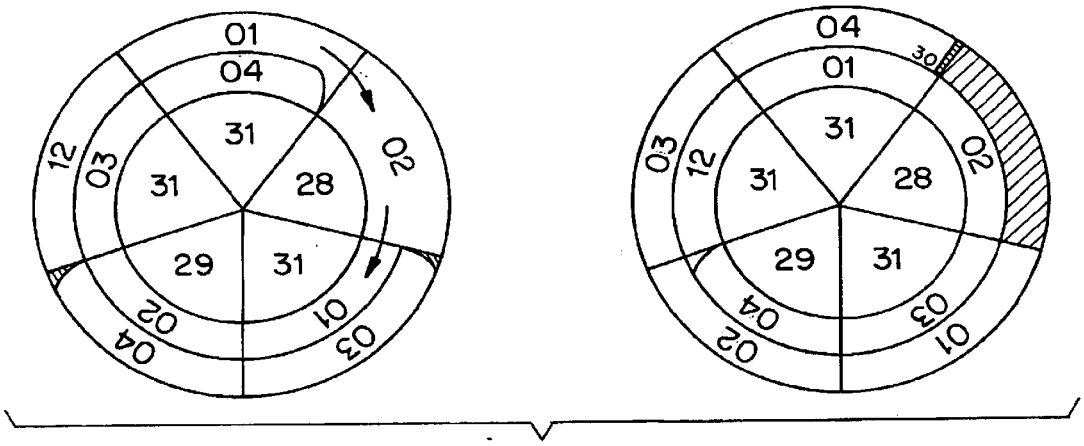

These arrangements of the calendar date scale can serve as the basis for a circular fertility calendar, with concentric circular discs for cycle day 58, ovulation day 59, calendar day 61, and optional weekday 60 added in a manner analogous to the linear slide rule calculator (FIG. 12). However, the problem of fitting February and its month-to-month boundaries into the calculator remained. In one embodiment, a separate circle is used, which allows enough room to incorporate both leap February 62 and regular February 63 calendar scales into a single calculator to include leap years. The months on each side of February (January and March) both contain 31 days, so they can be overlapped while preserving the month-to-month boundaries, leaving an arrangement of "5 months" similar to the January-to-March calendar scale, as shown in FIG. 13A. This calendar may be extended to include most of April and leap April, as shown in FIG. 37B.

The advantages of this system include similar sized circular calendar scales for the March-to-January and the February-leap February displays. This allows the two scales to be printed on each side of a single calculator. The entire year (including leap years) can be incorporated onto a single, small, portable fertility calculator preserving all month-to-month boundaries, and maintaining readable day size resolution.

Further examination of the two calendar scales reveals similar division day sizes:

| | |
|---|---|
| March–July, August–December, January | 31 + 30 + 31 + 30 + 31 = 153 days |
| January–March (regular and leap February) | 31 + 28 + 31 + 29 + 31 = 150 days |

Figure 13B:
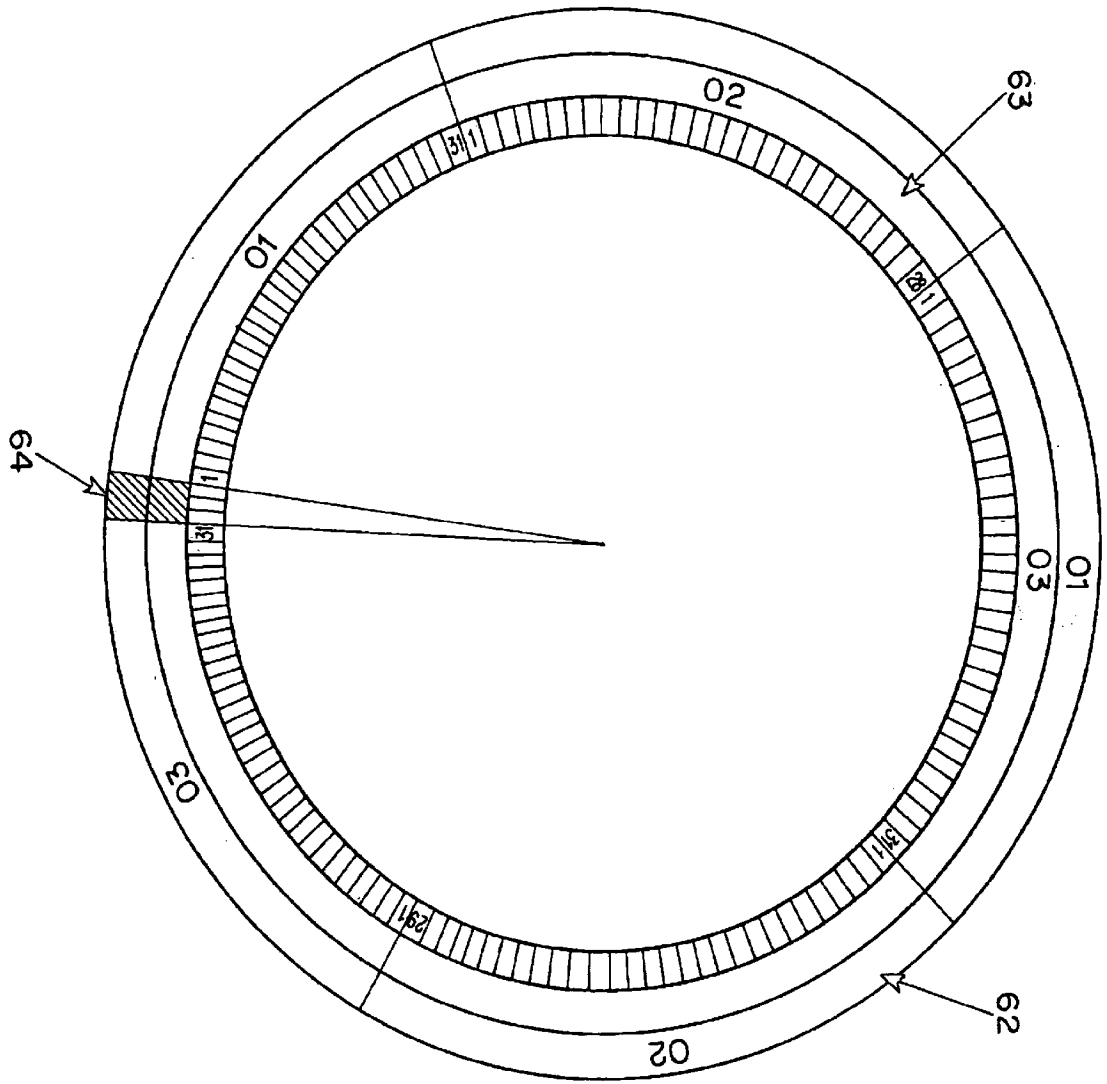
Figure 38A:
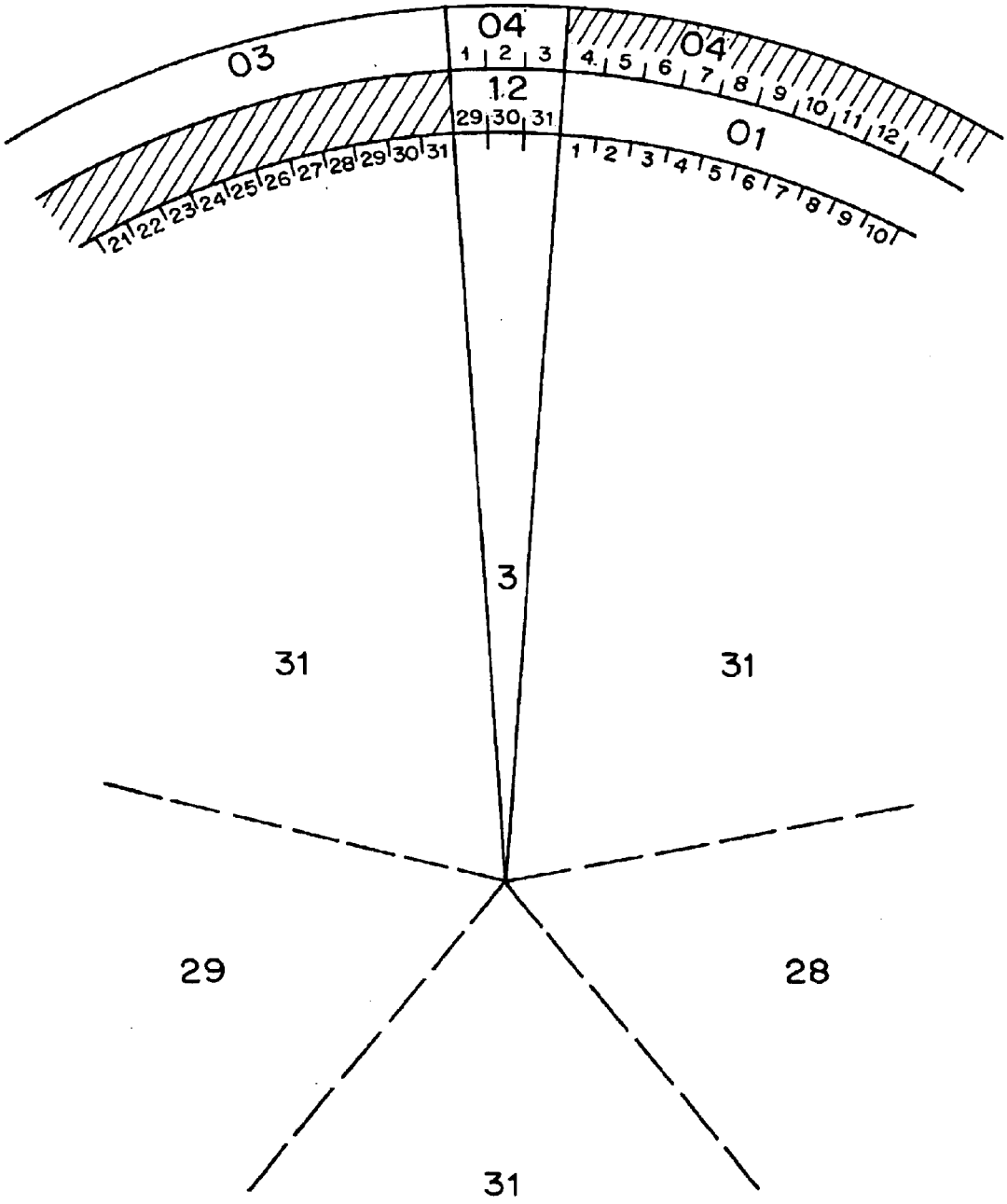
FIGS. 38A and 38B illustrate alternate embodiments of the leap year calendar.
Figure 38B:
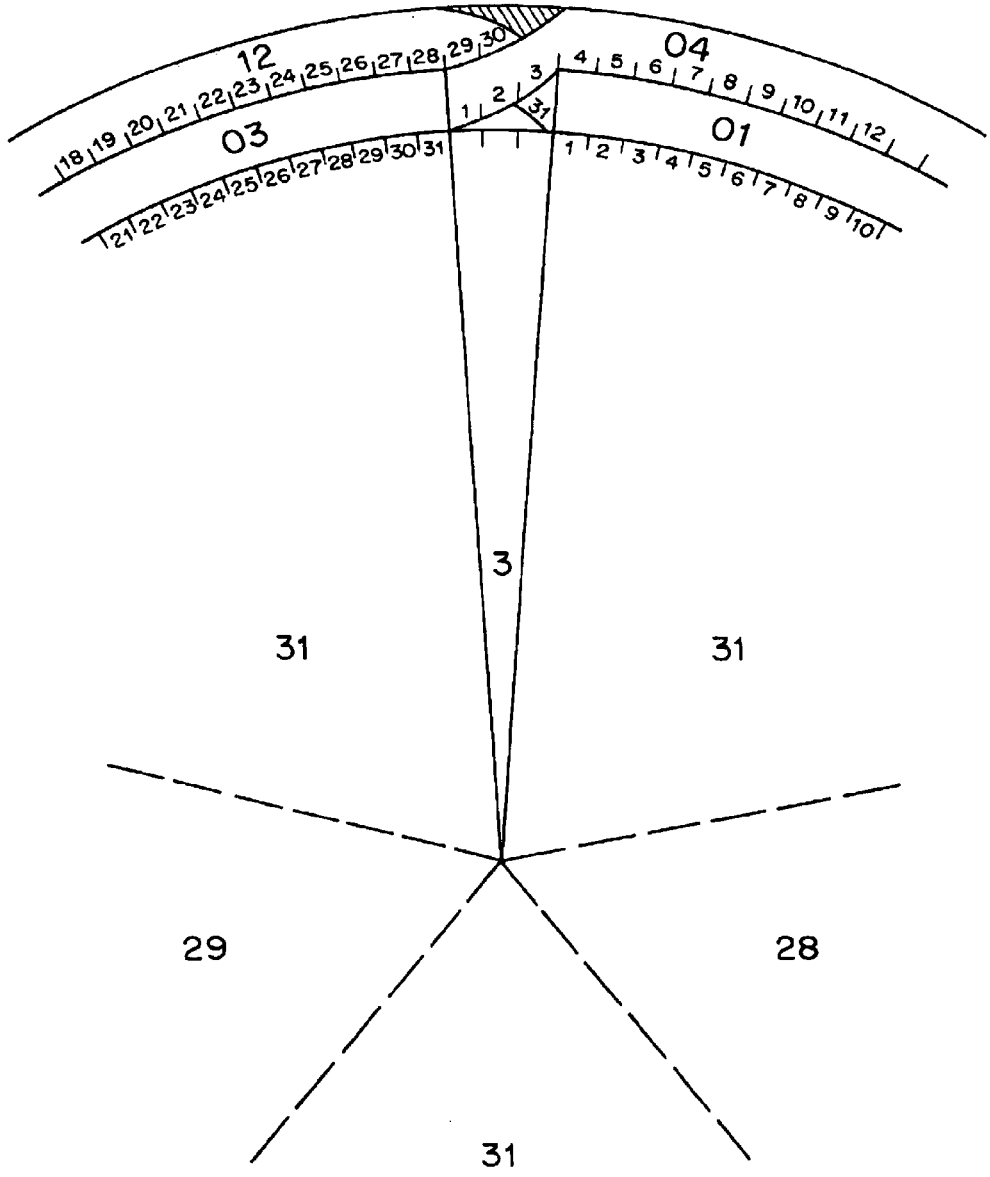

There is a 3-day difference in the two calendar date scales. Because of the high accuracy in fertility tests and treatment requirements, many procedures must be done on an exact day or date. This means that the other adjustable concentric scales for cycle day, ovulation day, and weekday cannot be directly interchanged between the March-to-January calendar scale (153 days) and the regular and leap February calendar scale (150 days), unless some adjustment in the scales is made to give them an equal number of days around a full circle (and therefore exactly equal day sizes). The addition of three blank "filler" days to the regular and leap February calendar scale accomplishes this feat (FIG. 13B). The three extra days on the 153 days leap year scale can be used as short extensions for the last three days of December and the first three days of April, as shown in FIG. 38A. In another embodiment, the three extra days are used to provide the entire months of April and December, as shown in FIG. 38B.

Once this adjustment is made, the other movable scales can be interchanged between calendar scales. This reduces the cost of the calculator because two sets of manufactured movable scales are reduced to only one set. The flexibility of the calculator is improved because different movable scales can be switched from one side of the calculator to the other.

By incorporating some of the original design of the linear slide rule calculator into the two circular calendar date scales, a very efficient, functional design of a fertility calculator was produced. The working parts of the calculator are the base 61, the middle disc 58, and the top disc 59, along with an optional weekday disc 60, and the mask 65 (FIG. 12). The base is considered the fixed scale, and the discs are adjustable rotating "sliding" scales, all with a concentric fulcrum center point. The calendar date scale, cycle day scale, ovulation day scale, and weekday scale can be assigned to any of the base, middle, and top discs in any order, but the description below represents the preferred embodiment.

The base is the calendar date scale. There are actually two scales on the base, a March-to-January scale and a regular and leap February scale, composed of the respective calendar date scale printed on a surface. The most preferred embodiment is a two-sided flat, substantially rigid base with the March-to-January scale printed on one side and the regular and leap February scale printed on the other side. Each scale consists of 153 equiangular parts, representing one day apiece, and arranged in a radial outer circle with a large diameter. The day of the month is printed chronologically as a single or double digit numeral inside each division around the circle at the same large radius.

Figure 19A:
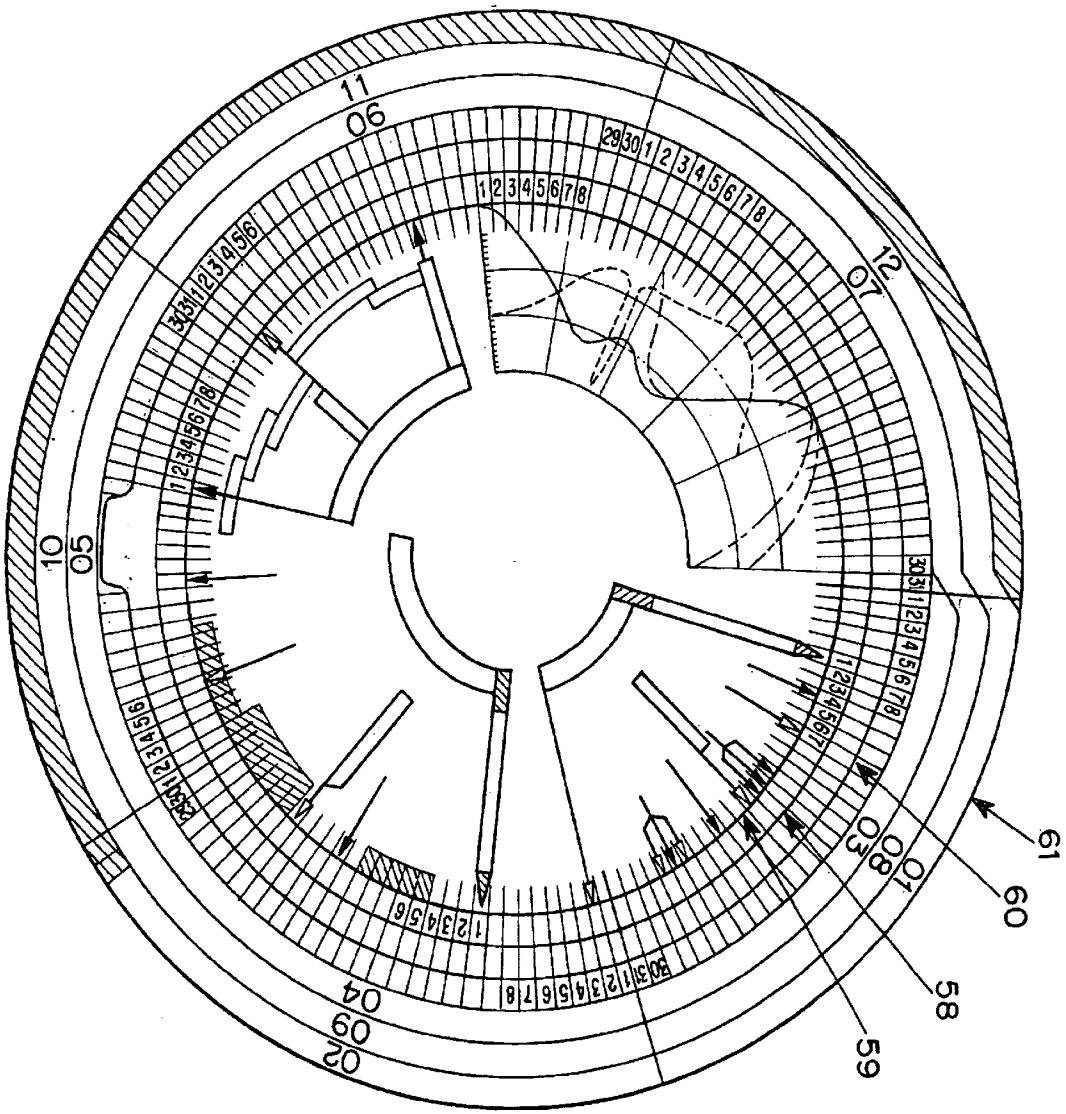
FIGS. 19A and 19B show an assembled calendar for calculating time periods and dates associated with the menstrual cycle and fertility treatments and therapies, without and with a mask, respectively.

Arranged on the outside perimeter of the numerical day circle are two or three concentric rings, each divided into 5 aligned segments (or a spiral with 2 or 2⅕ turns divided radially into 5 segments). Beginning on the outermost ring (or end of spiral) each segment is labeled with a month in chronological order. On one scale the second segment has 30 equiangular parts and is labeled "April" and "September", the third segment has 31 equivalent parts and is labeled "May" and "October", The fourth segment has 30 equiangular parts and is labeled "June" and "November", and the fifth segment has 31 equiangular parts and is labeled "July" and "December". The first segment is labeled with one or more of "March", "August" and "January" (FIG. 19A).

On the other scale, the segments are arranged in either of two formats. In one format, the first segment has 31 equiangular parts and is labeled "January" the second segment has 28 equiangular parts and is labeled "February", the third segment has 31 equiangular parts and is labeled "March" and "Leap January", the fourth segment has 29 equiangular parts and is labeled "Leap February", and the fifth segment has 31 equiangular parts and is labeled "Leap March", respectively, in clockwise fashion around the scale (FIG. 13A). In the other format, the first segment has 31 equiangular parts and is labeled "Leap January", the second segment has 29 equiangular parts and is labeled "Leap February", the third segment has 31 equiangular parts and is labeled "Leap March" and "January", the fourth segment has 28 equiangular parts and is labeled "February", and the fifth segment has 31 equiangular parts and is labeled "March", respectively, in clockwise fashion around the scale.

Figure 15:
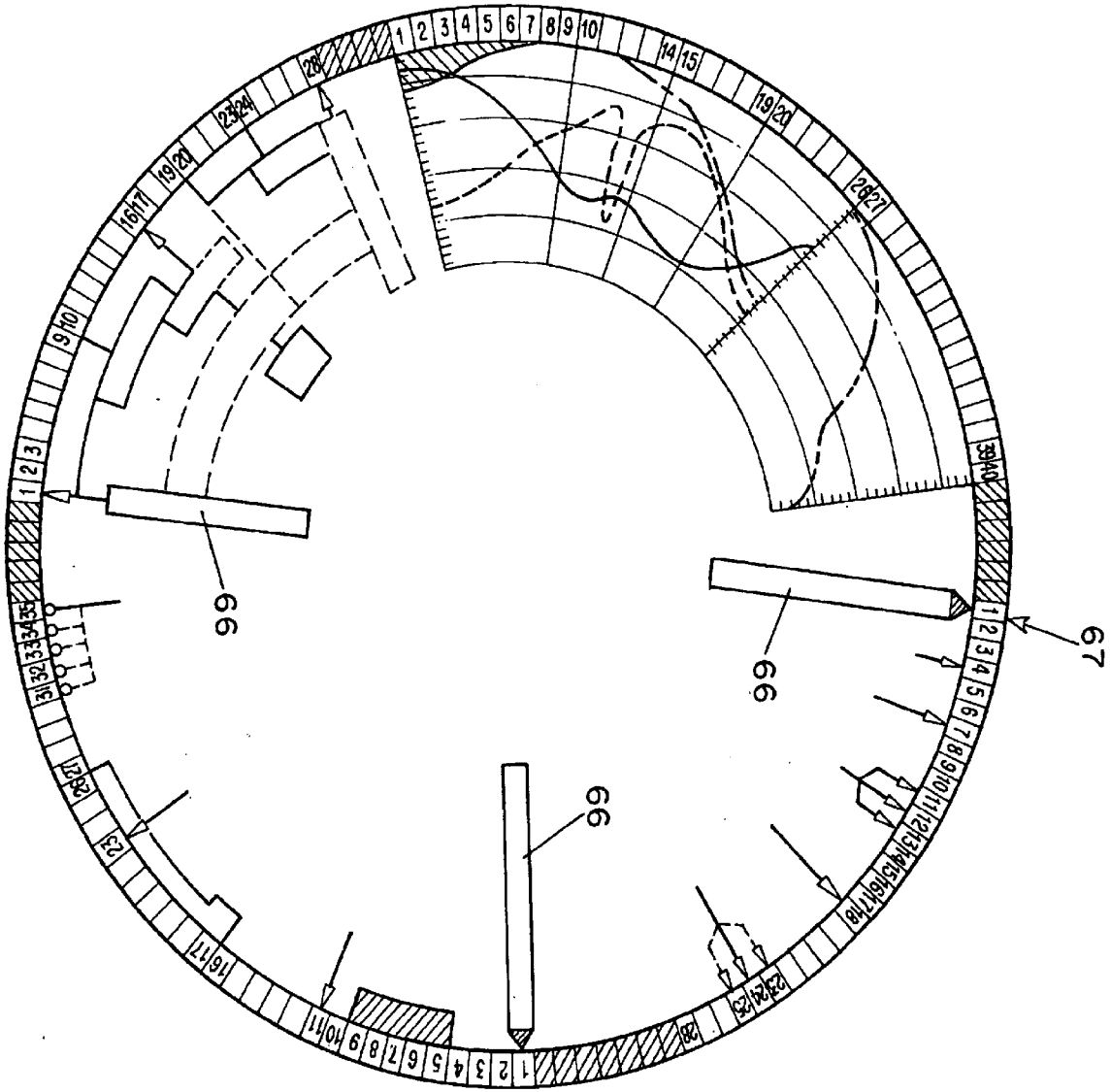
FIG. 15 shows a middle disc labeled with menstrual cycle days and initial steps in various treatments.

The inside edge of the printed portion of the base, along the day numeral side, will be adjacent to the outside edge of the middle disc. The middle disc is the Cycle Day disc (FIG. 15). This disc consists of 153 equal printed divisions along the outside edge which align with the adjacent 153 divisions on the underlying base. The middle disc rotates around a center pint fulcrum, concentric with the base. Cycle days are printed as one or two digit numerals inside the equal divisions at the same radius along the outside edge of the disc. This forms the cycle day scale with consecutive numbers beginning with 1 and ending with a number corresponding to whatever cycle length chosen for a particular calculation. Multiple menstrual cycles, preferably of different lengths, may be printed on the disc. Cycle day number 1 is also labeled as "Last Menstrual Period" 66, and other cycle days can be labeled with graphical representations of associated tests or treatments (FIG. 15). Once the middle disc is rotated until the menstrual period "Cycle Day 1" 67 label is aligned (opposite/adjacent) to the appropriate calendar day on the base, any other cycle days are read directly from their respective adjacent calendar days. Any fertility test or treatment related to the menstrual period, and this printed on the middle discs, is also automatically aligned with the proper calendar day on the base. Tests and treatments can be timed or scheduled at a glance using this simple rotational alignment.

Figure 16:
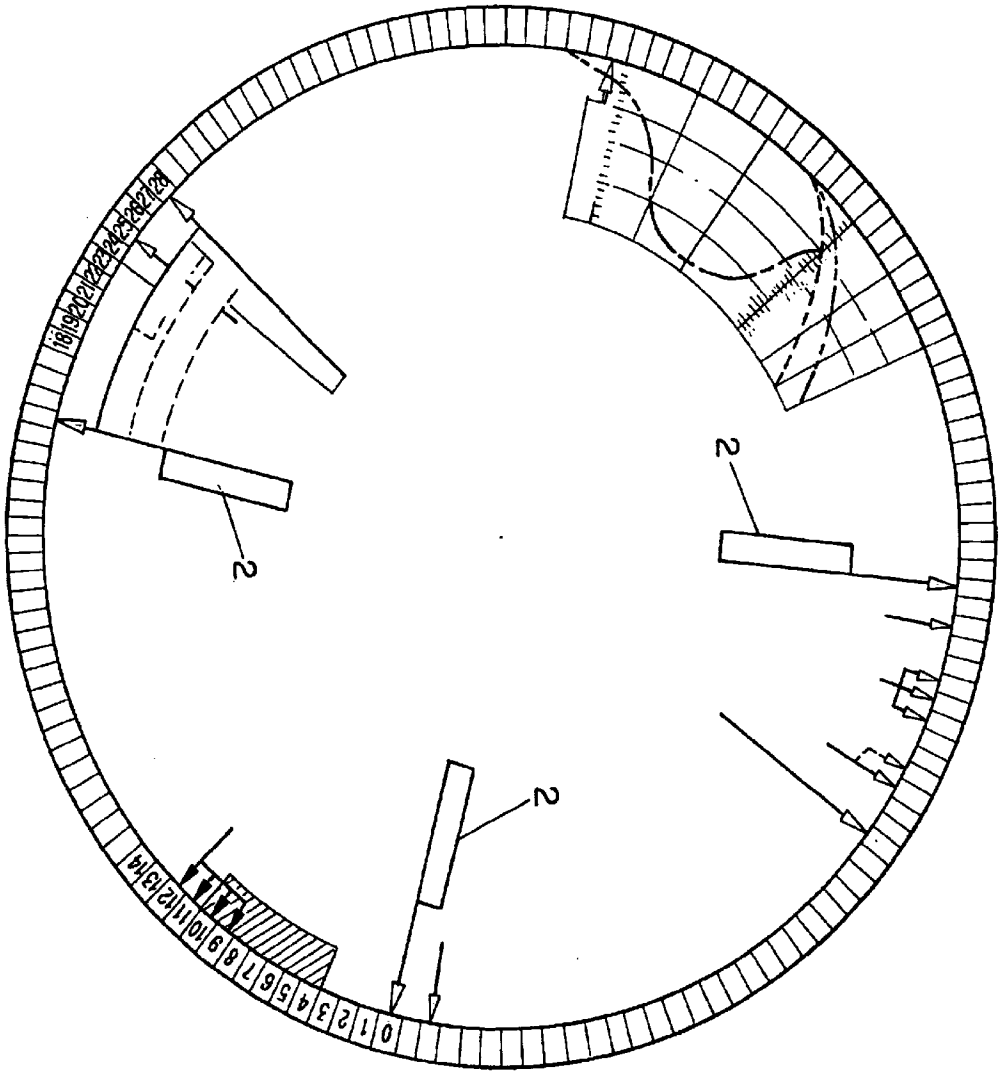
FIG. 16 shows a top disc labeled with ovulation day and final steps in various treatments.
Figure 17:
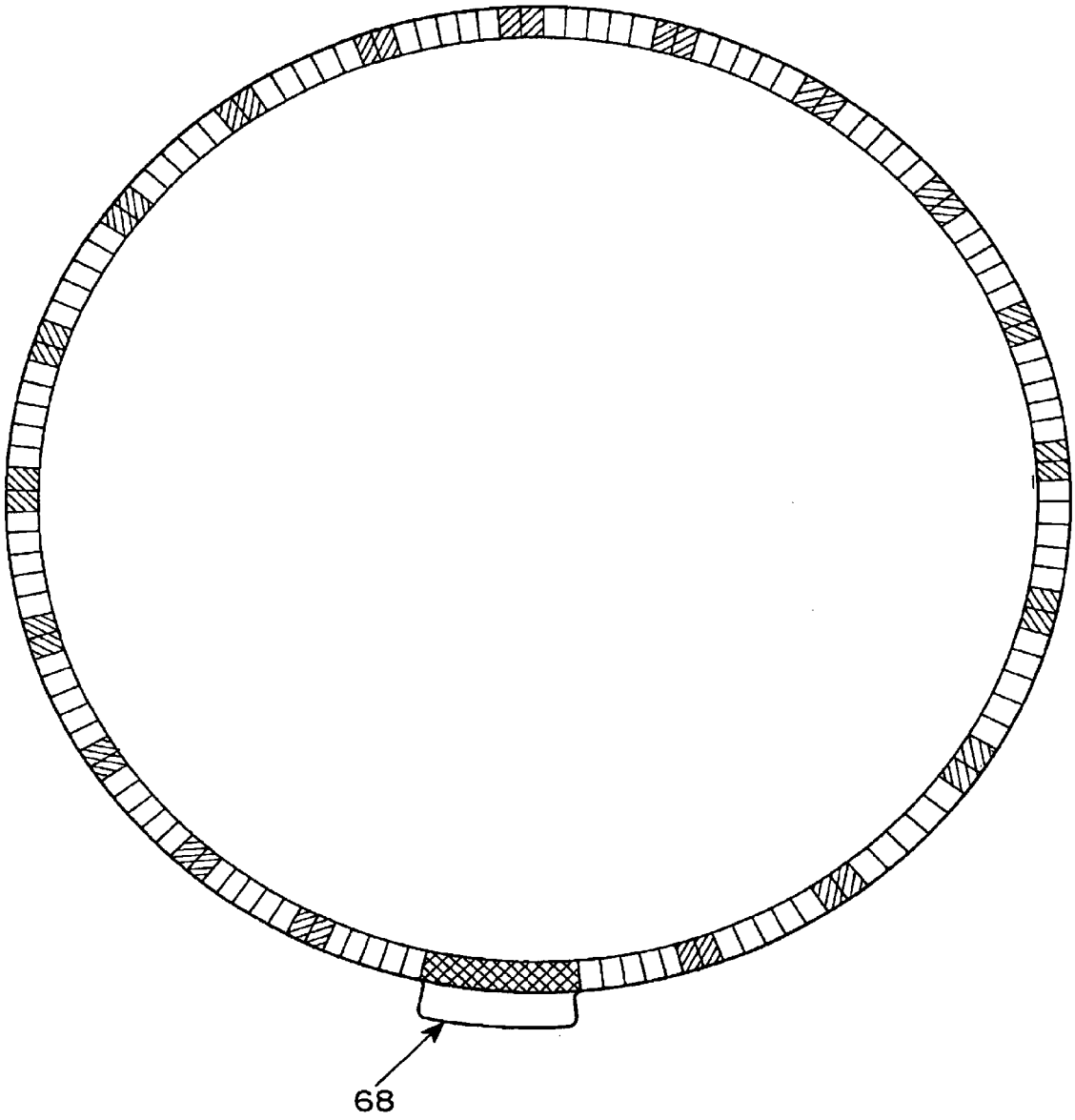
FIG. 17 shows a weekday disc.

The top disc is the Ovulation Day disc (FIG. 16). It is also divided by printed marks into 153 equal days, but preferably with no numerical labels, and rotates on the same central pin fulcrum concentric with the base and middle disc. This disc is preferably slightly smaller than the middle disc, so its outside edge lies immediately inside the numerals of the middle disc. An "ovulation day" label 2, or one of its related markers such as "LH-surge" or "hCG trigger injection" is printed on the top disc inside or pointing to one of the marked divisions. Other ovulation day related tests or treatments are printed on the top disc at the appropriate relative position before or after the ovulation day label (FIG. 16). After the cycle day middle disc is rotated to the proper position over the calendar day base, the top disc is then rotated until the ovulation day label, or its related marker, is aligned with the appropriate calendar day on the base. Any fertility test or treatment related to the ovulation day, and thus printed on the top disc, is also automatically aligned with the proper cycle day and calendar date on the underlying middle disc and base. These tests and treatments can also be timed or scheduled at a glance. To make viewing of the underlying cycle day middle disc feasible, the top disc is preferably printed on transparent plastic or celluloid. The weekday disc, which is optional, is also divided into 153 equal days and rotates independently of the other discs (FIG. 17). The divisions are labeled with the day of the week (or, due to small space available, an abbreviation) in chronologic order in the same direction as the other discs. A typical weekday disc has labels of M, T, W, Th, F, Sat, Sun or M, T, W, T, F, S, S. To improve rapid, easy readability the weekday or weekend labels can be shaded or color-coded so the repetition of the weeks and weekends are quickly detected.

The weekday labels cannot extend all the way around the circumference of the disc because 7 is not a factor of 153, i.e. they cannot be evenly divided into each other. Continuous labeling of weekdays around the disc cannot be completed because once the starting point is reached again the labels will not match (Friday will come just before Sunday), so a gap of at least one day is needed on the disc labels. In the preferred embodiment, a gap of at least 7 to 15 days is used because it is easily visible, preventing the gap from accidentally being placed in the middle of a calculated menstrual cycle. An extended tab 68 sticking out of the weekday disc at the gap position can be added to facilitate manual rotation of the disc (FIG. 17).

Although some fertility tests or treatments must be done on an exact cycle day or ovulation dependent day, most tests and treatments have a 2 to 5 day variable range in which they can be scheduled without significantly affecting the results. For instance, the HSG x-ray can be done any time between cycle day 6 and cycle day 10. When the weekday disc is approximately aligned with the calendar date disc, weekend dates for a few months in the past and a few months in the future are automatically labeled. Test and treatment days labeled on the aligned cycle day and ovulation day scales can then be compared relative to upcoming weekend, allowing the variable range tests and treatments to be scheduled away from weekends.

The weekday disc can be positioned anywhere relative to the other discs. In the preferred embodiment, the weekday disc is placed between the fixed calendar date base and the cycle date disc so that the numerals are separated by the letters on the weekday disc, improving readability and reducing the chance of confusing cycle days for calendar dates.

Figure 18A:
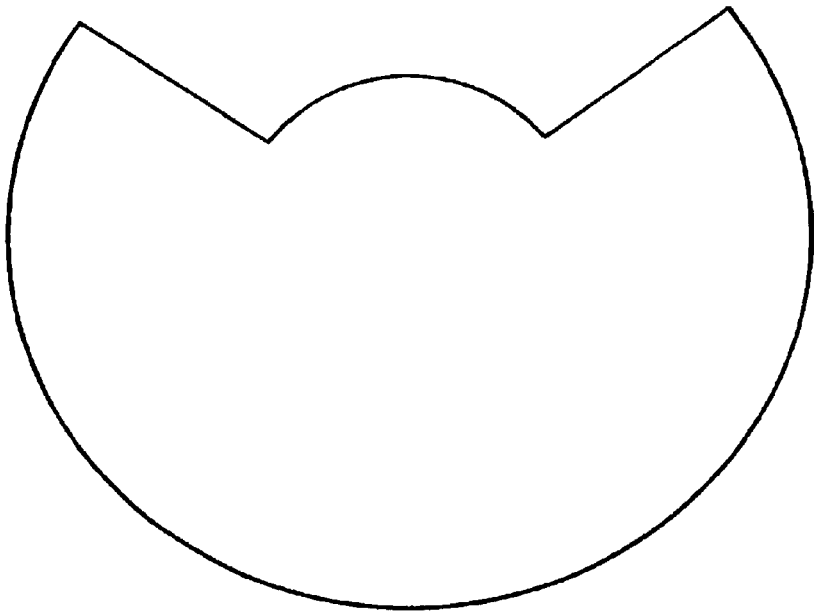
FIGS. 18A and 18B show a one-piece and two-piece mask, respectively.
Figure 18B:
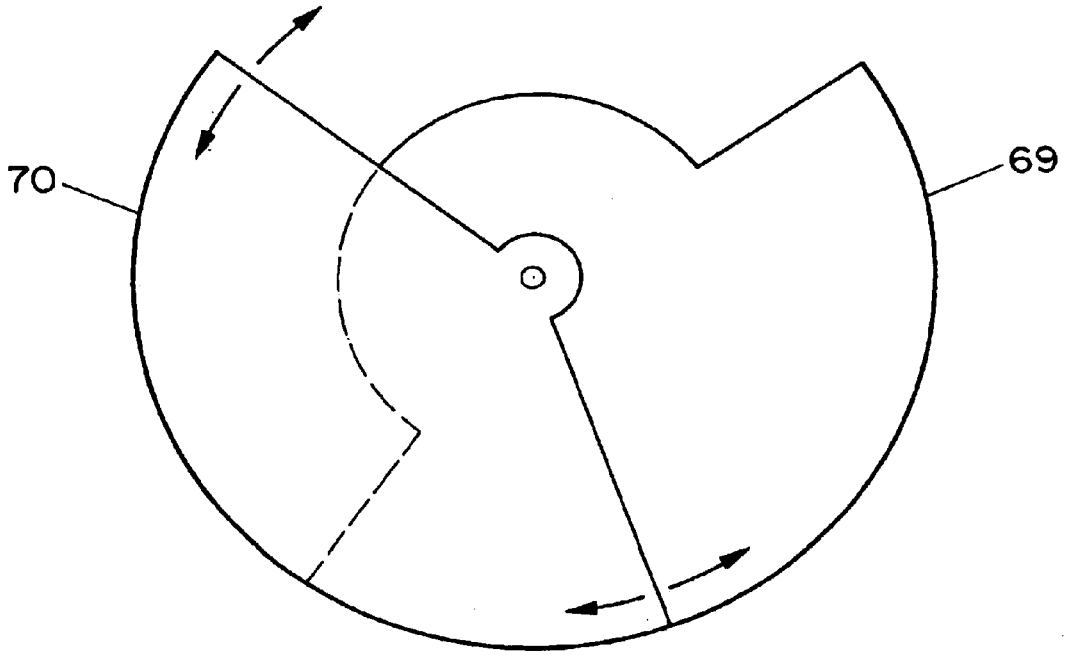
Figure 19B:
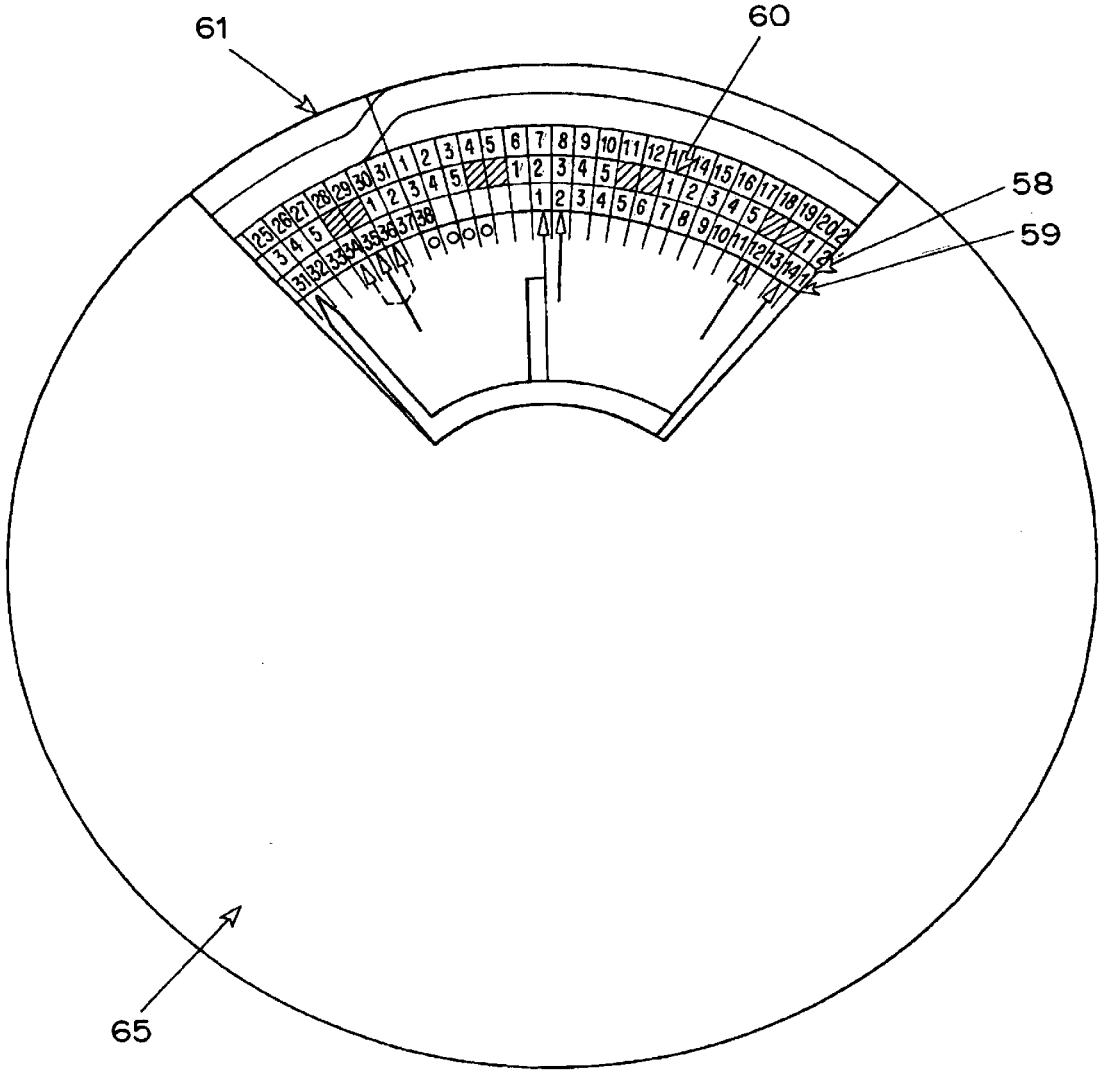

An option mask is a circular disc placed on top of the other discs to cover up unneeded or irrelevant information. A section of the mask is cut out to reveal only the active menstrual cycle information which usually occupies only about ¼ to ⅓ of the circumference of the entire calculator (FIG. 18A). Relevant information in the active cycle typically occupies 28 to 48 days, which is the range of menstrual cycle lengths, with the rest of the 153 day calculator information irrelevant. The irrelevant portions of the calculation may be distracting or even accidentally confused with the active portion. An opaque mask covering the irrelevant sections reduces such confusion. The mask may be a physically separate item laid on top of the calculator when needed, or it may be a rotating wheel attached to the center pin fulcrum like the other discs. A two-part rotating wheel comprised of independently moving half-masks 69,70, that can be spread apart or closer together to change the radial size of the unmasked "window" part allows for variations in the active cycle length (FIG. 18B). FIGS. 19A and 19B show base, weekday, middle, and top discs with and without a mask, respectively, assembled into a calculator.

The materials used to construct the calculator base and discs are limited only by the flat surface requirement for printing and the requirement that the discs have sufficient rigidity to minimize flex errors in disc alignments. The base and discs may be flat, rounded, cone shaped, or other shapes which meet these requirements. Suitable materials for constructing the calculator base and discs include metal, wood, paper, plastic, or a composite combination of these categories. If a transparent top disc is used, it can be made of plastic, celluloid, glass, plexiglass, or any other suitable transparent material. The base may be any shape, with the calendar information printed in a circle. The remaining discs must be circular.

Elements

Each individual test, treatment or physiologic event printed on the cycle day disc or ovulation day disc is an element. For instance, the luteogenesis sub-phase is a single element, the Mid Luteal Progesterone blood test is another element, and clomiphene pills taken on cycle days 5, 6, 7, 8, 9 are another element. Each of the menstrual cycle physiologic events are elements, and each of the fertility tests and treatments are also individual elements. The physiologic, test, and treatment elements are not limited to those listed or described herein. Any other physiologic event, fertility/infertility test, or treatment can be added as an element by printing it on the cycle day and/or ovulation day discs.

Figure 20A:
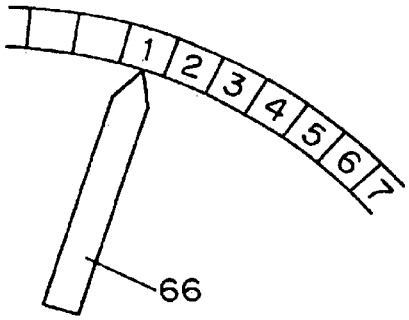
FIGS. 20A–20D illustrate how fixed and variable elements are represented on the calendar.
Figure 20B:
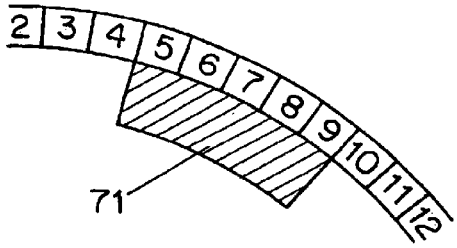
Figure 20C:
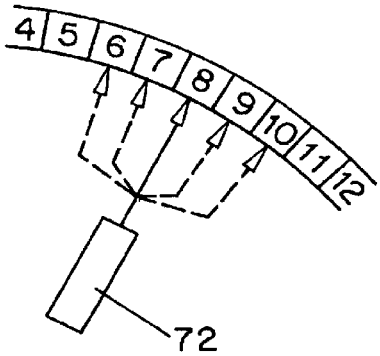
Figure 20D:
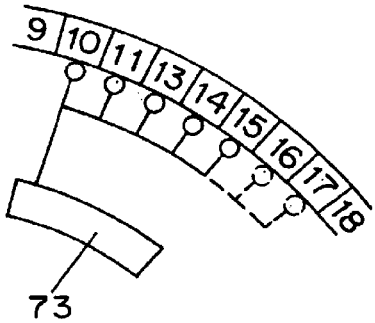

Elements can be either fixed (FIGS. 20A and 20B) or variable (FIGS. 20C and 20D). Fixed elements occupy an exact day or group of days on the discs, as shown by the single arrow in FIG. 20A, and the block in FIG. 20B. The first day of the Last Menstrual Period (LMP) 66 is a specific day on the disc, and is therefore a fixed element. Clomiphene pills 71 taken on cycle days 5, 6, 7, 8, and 9 are also a fixed element. A variable element is a test or therapy that can be done at any time within a specified range or group of days. For instance, the hysterosalpingogram x-ray (HSG) 72 can be done on any day between cycle days 6 and 10 inclusive to obtain basically the same test result. The HSG is therefore a variable element, and can be marked on the cycle day disc as symbols on cycle days 6, 7, 8, 9, and 10, with the HSG test to be scheduled on any one of the marked days, as shown in FIG. 20C. Some variable elements are "open-ended" because they do not contain an exact number of specified days in their range. The urine LH test kit test 73 will start on cycle day 10 or 11, then continue with one test per day until a positive result occurs. The positive result day is unpredictable; it may occur on the first day of testing (cycle day 10 or 11), or on the third day of testing, or the fourth, or sixth, etc. Once it does turn positive, the subsequent urine LH tests are discontinued. The total number of days of urine LH testing is variable, and customized to each individual cycle, and can range from one day to as many as nine days or more (FIG. 20D).

Fixed and variable elements can be distinguished from one another on the cycle day and ovulation day discs by using different types of notation symbols. In one embodiment, solid lines and filled arrows represent fixed elements, and dashed on half-gray lines with outlined arrows represent variable elements. Open-ended elements can be displayed as entire days or groups of day filled in with color or gray scale shadowing for easy identification or to allow easy readability of tests and treatments that overlap cycle days. An example would be an arrow to cycle day 3 for an FSH blood test lying on top of a gray scale shaded day 3 for the first day to take a clomiphene pill. Both tests are clearly marked and distinct even though they overlap on cycle day 3. A partial list of elements is as follows.

Physiuology Phases

- Menstrual
  - Last Menstrual Period
  - Prior Menstrual Period
  - Next Menstrual Period
  - Menstrual Period
  - Expected Menstrual Period
- Follicular Subphase
  - Follicular Phase
  - Recruitment Phase
  - Follicle Selection
  - Follicle Growth Phase
  - Pre Ovulatory Progesterone Rise
  - LH Surge
  - LH-FSH Surge
  - Gonadotropin Surge
  - FSH Surge
- Luteal Subphase
  - Ovulation
  - Luteal Phase
  - Luteinization
  - Luteogenesis
  - Neovascularization
  - Luteolysis
  - Luteo Reserve
  - Progesterone Phase
- Fertile Subphase
  - Premenstrual Period
  - Fertile Period
  - Non Fertile Period
  - Possible Fertile Period
  - Oocyte (Egg) Fertilizable
  - Oocyte Lifespan
  - Sperm Lifespan
- Follicle Development
  - Primordial Follicle
  - Primary Follicle
  - Secondary Follicle
  - Antral Follicle
  - Tertiary Follicle
  - Immature Follicle
  - Mature Follicle
  - Atretric Follicle
  - Dominant Follicle
- Embryo Development
  - Fertilization
  - First Polar Body Expulsion
  - Second Polar Body Expulsion
  - First Cell Division
  - Second, Third, Fourth . . . Cell Division
  - Two, Four, Eight . . . Cell Stage
  - Pre Embryo Phase
  - Totipotency
  - Embryo Phase
  - Morula
  - Blastocyst
  - Compaction
  - Hatching
  - Embryo Attachment
  - Implantation

- Tubal Transport
- Uterine Transport
- Fetal Phase
- Fetal Growth
- Gestational Sac
- Yolk Sac
- Early Pregnancy
  - Fetal Heart Motion
  - Fetal Pole
  - Crown-Rump Length
  - Neurotube Closure
  - Neurotube Defect
  - Cardiac Rotation
  - Limb Budding
  - Fetal Motion
  - Organogenesis
  - Gut Rotation
  - Facial Cleft Closure
  - Fetal Development
  - Fundal Height
  - Chorionic Villus Sampling
  - Amniocentesis
  - Early Amniocentesis
  - Quickening
  - Viability
  - Selective Reduction
- Fertility Tests
  - Baseline
    - LH Level
    - FSH Level
    - Gonadotropin Levels
    - LH & FSH Levels
    - Estradiol Level
    - Estrogen Level
    - Prolactin Level
  - Endocrine Blood Tests
    - Thyroid Tests
      - Thyroid Stimulating Hormone
      - Thyroxine
      - T3 Uptake
      - Free Thyroxine
      - Calculated T7 Level
    - Cortisol Level
    - Dihydroepiandosterone
    - Dihydroepiandosterone Sulfate
    - 17-Hydroxyprogesterone
  - Androgen Blood Tests
    - Testerone
    - Total Testosterone
    - Free Testosterone
    - Percent Free Testosterone
    - Progesterone
    - Mid-Luteal Progesterone
    - Androstenediol
    - Andosterone
    - 3-alpha Androstenediol Gluconide
  - OV
    - Urine LH Test
  - Male
    - Semen Analysis
    - Sperm Count
    - Strict Kruger Sperm Morphology
  - Screening
    - Hepatitis Tests
    - Human Immunodeficiency Virus Tests
    - Gonorrhea
    - Chlamydia
    - Preoperative Lab Tests
  - Radiologic
    - Hysterosalpingogram
    - Operative Hysterosalpingogram
    - Ultrasonic Hysterosalpingogram
    - Ruben's Test
    - Basal Body Temperature Chart
    - Ultrasound
    - Pelvic Ultrasound
    - Follicular Ultrasound
    - Baseline Ultrasound
    - Follow-Up Ultrasound
    - Ovulation Ultrasound
    - Ovarian Ultrasound
    - Gestational Ultrasound
  - Exams
    - Clomid Check
    - Clomiphene Check
    - Bimanual Pelvic Exam
    - Pelvic Exam
    - Physical Exam
  - Invasive
    - Laparoscopy
    - Hysteroscopy
    - Ovulation Test Kit
    - Hydrotubation
    - Chromotubation
    - Endometrial Biopsy
    - Post Coital Test
    - Intrauterine Device Placement
    - Intrauterine Device Removal
    - Fern Test
  - Metabolic
    - ACTH Stimulation Test
    - Glucose Tolerance Test
    - Fasting Insulin Level
  - Early Pregnancy
    - TriScreen
    - Alpha-fetoprotein
    - human Chorionic Gonadotropin Level
    - Beta-human Chorionic Gonadotropin Level
      - Qualitative
      - Quantitative
    - Intact human Chorionic Gonadotropin Level
    - Urine human Chorionic Gonadotropin Level
    - Pregnancy Test
      - Urine
      - Serum
      - Blood
    - Home Pregnancy Test
    - Repeat Pregnancy Test
- Fertility Treatments
  - Standard Fertility Drugs
    - Clomiphene
    - Clomiphene Citrate
    - Clomid
    - Serophene
    - Tamoxifen
    - Dexamethasone
    - Prednisone
    - Gonadotropin
    - human Follicle Stimulating Hormone
    - human Luteinizing Hormone
    - human Menopausal Hormone
    - Pergonal

- Repronex
- Fertinex
- Follistim
- Gonal-F
- recombinant human Follicle Stimulating Hormone
- recombinant human Luteinizing Hormone
- human Chorionic Gonadotropin injection
- Gonadotropin Releasing Hormone Pump Fertility Drug Enhancers
- Ethyril Estradiol
- Estrogen
  - Oral (pills)
  - Transdermal
  - Patch
  - Cream
  - Sublingual
- Estrace
- Premarin
- Climara
- Estraderm
- Oral Contraceptive
- Birth Control Pill
- Contraception
- Contraceptive
- Norethindrone
  - Aygestin
- Medroxyprogesterone
- Provera
- Depo-Provera
- Progesterone
  - injection
  - suppository
  - lozenges
  - oral
  - gel
- Prometrium
- Crinone
- Gonadotropin Releasing Hormone
- Gonadotropin Releasing Hormone analog
- Gonadotropin Releasing Hormone agonist
- Gonadotropin Releasing Hormone antagonist
- Lupron
- Depo-Lupron
- Syneril
- Bromocriptine
- Pariodel
- Pergolide
- Luteinizing Hormone Releasing Hormone Minor Procedures
- Ovarian Cyst Aspiration
- Cervical Cone Biopsy
- Cervical Cryosurgery
- Cervical LEEP Procedure
- Cervical Cultures
- Dilation and Curettage
- Methotrexate
- CitroVorum Reserve Inseminations
- Insemination
- Artificial Insemination
- Artificial Insemination—Husband Sperm
- Artificial Insemination—Donor Sperm
- Donor Insemination
- IntraCervical Insemination
- IntraUterine Insemination
- IntraTubal Insemination
- Timing
  - Timed Intercourse
- Intercourse (Sexual)
  - Shotgun Intercourse
  - Frequent Intercourse
  - Abstinence
  - No Intercourse
- Assisted Reproductive Technology
  - Gamete IntraFallopian Transfer
  - Zygote IntraFallopian Transfer
  - Tubal Embryo Transfer
  - Ultrasound Egg Capture
  - Laparoscopic Egg Capture
  - Egg Capture
  - Embryo Transfer
  - Zygote Transfer
  - Blastocyst Transfer
  - Frozen Embryo Transfer
  - Embryo Freezing
  - Embryo Thawing
  - Donor Embryo Transfer
  - Drift Days
  - In Vitro Fertilization
  - Mock Transfer
  - Uterine Sound
  - Ultrasound Guided Transfer
  - Hysteroscopic Guided Transfer
  - IntraCytoplasmic Sperm Injection
  - Blastomere Biopsy
  - Assisted Hatching
  - Testicular Sperm Extraction—Injection Miscellaneous
- Veterinary
- Estrus
- Heat
- Mating
- Diapause
- Embryonic Diapause Domains Many fertility tests and treatments are inter-related, or they tend to cluster as groups within the same range of cycle days. Inter-related tests and treatments are frequently linked together by a specific number or range of cycle days, i.e. the day on which a test is done will determine exactly when a related test or treatment is to be scheduled. The range of days for any two or more inter-related or grouped elements is called a domain.

A domain may be a cluster of two or more elements on the cycle day disc, two or more elements on the ovulation day disc, or two or more elements on both the cycle day and ovulation day discs, as long as the elements are in the same basic classification group or otherwise related. Actually, there are no set rules governing how testing or treatment elements are related, and technically any two or more elements of any type can be grouped together into a domain. For practical display and calculation reasons, however, domains will usually consist of groups of elements that are similar to each other or are inter-related to each other in terms of class or function. The diagnostic fertility tests such as LH and FSH blood tests, HSG x-ray, urine LH test, Post Coital Test, mid-luteal progesterone test, and endometrial biopsy can be grouped into a "Diagnostic Domain." Similarly, the physiologic phases of the menstrual cycle, follicular phase, dominance sub-phase, luteolysis sub-phase, etc., are grouped into a "Physiologic Domain", and the medications and tests used in a clomiphene pill fertility treatment cycle can be grouped into a "Clomiphene Treatment Cycle Domain."

Domains are important part of a fertility calculator because they are the actual working parts of the calculator. By automatically aligning on their proper cycle days, they display the calendar day and weekday on which any fertility test and treatment should be done or scheduled. In addition, a large number of domains can be created to satisfy the requirements of numerous specialty applications. Educational domains can be visual teaching aids for physiology or medical students, diagnostic domains can be used by physicians and nurses to schedule fertility related tests, low level treatment domains would be useful to family practice or Ob-Gyn physicians to plan basic fertility drug cycles, and high level treatment domains would allow easy planning and scheduling of advanced therapy cycles, such as In Vitro Fertilization, by reproductive endocrinology sub-specialists.

The length of a domain is the number of consecutive cycle days it covers, which is determined by the number and the type of elements it contains. It can be as short as two days (i.e. on LMP and an FSH test element) or can exceed 90 days for a long Lupron In Vitro Fertilization protocol cycle or an early gestation testing group covering the first trimester of pregnancy. A practical limit on the maximum length of a domain is imposed by the overlapping month calendar base design. In theory, a domain that started anytime between March 1 and Aug 1 could be five months (153 days) in length, covering the entire circumference of that side of the calculator, using a 2-layer month label on the calendar base. Cycle domains that start after Dec. 1, or especially those that start in or just before February will be restricted in length because the end of the cycle day disc, Dec. 31 or Jan. 31 on one disc, March 31 on the other disc, will be reached, with no marked calendar days beyond that point. The severest restrictions will occur for domains starting near the end of February, with only 31 days of March marked beyond that point. This could represent a significant problem, since most useful domains are the length of a typical menstrual cycle, so many will exceed this 31 days restriction, an end-of-February problem. Fortunately, these restrictions are easily overcome by minor modifications of the calendar scale month labels. A domain starting Feb 26 that is 48 days long can be readily displayed on the March-to-January calendar scale instead of the February-leap February calendar plate simply by assigning the first day of the domain to "Dec 29." The first 3 days of the cycle will be mislabeled, but the remainder of the domain can be extended through March, April, etc., easily accommodating the 48 day domain length. An easier solution is to represent this domain on the February-leap February calendar scale and let the end of the domain extend into the "Leap February" month. This will also easily accommodate a 48 day domain length, with "Leap February" re-labeled "April", and can be used for even longer domains as long as they do not extend past re-labeled "April 29." Using this method, domains up to 60 days long can be used for the end-of-February problem during most years, and can even be facilitated by adding restricted month wedge labels for "early April" on the February-leap February calendar scale, and for "early or even total February" on the end of the March-to-January calendar scale, or an "end of February" wedge (special date label) at the beginning of the March-to-January calendar scale. The end-of-February problem is easily solved for non-leap years with a 28 day February by adding an "early April" wedge to the February-leap February calendar scale. However, this cannot be used for leap years. The end-of-February problem has the most restricted solution for leap years with a 29 day February because the absolute end of the calendar scale is achieved on March 31, with no available subsequent days to add on to the "early April" wedge since this would crash into the 3 filler days on the February-leap February scale. Fortunately, this problem occurs only during a relatively short time period at the end of the February, only during leap years, and only for long domain lengths. In general domain lengths up to 60 days can be easily accommodated by the calculator design, and domain lengths exceeding 90 days are feasible for most of the year.

A variation of this fertility calculator invention consists of a calendar base of 365 days length to hold the entire January-to-December calendar around the circumference. A separate, and preferably opposite side calendar scale will accommodate a 366 leap year calendar around its entire circumference. No month-to-month boundary problems will occur in these calendars, and domain lengths can reach 365 or 366 days if necessary. However, the arc size of each day on this calculator is less than 1° of circumference, so reading the marked days will be difficult unless the total size of the calculator is quite large. Otherwise, the calculator has the same basic design: A 365-day calendar base with same scale weekday disc, cycle day disc, and ovulation day discs.

Domain Permutations

A large number of physiologic, testing, and treatment elements are available to be assembled into various domains. The number of elements assembled into a domain is variable, from as few as two to as many as 20 or more. As stated above, there are no rules governing how elements can be grouped into domains, so an astronomically large number of domains exist consisting of all possible permutations of elements. In general, most domain structures are limited by the nature of inter-related or grouped elements. A physiology domain is limited by the fact that the luteal phase always follows the follicular phase, a treatment domain is limited by the fact that ovulation always occurs after taking clomiphene pills, etc. Some limitations are purely practical. A domain consisting only of an HSG x-ray test and a luteogenesis sub-phase has minimal practical value since these elements are essentially unrelated.

Figure 21A:
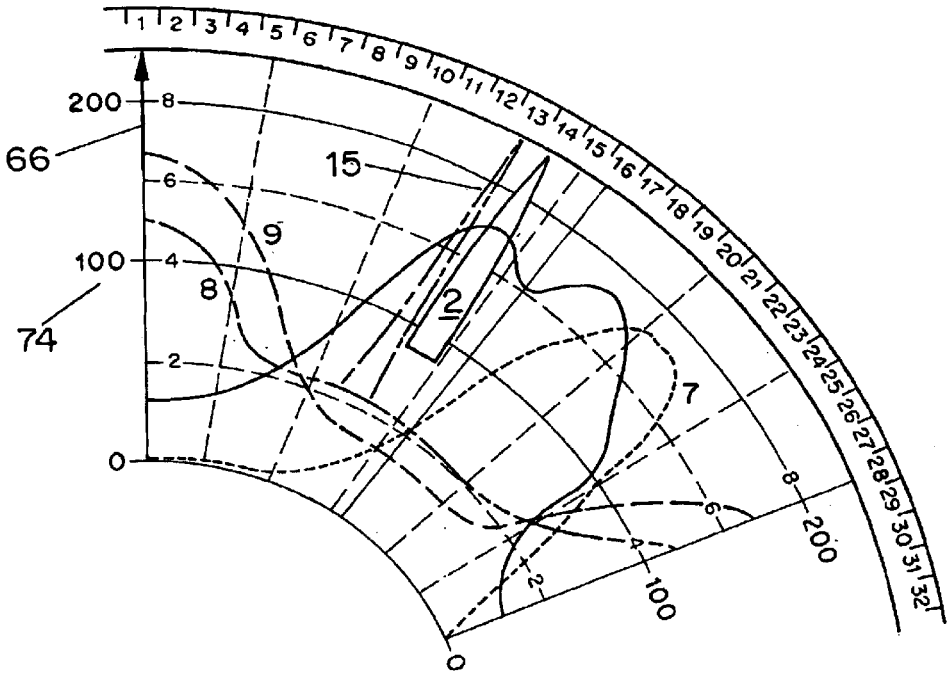
FIGS. 21A–21V illustrate domains and associated events which may be printed on the discs of a calendar.
Figure 21B:
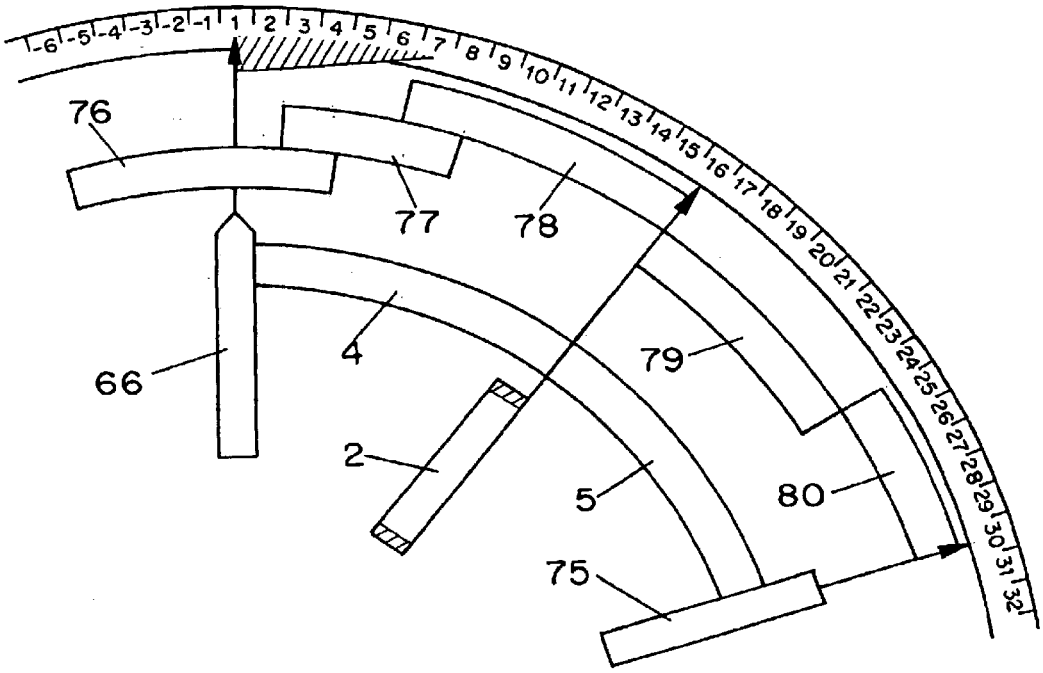
Figure 21C:
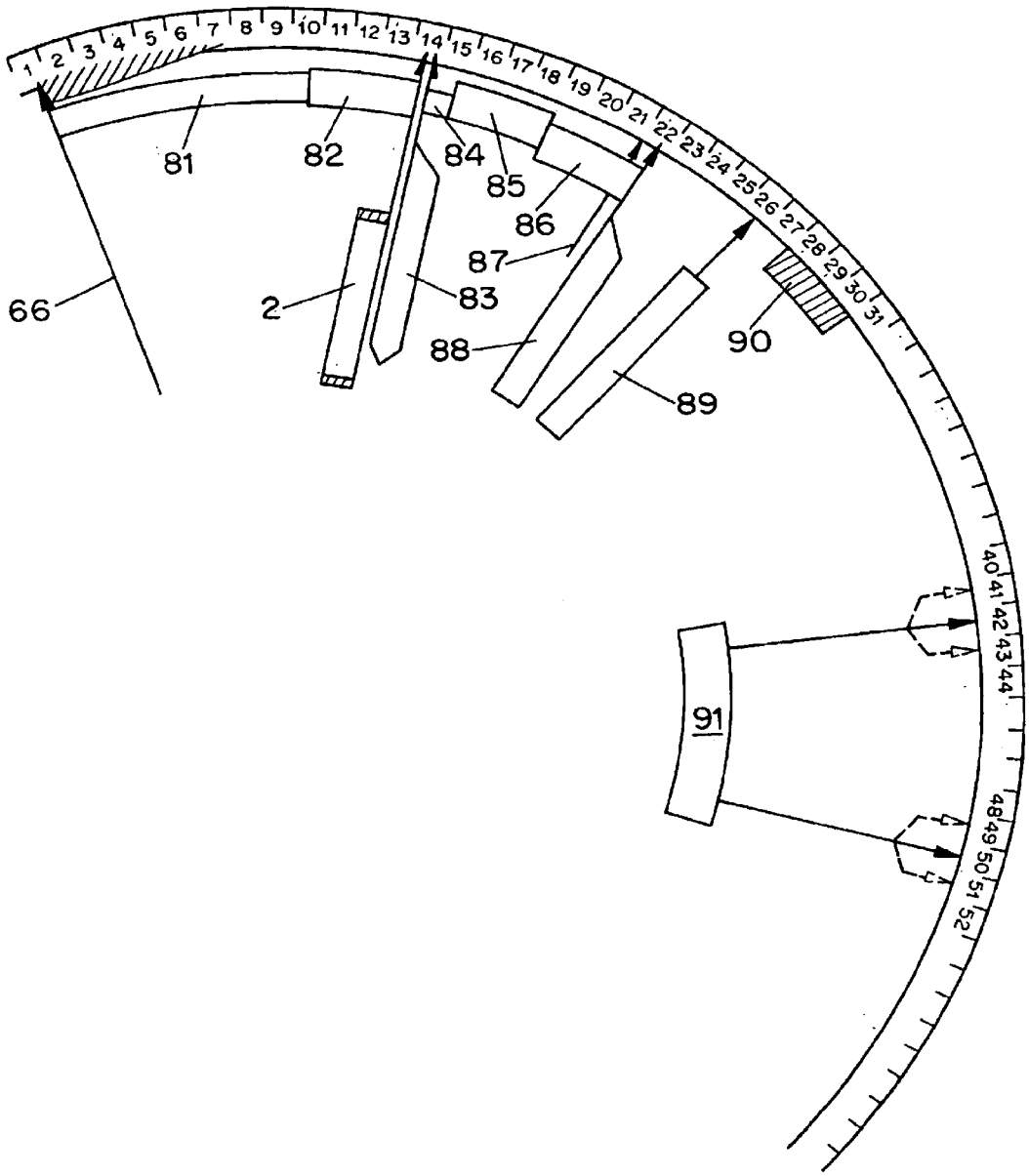
Figure 21D:
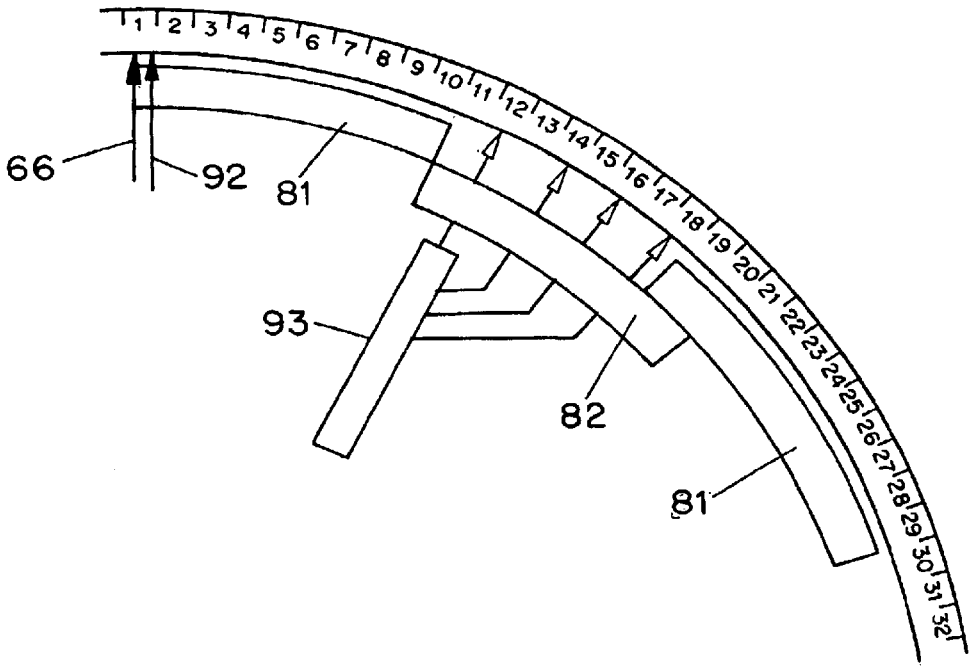
Figure 21E:
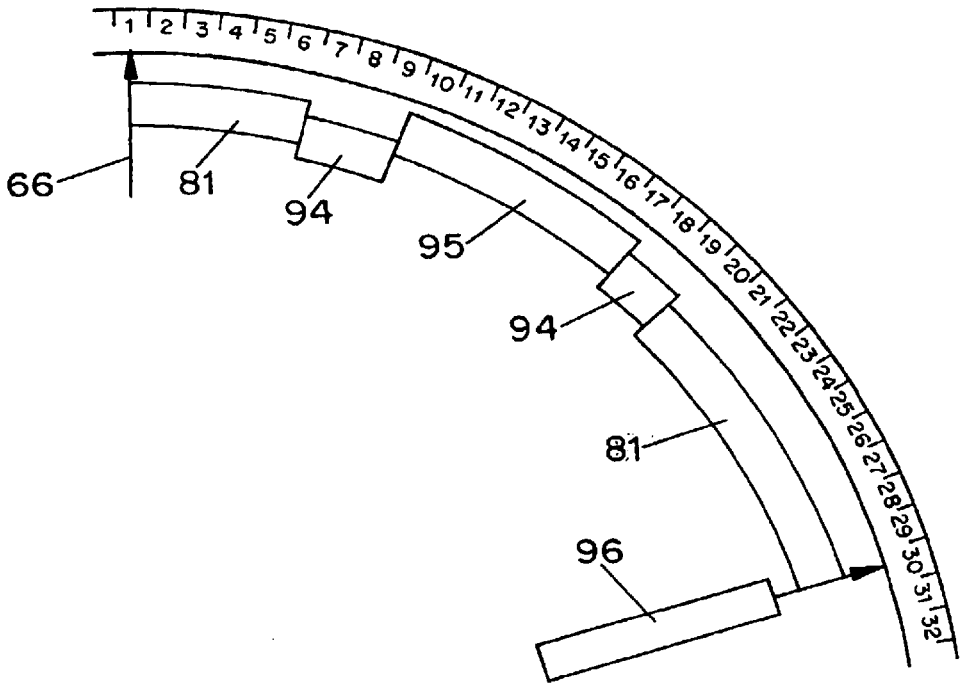
Figure 21F:
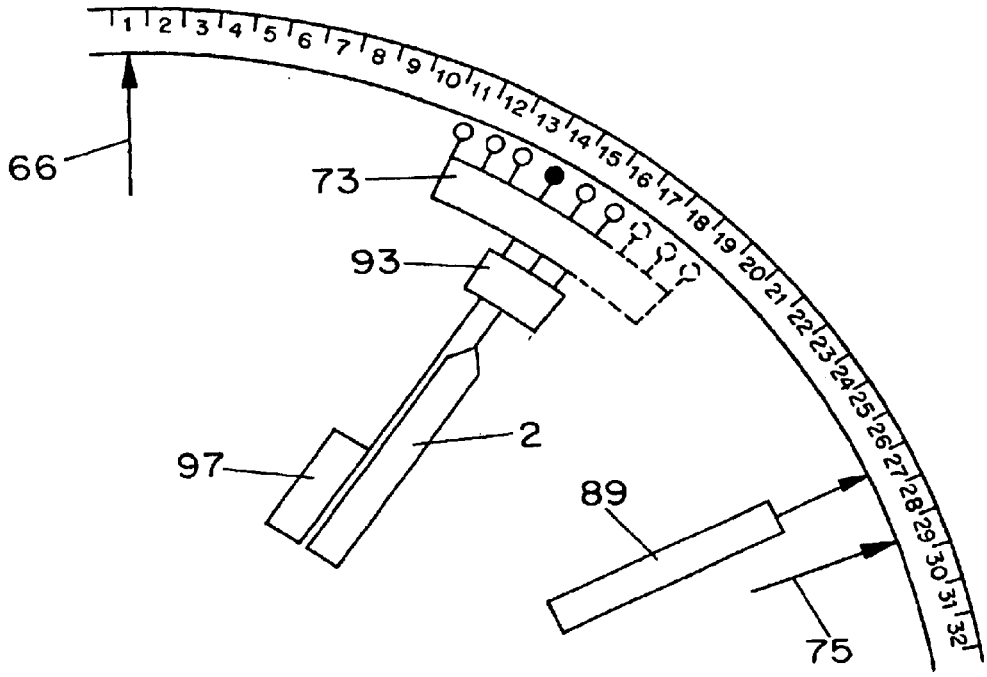
Figure 21G:
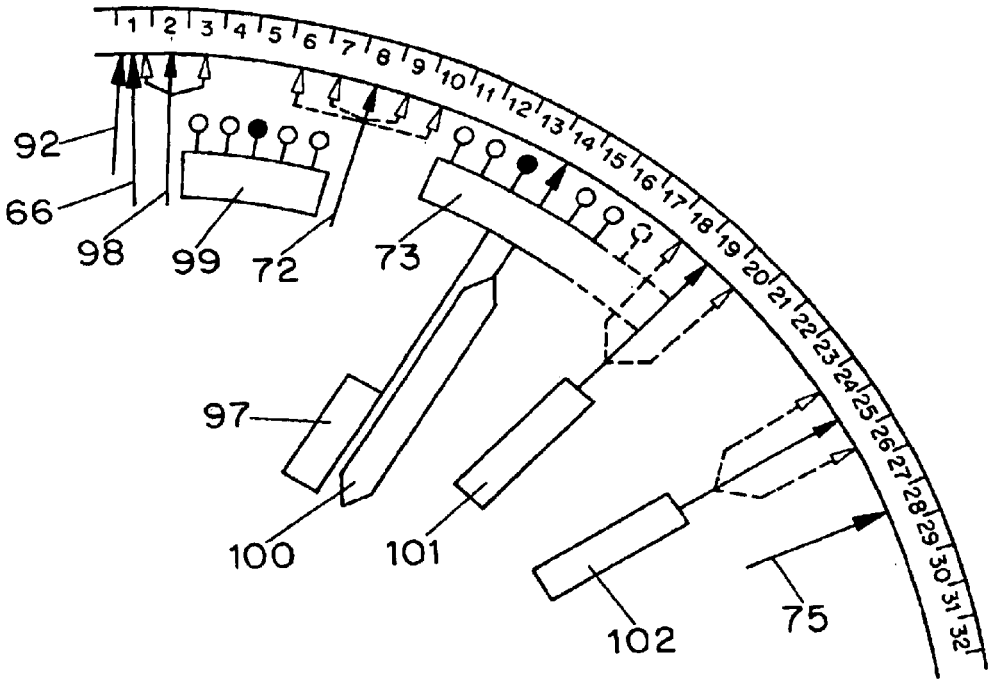
Figure 21H:
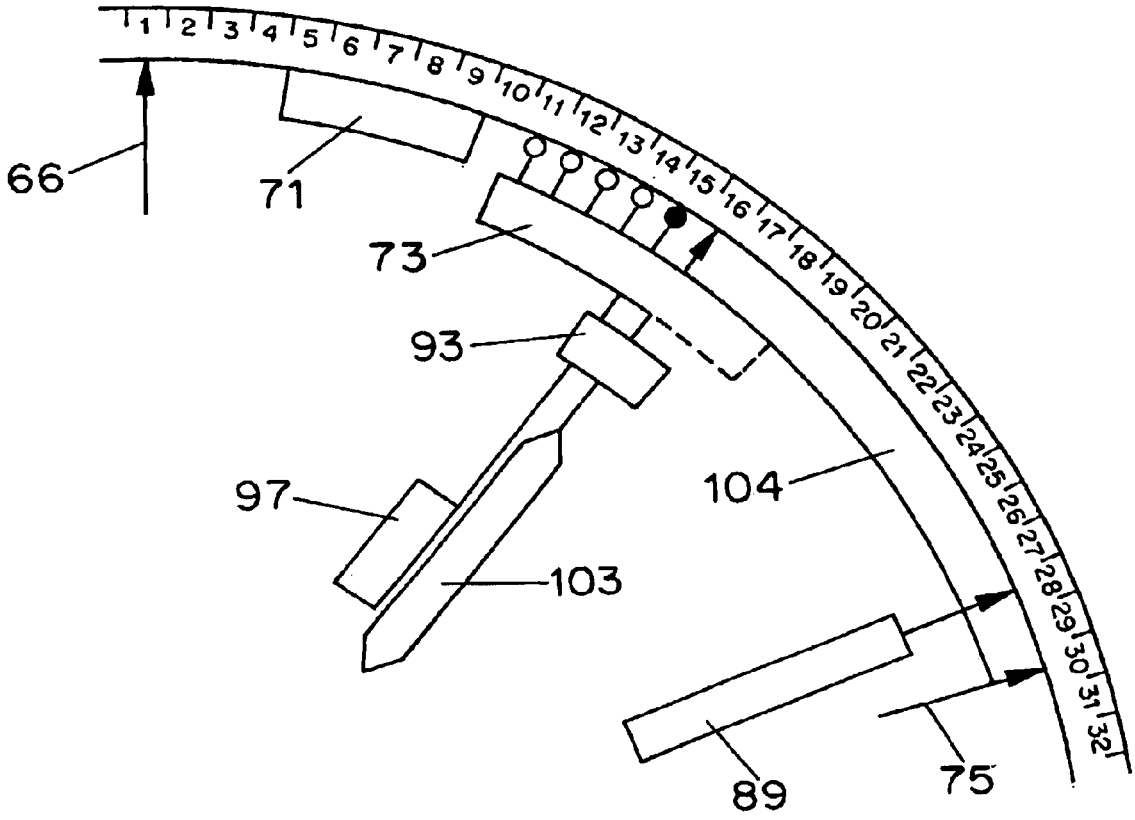
Figure 21I:
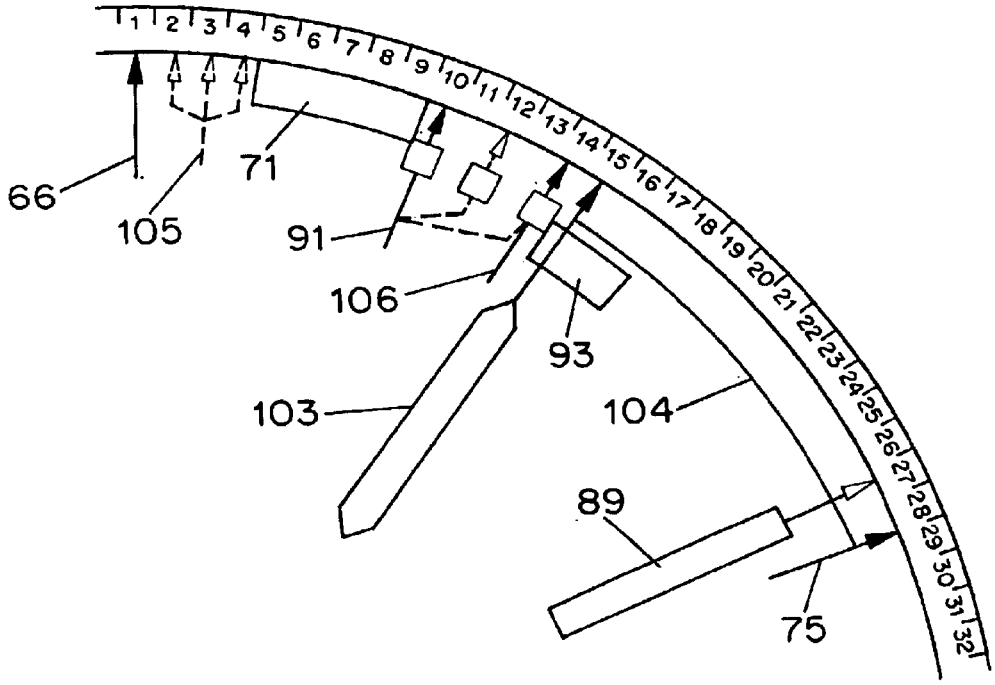
Figure 21J:
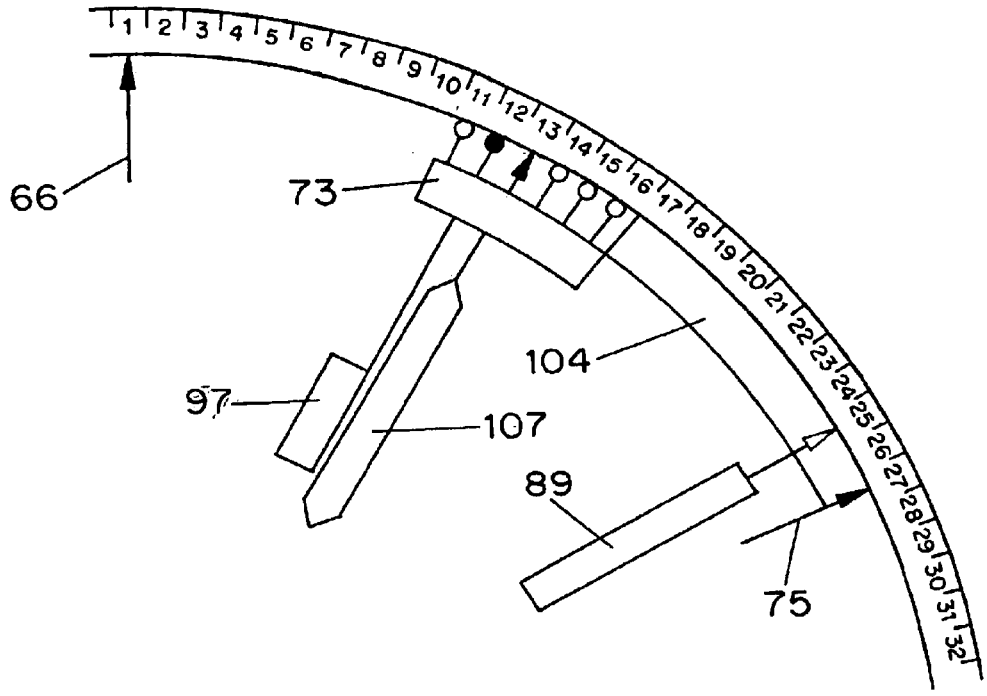
Figure 21K:
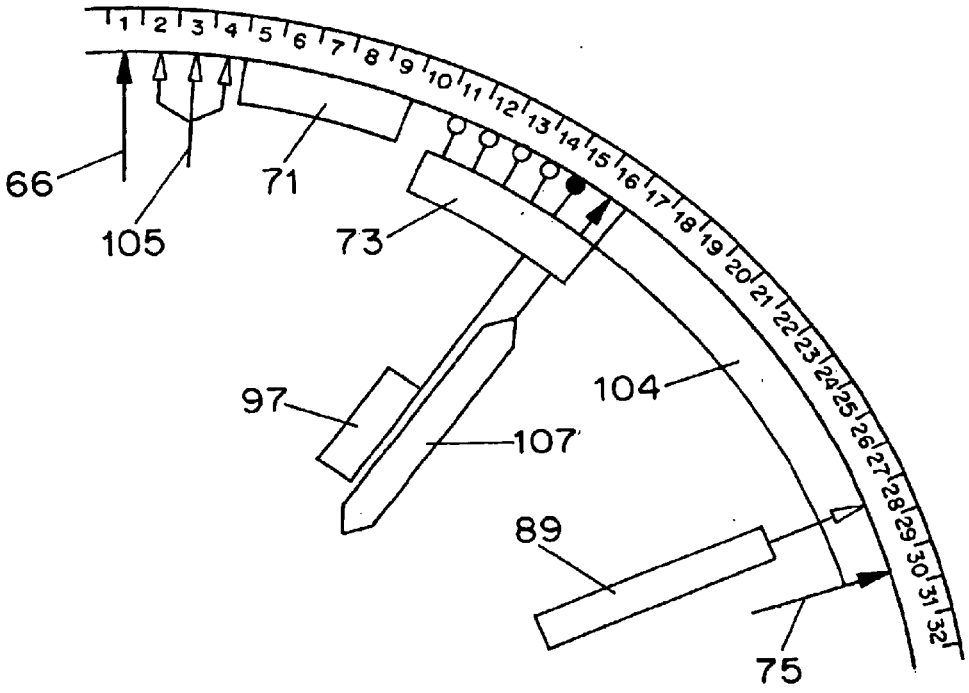
Figure 21L:
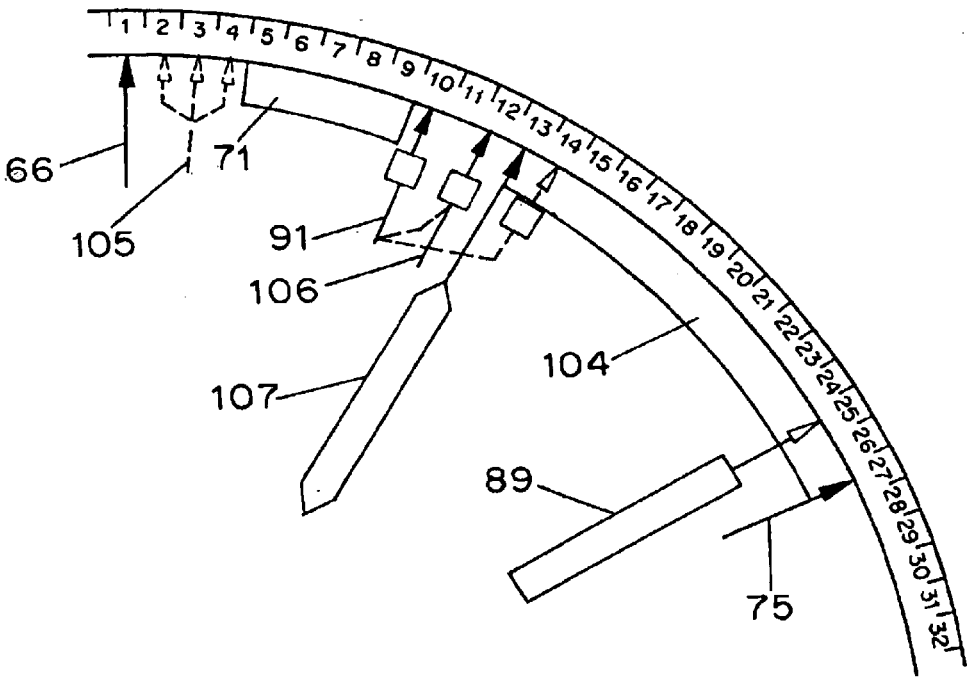
Figure 21M:
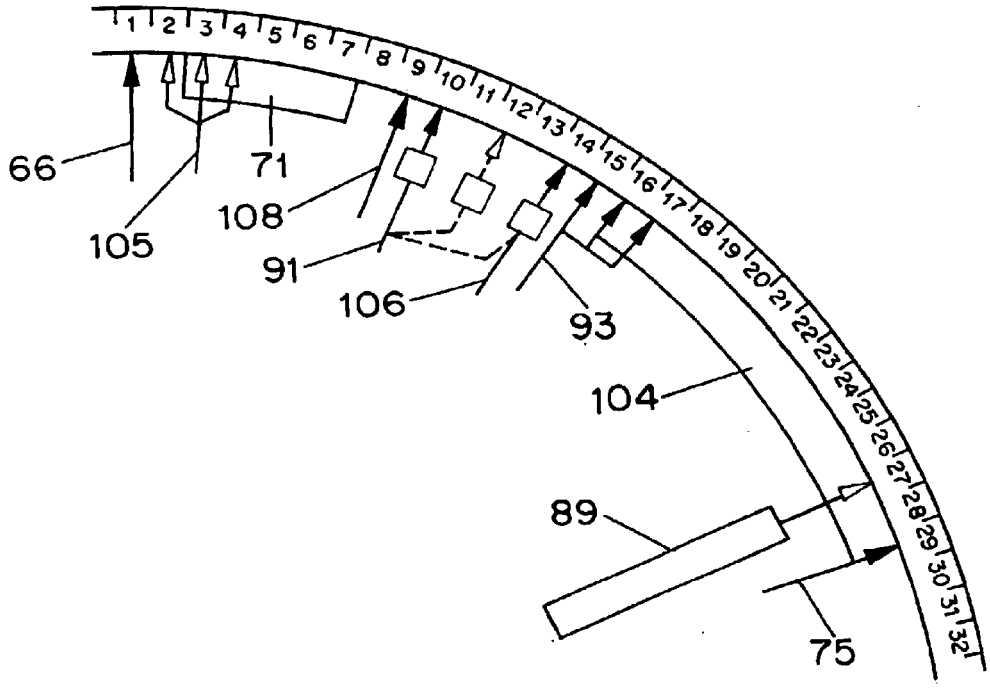
Figure 21N:
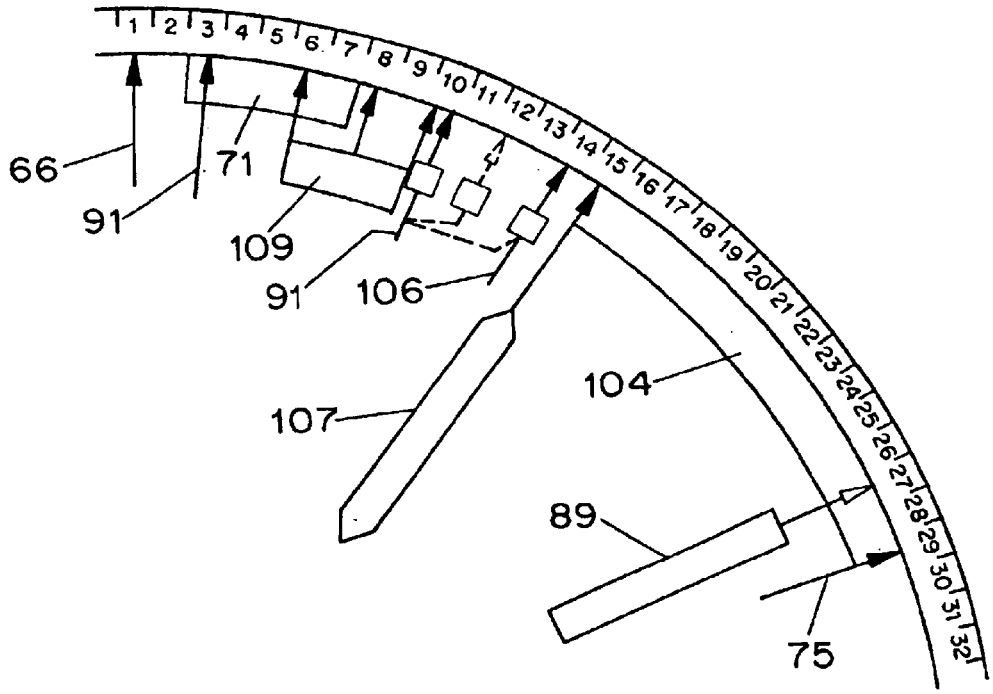
Figure 210:
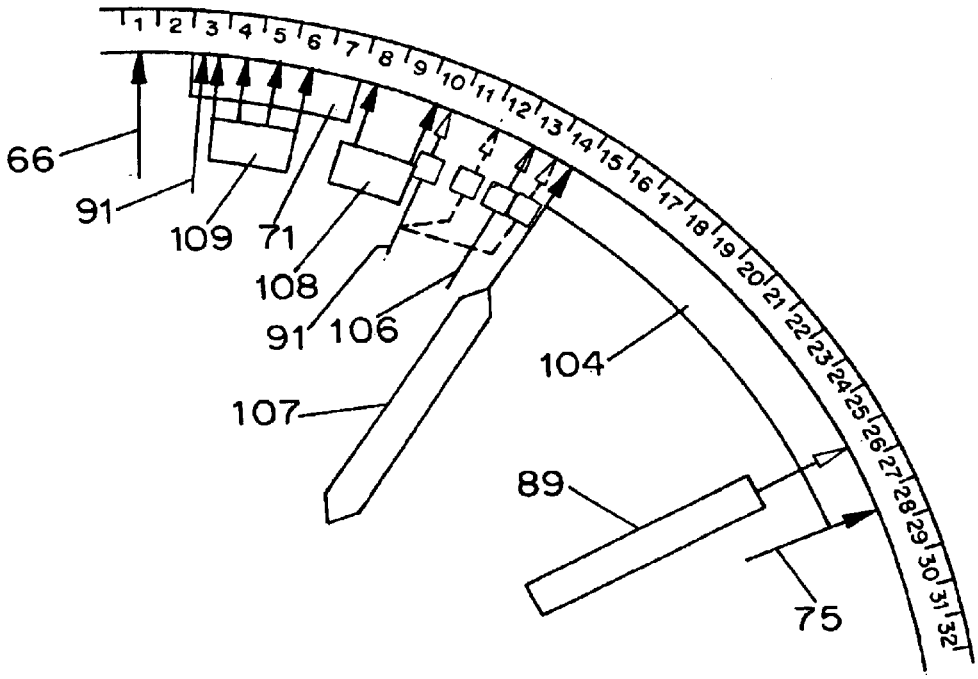
Figure 21P:
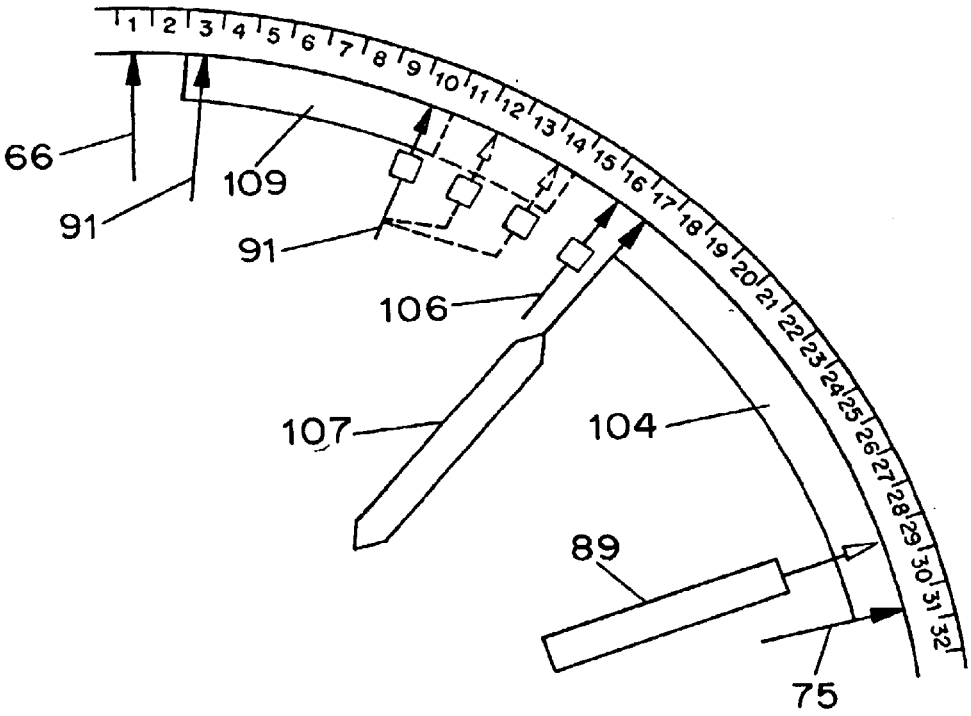
Figure 21Q:
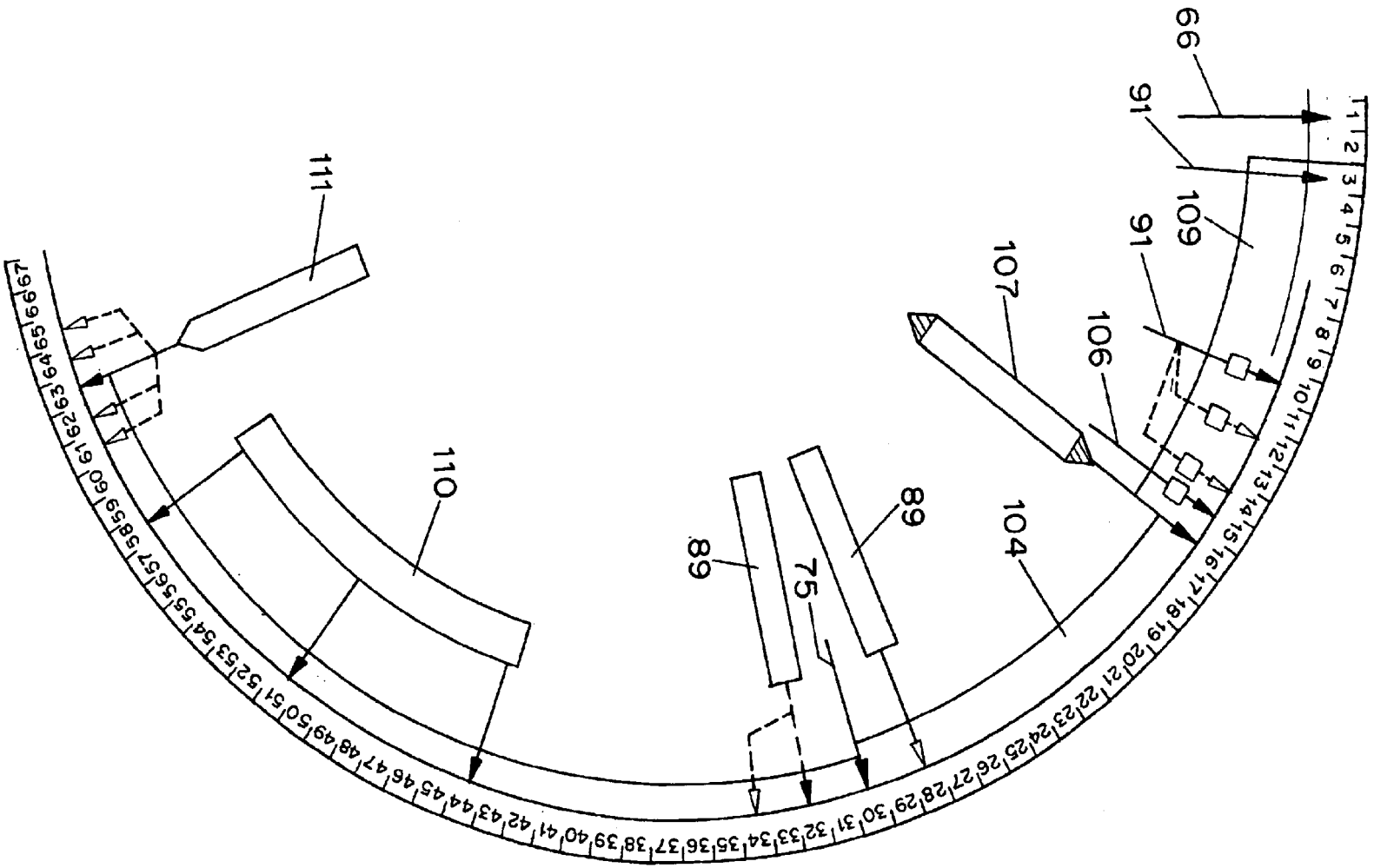
Figure 21R:
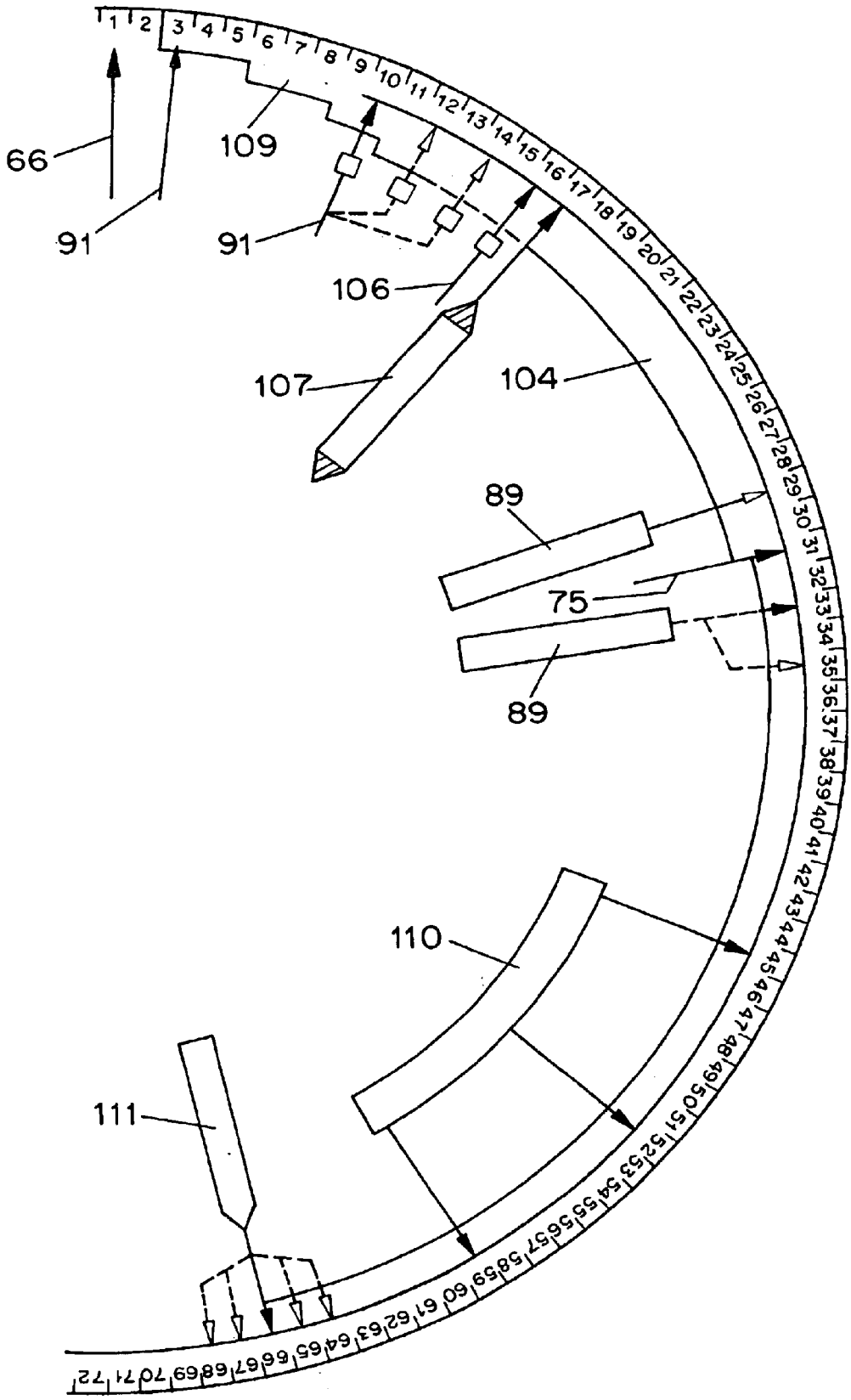
Figure 21S:
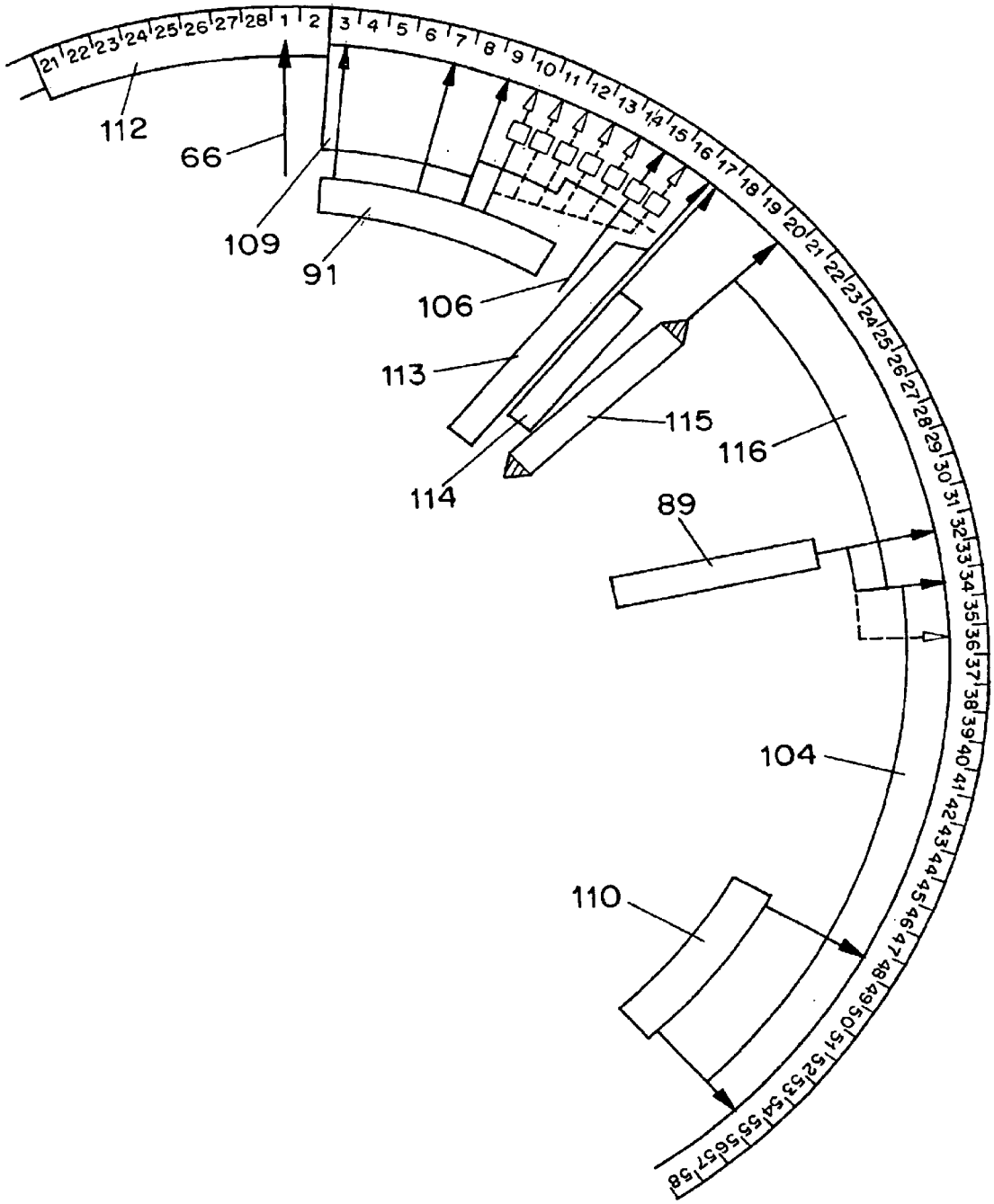
Figure 21T:
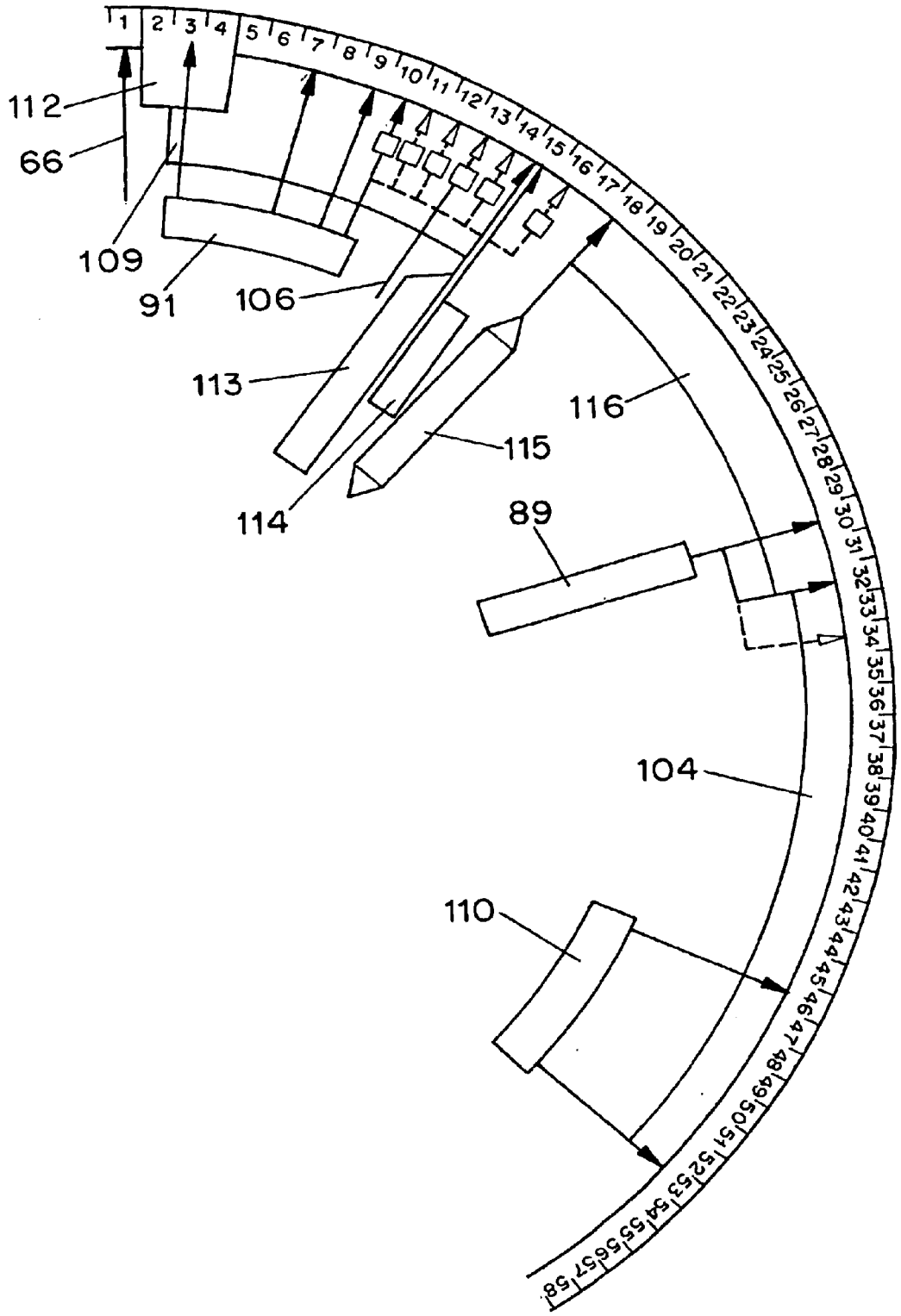
Figure 21U:
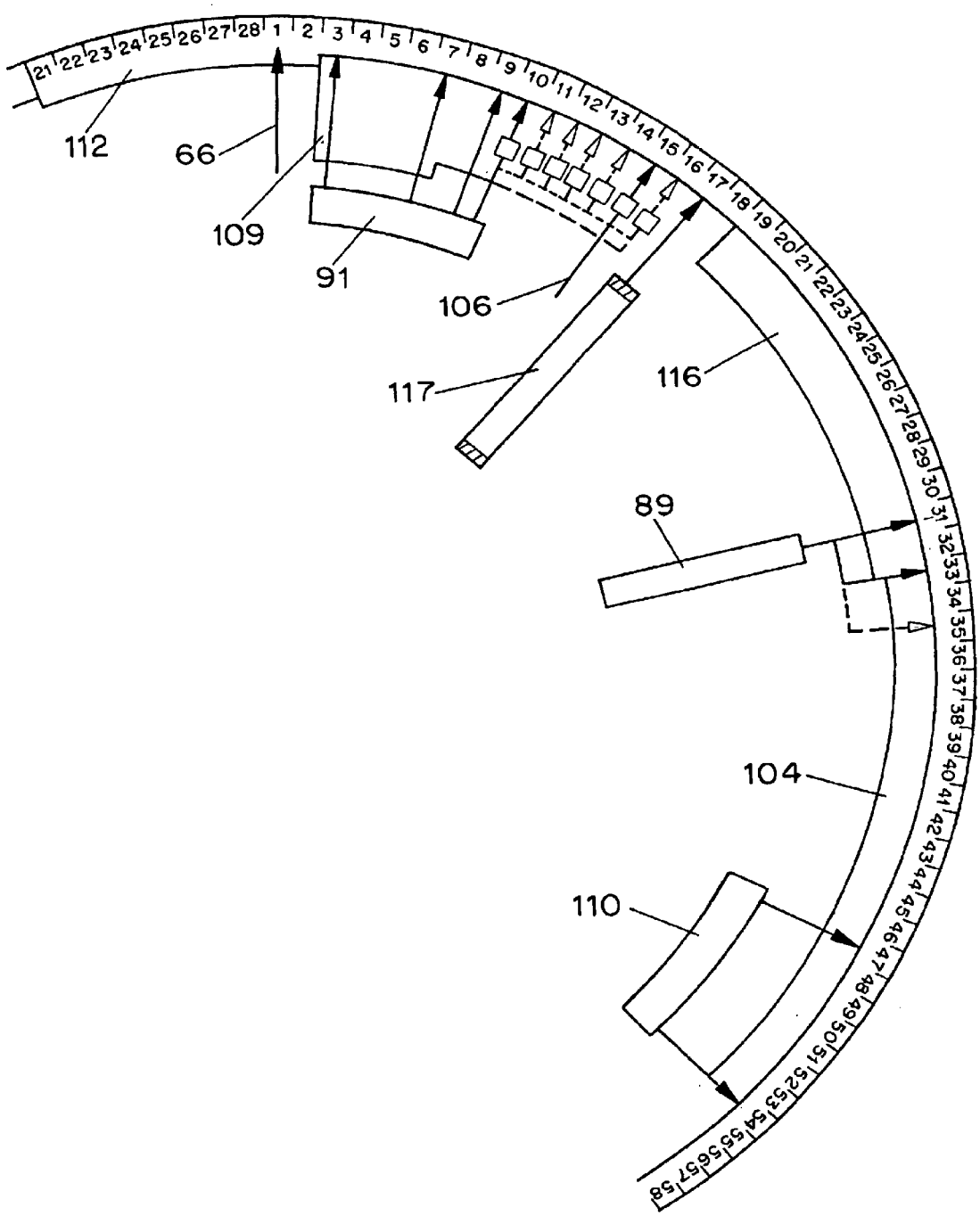
Figure 21V:
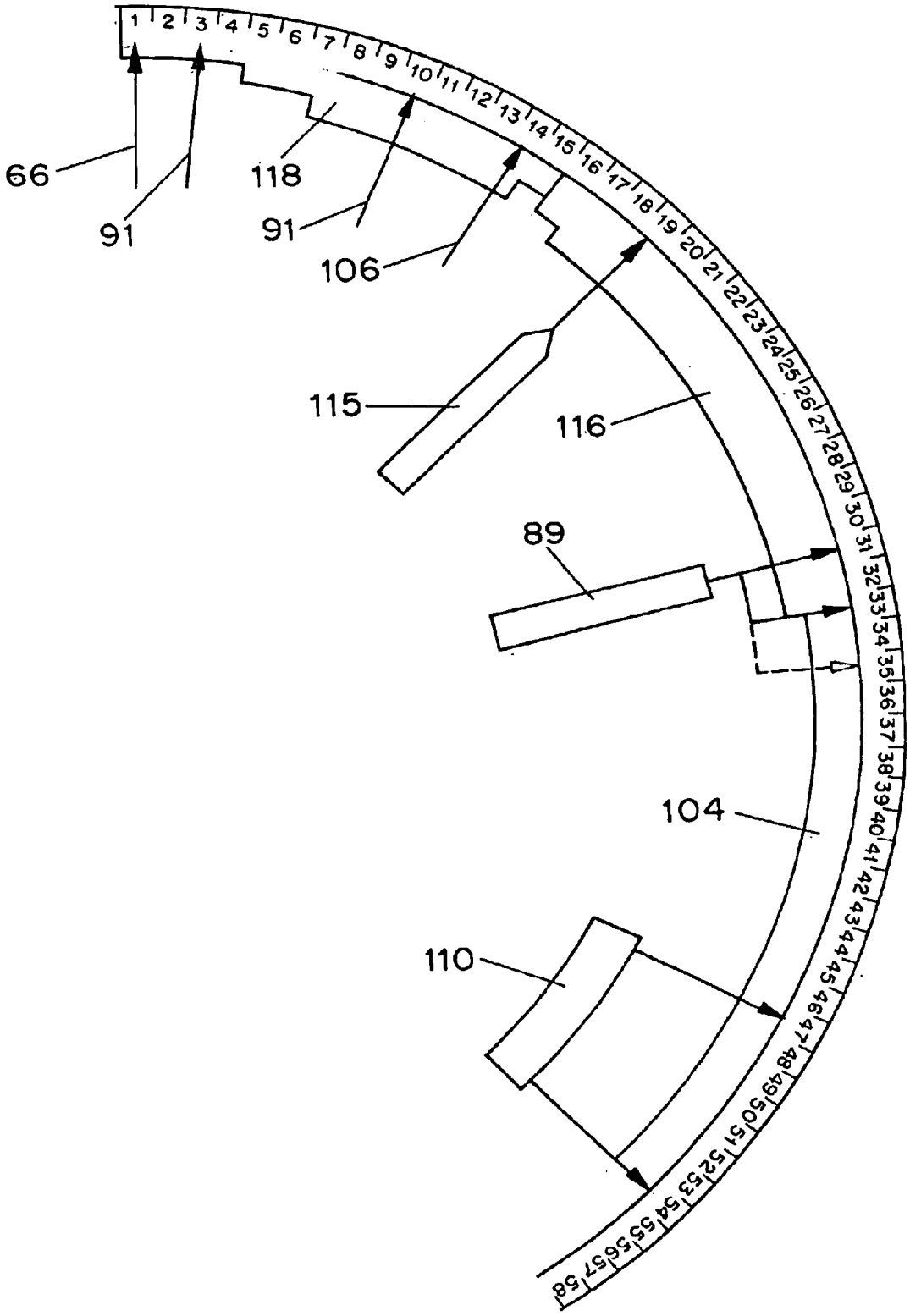

A few practical or usable domain permutations are outlined below, but it should be noted that useful domains are not limited to just this set. A large number of other usable or practical domains are possible with this invention, many of which can be customized to specific requirements or demands of each user. In addition, fertility testing and treatment is an actively progressing field of science, with new physiology events, new fertility tests, and new fertility and contraception treatments discovered or invented every year. These future tests and treatments will be added to the domains of the invention as they are accepted into the field. Examples of domain are shown in FIGS. 21A–21V.

Numerous methods of grouping domains and elements into practical uses are possible. A "Professional Medical Group" method of grouping domains and elements is used below to illustrate various domain applications, with domain permutations customized to particular requirements of some medical professions. Items in parentheses are optional.

| Professional Group | Domain Name | Domain Elements Used: Cycle Disc | Domain Elements Used: Ovulation Disc |
|---|---|---|---|
| Educational | 1. Menstrual Cycle FIG. 21A | Menstrual Period 66<br>LH blood levels 8<br>FSH blood levels 9<br>Follicular phase<br>Estrogen levels 74 | LH-surge 15<br>Ovulation 2<br>Progesterone levels 7<br>Luteal Phase<br>Next Menstrual Period |
| | 2. Cycle Phases FIG. 21B | LMP 66<br>Follicular phase 4<br>Recruitment 76<br>Dominance 77<br>Growth 78 | Ovulation 2<br>Luteal Phase 5<br>Luteogenesis 79<br>Luteolysis 80<br>Next Menstrual Period 75 |
| | 3. Early Pregnancy FIG. 21C | LMP 66<br>NonFertile times 81<br>Fertile times 82 | Ovulation 2<br>Fertilization of oocyte 83<br>Embryo development<br>Zygote 84<br>Morula 85<br>Blastocyst 86<br>Hatching 87<br>Implantation 88<br>Pregnancy test times<br>Blood test 89<br>Urine test 90<br>Early Ultrasound 91<br>(1st Trimester development)<br>(Embryonic Plate)<br>(Fetal Heart Motion)<br>(Limb budding) |
| Family Planning | 4. Conception Cycle FIG. 21D | LMP 66<br>(Start BBT chart) 92<br>Cervical mucus<br>NonFertile Times 81<br>Fertile Times 82<br>Timed Intercourse 93 | Timed Intercourse 93<br>(BBT temperature shift)<br>Probable Ovulation<br>(Pregnancy Test)<br>Next Menstrual Period<br>Average Cycle Length |
| | 5. Contraception Cycle (Rhythm method) FIG. 21E | LMP 66<br>(Start BBT chart)<br>NonFertile Days 81<br>Maybe Fertile Days 94<br>Fertile Days<br>No Intercourse 95 | No Intercourse 95<br>(BBT temp shift)<br>Probable ovulation<br>Next Menstrual Period<br>Average Cycle Length 96<br>Urine LH-positive 97 |
| | 6. Conception (Targeted Intercourse) FIG. 21F | LMP 66<br>Start BBT chart<br>Start Urine LH tests 73 | Timed Intercourse days 93<br>Ovulation Day 2<br>(Pregnancy Test) 89<br>Next Menstrual Period 75<br>Urine LH-positive 97 |
| Family Practice Physicians and Nurses | 7. Diagnostic Cycle FIG. 21G | LMP 66<br>LH & FSH tests 98<br>Semen Analysis 99<br>HSG x-ray 72<br>Start BBT chart 92<br>Start Urine LH tests 73 | Post Coital Test 100<br>MidLuteal Prog level 101<br>Endometrial biopsy 102<br>(Next Menstrual Period) 75<br>[for EMB backcalc]<br>Urine LH-positive 97 |
| | 8. Clomiphene + ULH treatment Cycle FIG. 21H | LMP 66<br>Clomiphene days 5–9, 71<br>(Start BBT chart)<br>Start Urine LH tests 73 | Timed Intercourse 93<br>(ICI) 103<br>Start prog suppos 104<br>(Pregnancy Test) 89<br>Expected next MP 75<br>(Ultrasound-gestatnl) |
| Family Practice Physicians and Nurses (cont'd) + Ob-Gyn Physicians | 9. Clomiphene + hCG trigger Treatment Cycle FIG. 21I | LMP 66<br>Clomid Check exam 105<br>(Ultrasound day 3) 91<br>Clomiphene 71<br>Ultrasound day 10<br>(Ultrasound day 12, 14)<br>Ultrasound Scale | CG trigger injection 106<br>Timed Intercourse 93<br>(ICI) 103<br>Start prog Suppos 104<br>(Pregnancy Test) 89<br>Expected Next MP 75<br>(Ultrasound-gestatnl) |
| Ob-Gyn Physicians and Nurses | 10. Processed IUI Cycle (AIH and AID) FIG. 21J | LMP 66<br>Start Urine LH tests 73 | Urine LH-positive 97<br>IUI 107<br>Start prog suppos 104<br>(Pregnancy Test) 89<br>Expected Next MP 75<br>(Ultrasound-gestatnl) |
| | 11. Clomiphene + Urine LH + IUI Cycle FIG. 21K | LMP 66<br>Clomid Check exam 105<br>Clomiphene 71<br>Start Urine LH tests 73<br>(dexamethasone days) | Urine LH-positive 97<br>IUI 107<br>Start prog suppos 104<br>(Pregnancy Test) 89<br>Expected Next MP 75<br>(Ultrasound-gestatnl) |

-continued

| Professional Group | Domain Name | Domain Elements Used: Cycle Disc | Domain Elements Used: Ovulation Disc |
|---|---|---|---|
| | 12. Clomiphene + hCG trigger + IUI Cycle FIG. 21L | LMP 66<br>Clomid Check exam 105<br>Clomiphene 71<br>Ultrasound day 10 91<br>(Ultrasound day 12,14)<br>Ultrasound Scale<br>(dexamethasone days) | hCG trigger injection 106<br>IUI 107<br>(Second IUI)<br>Start prog suppos 104<br>(Pregnancy Test) 89<br>Expected Next MP 75<br>(Ultrasound-gestatnl) |
| Reproductive Endocrinologists and R.E. Nurses | 13. Clomiphene + single hMG cycle FIG. 21M | LMP 66<br>Clomid Check exam 105<br>Clomiphene days 3–7 71<br>hMG injection day 9 108<br>Ultrasound day 10 91<br>(Ultrasound day 12,14)<br>Ultrasound Scale | hCG trigger injection 106<br>Timed Intercourse 93<br>(IUI)<br>Start prog suppos 104<br>(Pregnancy Test) 89<br>Expected Next MP 75<br>(Ultrasound-gestatnl) |
| | 14. Clomiphene + Mid-Load hFSH Cycle FIG. 21N | LMP 66<br>Ultrasound day 3 91<br>Clomiphene days 3–7 71<br>hFSH inj days 6, 8, 10 109<br>Ultrasound day 10 91<br>(Ultrasound day 12,14)<br>Ultrasound Scale | hCG trigger injection 106<br>Timed Intercourse<br>(IUI) 107<br>Start prog suppos 104<br>(Pregnancy Test) 89<br>Expected Next MP 75<br>(Ultrasound-gestatnl) |
| | 15. Clomiphene + Front-Load hFSH Cycle hMG Cycle FIG. 21O | LMP 66<br>Ultrasound day 3 91<br>Clomiphene days 3–7 71<br>hFSH days 3–6 109<br>hMG days 8, 10 (12) 108<br>Ultrasound day 10 91<br>(Ultrasound day 12,14)<br>Ultrasound Scale | hCG trigger injection 106<br>Timed Intercourse<br>(IUI) 107<br>Start prog suppos 104<br>(Pregnancy Test) 89<br>Expected Next MP 75<br>(Ultrasound-gestatnl) |
| | 16. Standard hFSH + IU Cycle FIG. 21P | LMP 66<br>Ultrasound day 3 91<br>hFSH inj days 3–10 + 109<br>Ultrasound day 10 91<br>(Ultrasound day 12,14)<br>Ultrasound Scale | hCG trigger injection 106<br>Timed Intercourse<br>(IUI) 107<br>Start prog suppos 104<br>(Pregnancy Test) 89<br>Expected Next MP 75<br>(Ultrasound-gestatnl) |
| | 17. Lupron + hFSH + IUI Cycle FIG. 21Q | LMP 66<br>Lupron days 1–10+<br>(luteal Lupron days)<br>Ultrasound day 3 91<br>hFSH inj days 3–10+ 109<br>Ultrasound day 10<br>(Ultrasound day 12,14)<br>Ultrasound Scale | hCG trigger injection 106<br>Timed Intercourse<br>(IUI) 107<br>Start prog suppos 104<br>(Pregnancy Test) 89<br>Expected Next MP 75<br>(Ultrasound-gestatnl) 110<br>(Obstetrics visit) 111 |
| | 18. Step-Up hFSH + IUI Cycle FIG. 21R | LMP 66<br>Ultrasound day 3 91<br>Step-Up hFSH days 109<br>Ultrasound day 10<br>(Ultrasound day 12,14)<br>Ultrasound Scale<br>(Estrogen Tests)<br>(Drift Days) | hCG trigger injection 106<br>Timed Intercourse<br>(IUI) 107<br>Start prog suppos 104<br>(Pregnancy Test) 89<br>Expected Next MP 75<br>(Ultrasound-gestatnl) 110<br>(Obstetrics visit) 111 |
| | 19. In Vitro Fertilization Cycle FIG. 21S | (Prior Cycle BCPs)<br>Prior cycle Lupron 112<br>LMP 66<br>Ultrasound day 3, 7 91<br>hFSH inj days 3–10+ 109<br>Ultrasound day 9, 10<br>(Ultrasound day 11–16+)<br>Estrogen Tests w/US<br>Ultrasound Scale<br>(Drift Days) | hCG trigger injection 106<br>Ultrasound Egg Capture 113<br>In Vitro Fertilization 114<br>Embryo Transfer Day 115<br>Progesterone injections 116<br>Start prog suppos 104<br>Pregnancy Test 89<br>(2nd Pregnancy Tst)<br>Expected Next MP<br>Ultrasound-gestatnl |
| | 20. Co-Flair In Vitro Fertilization Cycle FIG. 21T | (Prior Cycle BCPs)<br>LMP 66<br>Lupron days 2, 3, 4 112<br>(low-dose Lupron day 5+)<br>Ultrasound day 3, 7 91<br>High-dose hFSH inj days 3–10+ 109<br>Ultrasound day 9, 10<br>(Ultrasound day 11–16+)<br>Estrogen tests with US<br>Ultrasound Scale | hCG trigger injection 106<br>Ultrasound Egg Capture 113<br>In Vitro Fertilization 114<br>Embryo Transfer Day 115<br>Progesterone inj. 116<br>Start prog suppos 104<br>Pregnancy Test 89<br>(2nd Pregnancy Tst)<br>Expected Next MP<br>Ultrasound-Gestatnl 110 |
| | 21. G.I.F.T. Cycle FIG. 21U | (Prior Cycle BCPs)<br>Prior Cycle Lupron 112<br>LMP 66 | hCG trigger injection 106<br>Laparoscopy G.I.F.T. 117<br>Start prog inject 116 |

-continued

| Professional Group | Domain Name | Domain Elements Used | |
|---|---|---|---|
| | | Cycle Disc | Ovulation Disc |
| | | Ultrasound day 3, 7 91<br>hFSH inj days 3–10+ 109<br>Ultrasound day 9, 10<br>(Ultrasound day 11–16+)<br>Estrogen Tests with US<br>Ultrasound Scale | Pregnancy Test 89<br>(2nd Pregnancy Tst)<br>Progesterone suppos 104<br>Expected Next MP<br>Ultrasound-gestatnl 110 |
| | 22. Frozen Embryo Cycle FIG. 21V | LMP 66<br>Estrgn Pill/Patch days 118<br>Ultrasound day 3, 10 91<br>(prog start day)<br>(Embryo Transfer Day) 115<br>(Start urine LH Test) | hCG trigger injection<br>Froz Embryo Trnsfr<br>(Thaw Embryos Day)<br>Start prog inject 116<br>Pregnancy Test 89<br>(2nd Pregnancy Tst)<br>Expected Next MP<br>Ultrasound-gestatnl 110 |

A large variety of other types of testing and treatment cycles exist and a wide variation in the types of elements, or timing of elements, are used by different professional groups or practitioners, so the permutations listed above are primarily for illustration of some commonly used domains. The types of domains illustrated will also generally overlap within the professional groups, i.e. Ob-Gyn physicians and Reproductive Endocrinologists would also benefit by having a Diagnostic Cycle (number 7) which is listed in the Family Practice Physician group.

Figure 22A:
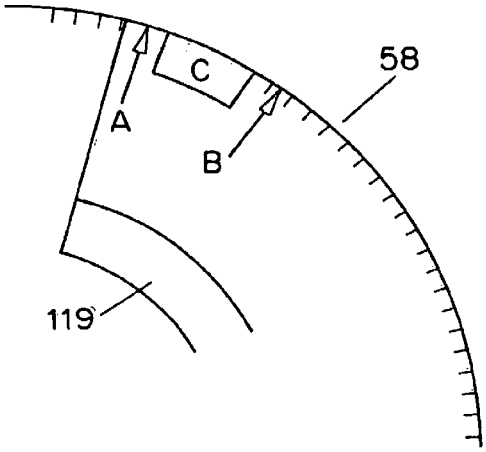
FIGS. 22A–22D illustrate the open-ended arc system for matching initial and final steps in a test from one disc to another.
Figure 22B:
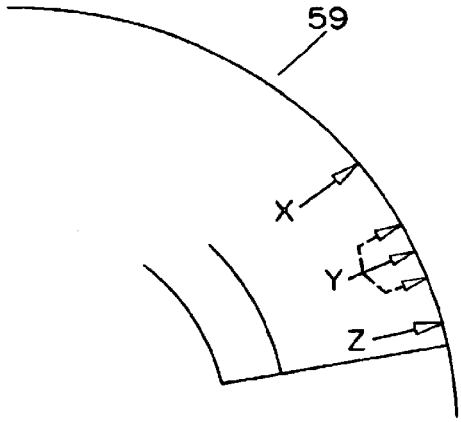
Figure 22C:
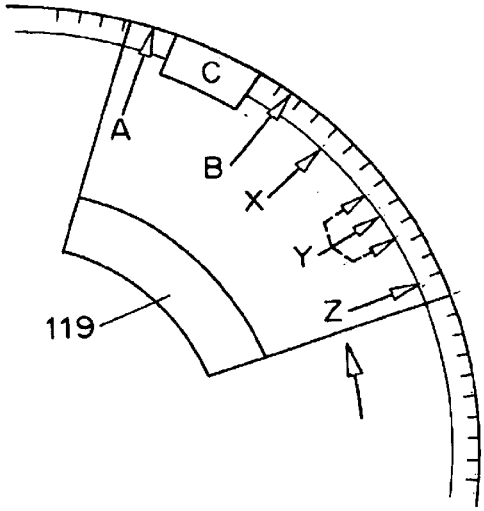
Figure 22D:
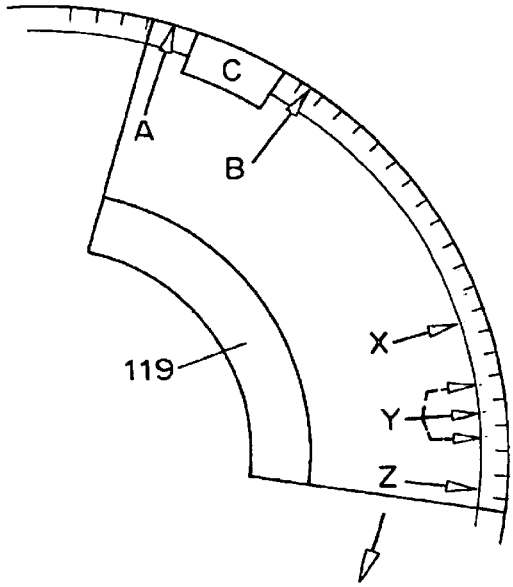

Domain names can be labeled on the cycle day and ovulation day discs to clarify the clustered elements for the calculator user. The domains that lie exclusively on the cycle day disc or the ovulation day disc are easy to label, typically toward the center of the wheel under the collection of elements with perhaps a radial line drawn at the beginning of the domain and another at the end of the domain to enclose its limits. Many domains will have elements on the cycle day disc and the ovulation day disc. Printing all of the elements of a single domain in the same color, whether the elements are on the same disc or on both a cycle day disc and an ovulation day disc, and using different colors for each domain achieves an easy-to-read calculator. In use, the same colored elements are matched up to create the domain. An arc-shaped domain name 119 can also be used in these instances, with the domain name enclosed within an arc-shaped box. The first half of the arc-shaped box "window" is printed on the cycle day disc 58, along with the radial line to the outer edge of the disc marking the beginning of the domain, and usually along with the enclosed domain name itself 119 (e.g. "Diagnostic Cycle") printed within the window (FIG. 22A). The last part of this cycle day disc window is open-ended, but it will match the position of the last half of the arch-shaped window box printed on the overlying transparent ovulation day disc 59 (FIG. 22B). The first part of the empty window on the ovulation day disc is open-ended, and the last part aligns with another radial line to the outer edge of this disc marking the end of the domain. With this system, the variable size of the domain can be accommodated by rotating the ovulation day disc around the center-in fulcrum changing the length of the arc-shaped window, but with the printed domain name inside easily visible within the window (FIGS. 22C and 22D).

Some special applications will use cycle day elements for one domain, and ovulation day elements from another domain. These shared domains are also easily accommodated by the calculator simply by rotating the transparent ovulation day disc around the center pin until the required domain elements on this disc lie alongside the appropriate or special cycle day elements on the underlying cycle day disc domain. Preferably, the cycle day domain elements will immediately precede the ovulation day domain elements. An example of shared domain use would be a treatment cycle converted from an originally intended In Vitro Fertilization cycle into a less expensive IntraUterine Insemination cycle because of poor ovarian response to the fertility drugs on the cycle day disc. The In Vitro Fertilization domain on the ovulation day disc is rotated away and replaced by the IntraUterine Insemination domain on the ovulation day disc.

Figure 26A:
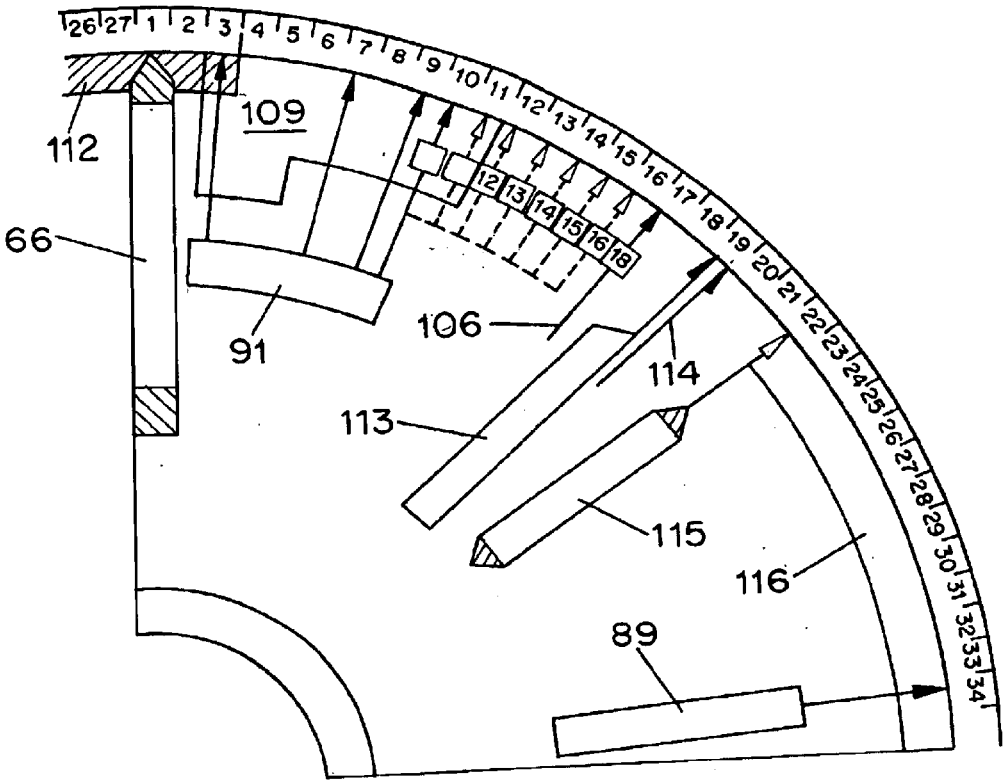
FIGS. 26A–26D illustrate the substitution of domain discs on a one-sided or two-sided base.
Figure 26B:
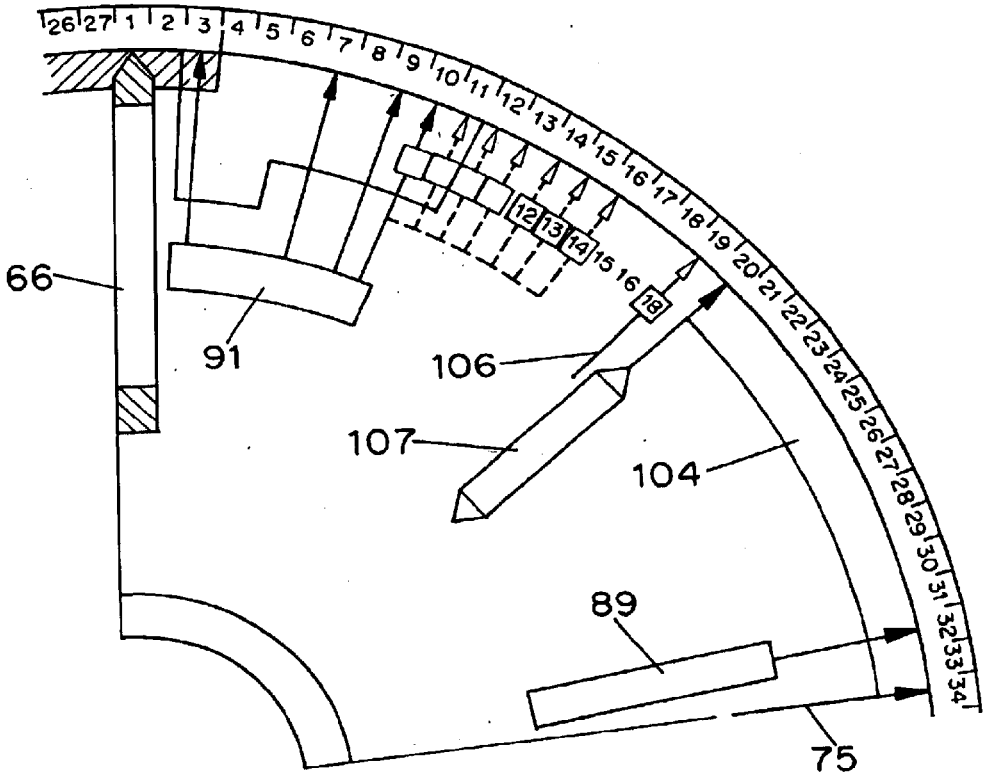
Figure 26C:
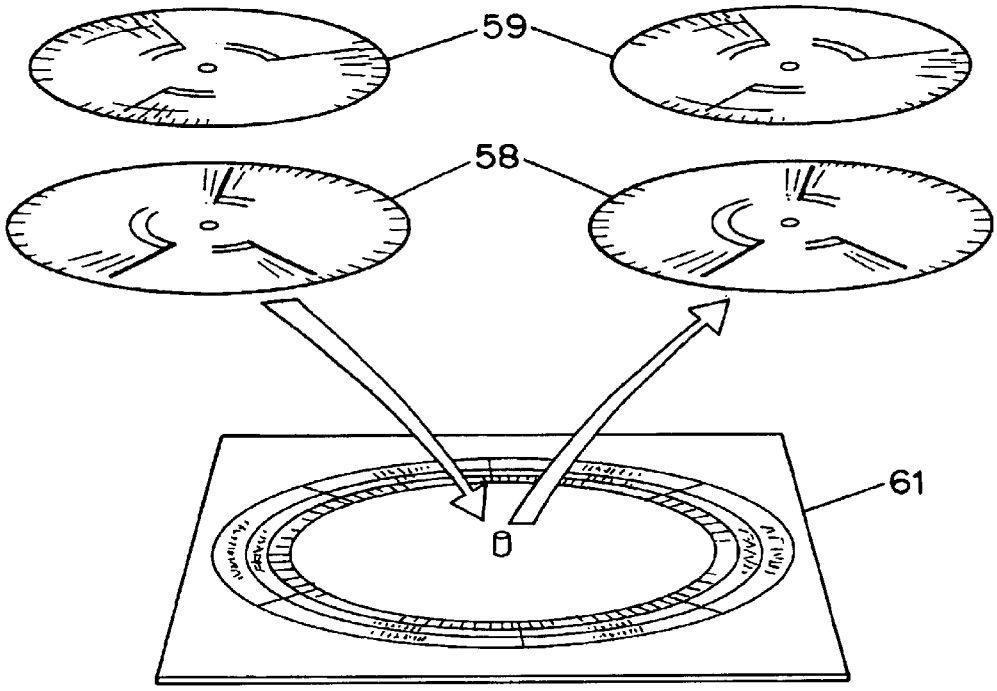
Figure 26D:
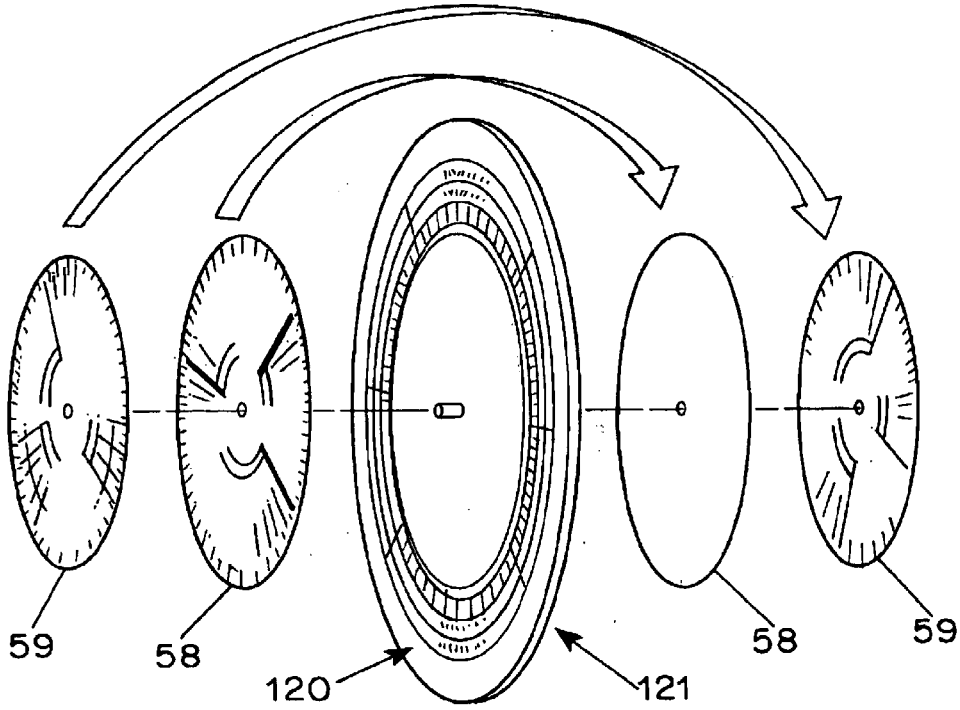

The length of a typical domain matches the length of the corresponding menstrual treatment cycle, usually 26 to 28 days. Most of the space on the calendar day bases (153 days) would be wasted if the cycle day and ovulation day discs contained only one domain. An efficient use of the fertility calculation is to print 3 to 4 separate domains on the cycle day and ovulation day discs. Attention is paid only to the active domain, with the other domains brought into use whenever needed. This arrangement allows sharing of domains, as described above, and allows several domains commonly used by a professional group to be present for immediate use on one calculator. This allows the substitution of domain when there is a change in the tests or procedures to be performed. For example, if an in-vitro fertilization (IVF) procedure is to be replaced by an intra-uterine insemination (IUI) procedure, the ovulation plate with the IVF domain (FIG. 26A) is rotated away, and the IUI domain is rotated into position (FIG. 26B). If one user requires a large number of domains, separately stored cycle day and ovulation day discs with all domains needed can be exchanged onto the calendar date bases (FIG. 26C). As shown in FIGS. 26D, this system also allows cycle day 58 and ovulation day 59 discs to be exchanged from the calendar date base with March-to-January 120 onto the calendar day base with February-leap February 121, as long as the total number of days on each base is the same (153 days). There is a wide variation in the size of different domains, from 26 to around 70. The cycle day and ovulation day discs can accommodate up to 4 small domains, or 1 to 2 large domains and still remain functional.

Special Calculating Domains

The interaction between the transparent ovulation disc and the cycle day disc provides easy timing calculations for some fertility tests and treatments within special domains. This is achieved by aligning two special elements, one on the cycle day disc, the other on the ovulation day disc.

Figure 27A:
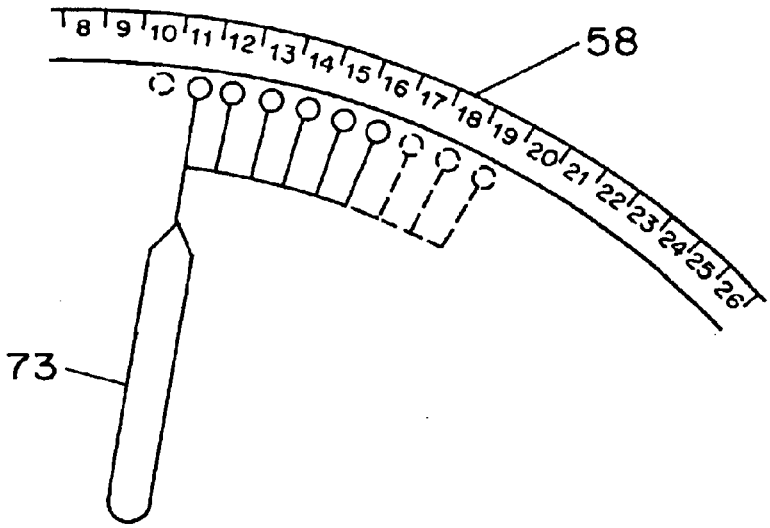
FIGS. 27A–27D illustrate an LH-surge calculator.
Figure 27B:
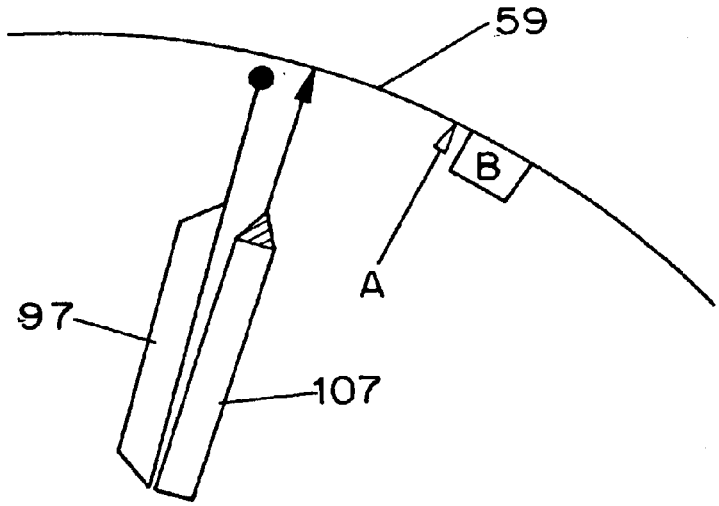
Figure 27C:
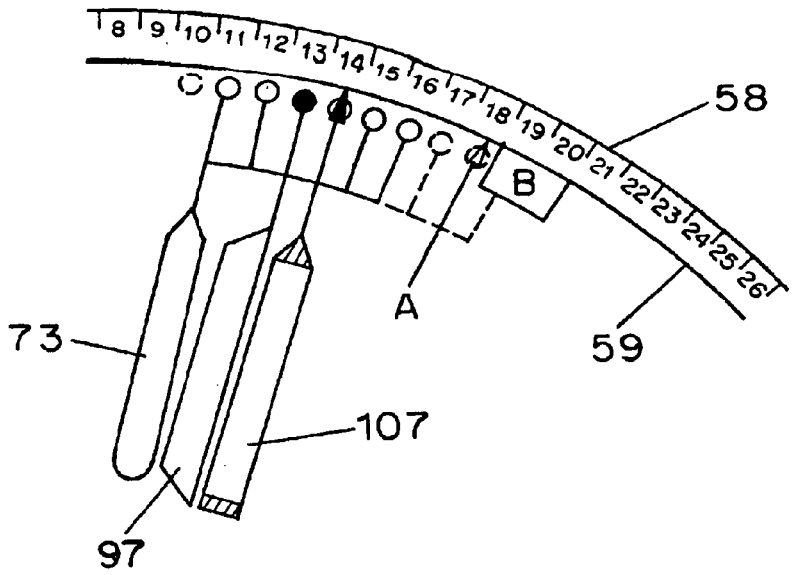
Figure 27D:
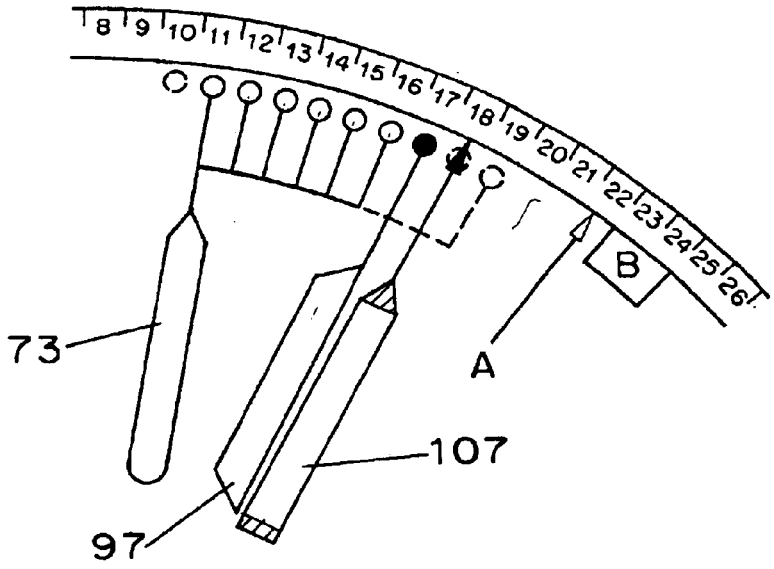

1. LH-Surge. As shown in FIGS. 27A–27D, the alignment of the entire ovulation day disc is determined by the day of the LH-surge 97 for many applications. The cycle day disc has a series of open small circles printed immediately under the cycle day numeral, usually with the first cycle printed under Cycle Day 11 and with a circle printed under each subsequent day for the ovulation day disc at exactly the same radius from the center-pin fulcrum as the next 6 to 10 days. A single filled-in circle (the same size) is printed on the open circles on the cycle day disc. The patient will start daily urine LH tests 73 on cycle day 11, and within a few days the test will turn positive (for example, positive on cycle day 13 in FIG. 27C). When this occurs, the ovulation day disc is rotated over the cycle day disc until the filled circle (labeled "Positive LH surge" 97 on the ovulation day disc) lies directly over the appropriate cycle day circle (in this example cycle day 13). The elements printed on the ovulation day disc are now automatically and accurately aligned with their appropriate cycle days and calendar dates. All of the remaining tests (A) and treatments (B) for the cycle can now be scheduled for the rest of the cycle. As shown in FIG. 27C, a positive LH surge on cycle day 13 correlates with insemination on day 14, test A on day 18, and medication B on days 19 and 20. If the LH surge is not until cycle day 17, aligning the ovulation plate automatically assigns insemination to day 18, test A to day 22, and medication B to days 23 and 24 (FIG. 27D).

Figure 28A:
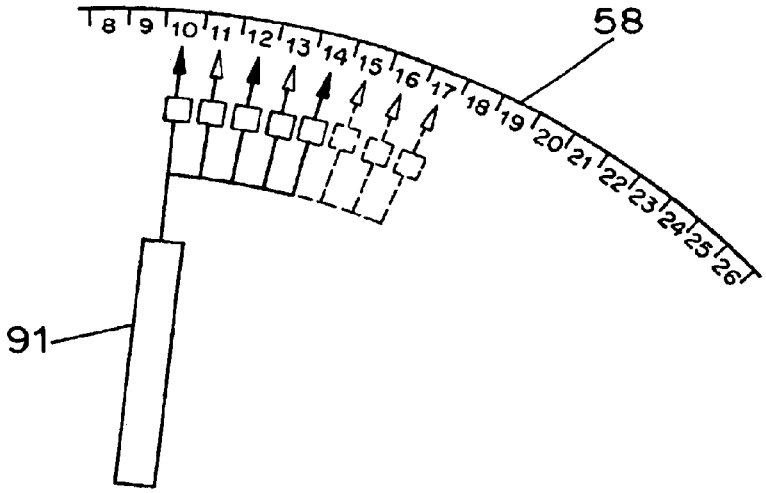
FIGS. 28A–28D illustrate the use of an ultrasound calculator.
Figure 28B:
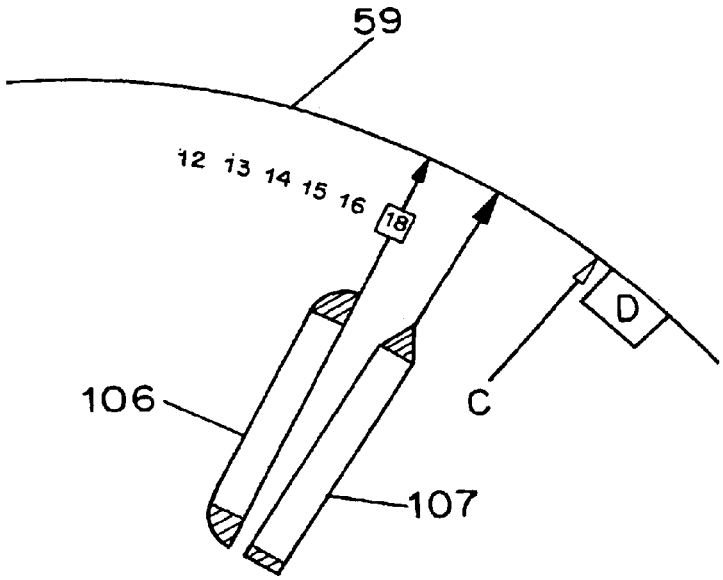
Figure 28C:
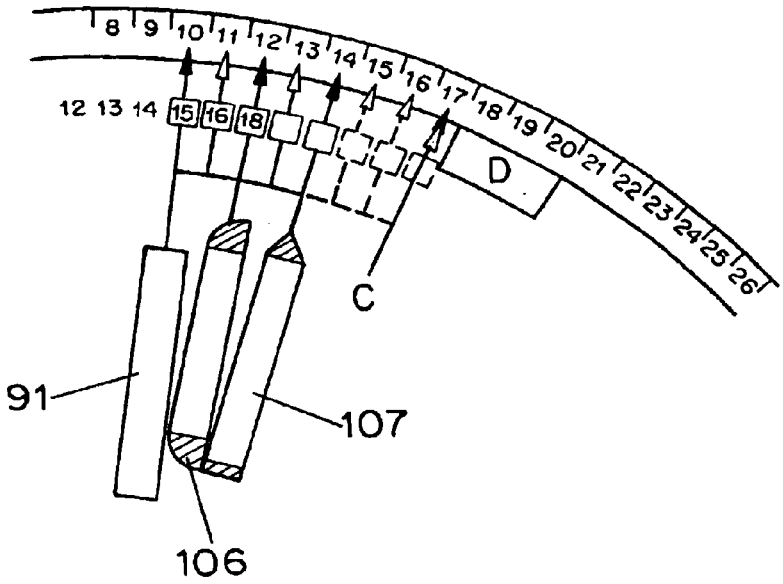
Figure 28D:
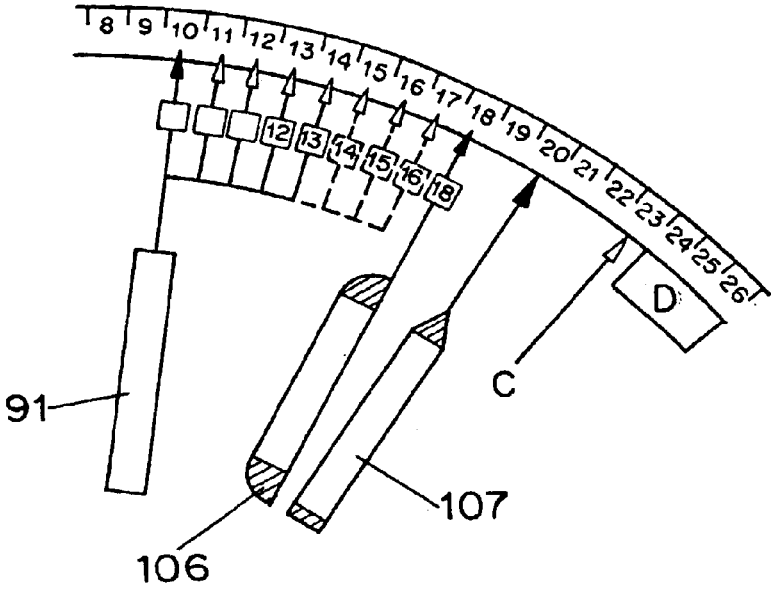
Figure 28E:
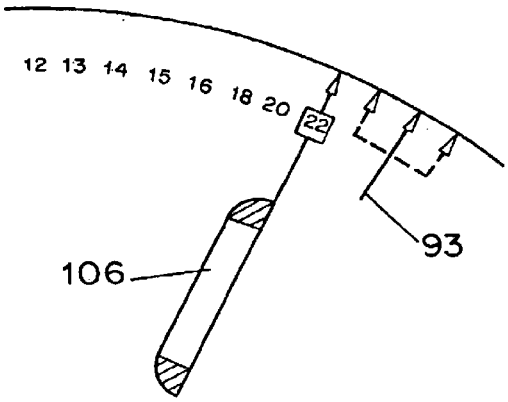
FIGS. 28E–28G illustrate additional ovulation day scales.
Figure 28F:
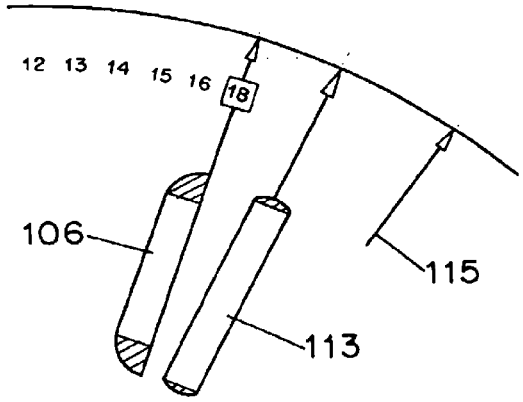
Figure 28G:
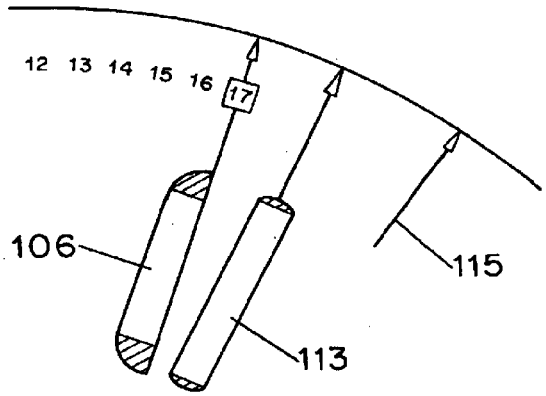

2. Ultrasound Scale. The size of the largest ovarian follicle (lead follicle) visualized by the pelvic ultrasound test determines when the hCG ovulation trigger injection is given, which then determines when all ovulation day disc domain tests and treatments are done. In general, the lead follicle grows at the rate of 1 mm per day between sizes 12 mm and 16 mm, and then grows at a rate of 2 mm per day between sizes 16 mm and 24 mm. The hCG ovulation trigger injection is given usually when the lead follicle is 20 to 22 mm diameter during clomiphene-stimulated or natural cycles, and the hCG injection is usually given when the lead follicle is 18 mm diameter during hFSH and hMG cycles (or clomiphene+hFSH/hMG cycles). A special case is scheduling the hCG injection when the lead follicle is 17 mm diameter during the Lupron+hFSH Co-Flair cycles. The ultrasound scale is used to accurately time the hCG trigger injection (GIGS. 28A–28D). It consists of several consecutive small square windows printed under the cycle day numerals on the cycle day disc, typically with the first square window under cycle day 10, and the other windows printed one per day afterwards for 6 to 10 days. A matching series of small numerals representing ultrasound lead follicle diameters are printed on the transparent ovulation day disc, at the same radius from the center-pin fulcrum as the square windows on the cycle day disc. The patient will have periodic follicular ultrasound tests 91 beginning on cycle day 10 (though not necessarily every day afterward). The diameter of the lead follicle is measured by ultrasound, and is then located on the follicle diameter scale of numerals on the ovulation day disc. For example, as shown in FIG. 28C, the ultrasound test is done on cycle day 10, measuring a lead follicle diameter of 15 mm. The 15 numeral on the ovulation day disc is then rotated into position so that it lies inside the square window printed under cycle day 10 on the cycle day disc. Once this is done, the elements printed on the ovulation day disc automatically and accurately align with their appropriate cycle days and calendar dates, including the hCG trigger injection marker 106. All of the remaining tests (C) and treatments (D) for the cycle, including the hCG injection, can now be scheduled. Examples of other events linked on the ovulation day scale are hCG injection 106 and timed intercourse 93 (FIG. 28E) and, hCG injection 106, ultrasound egg capture 113 and embryo transfer 115 (FIGS. 28F and 28G).

Figure 29A:
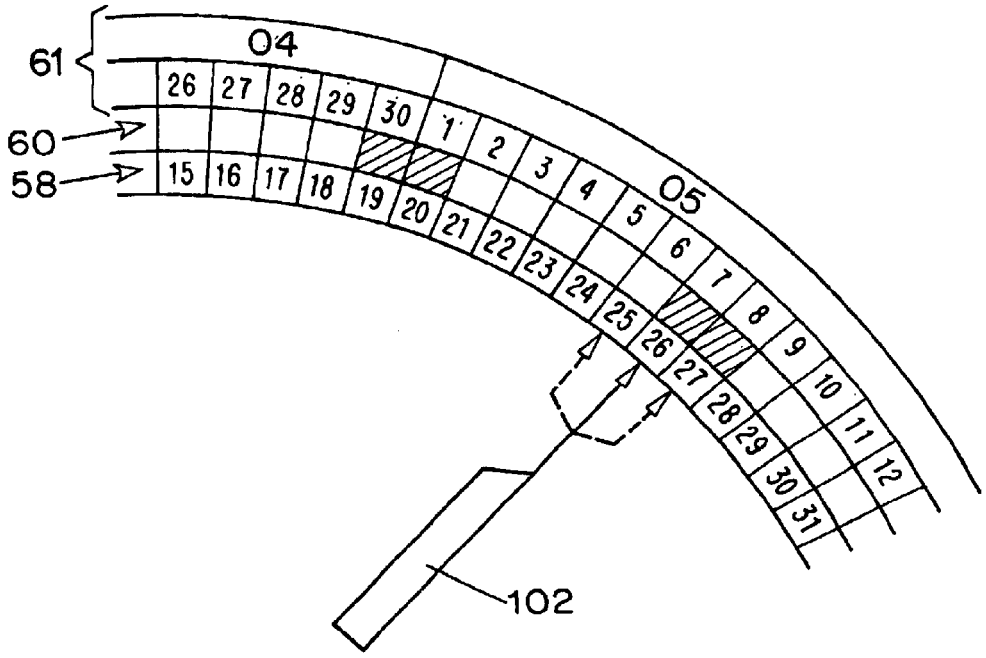
FIGS. 29A–29D illustrate an endometrial biopsy calculator and an early pregnancy calculator, respectively.
Figure 29B:
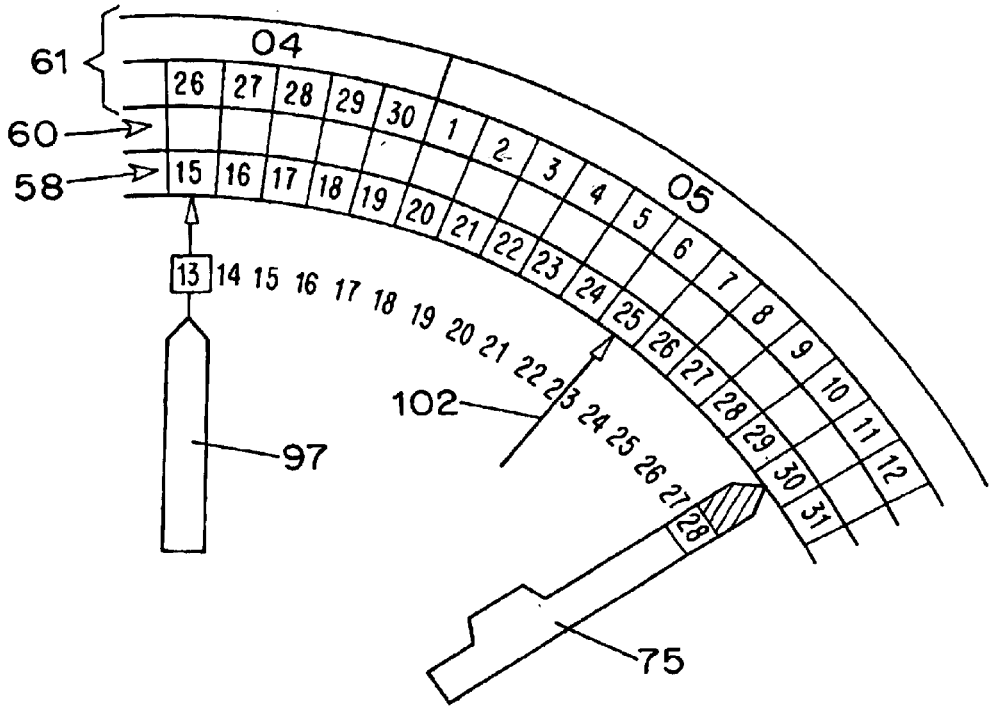
Figure 29C:
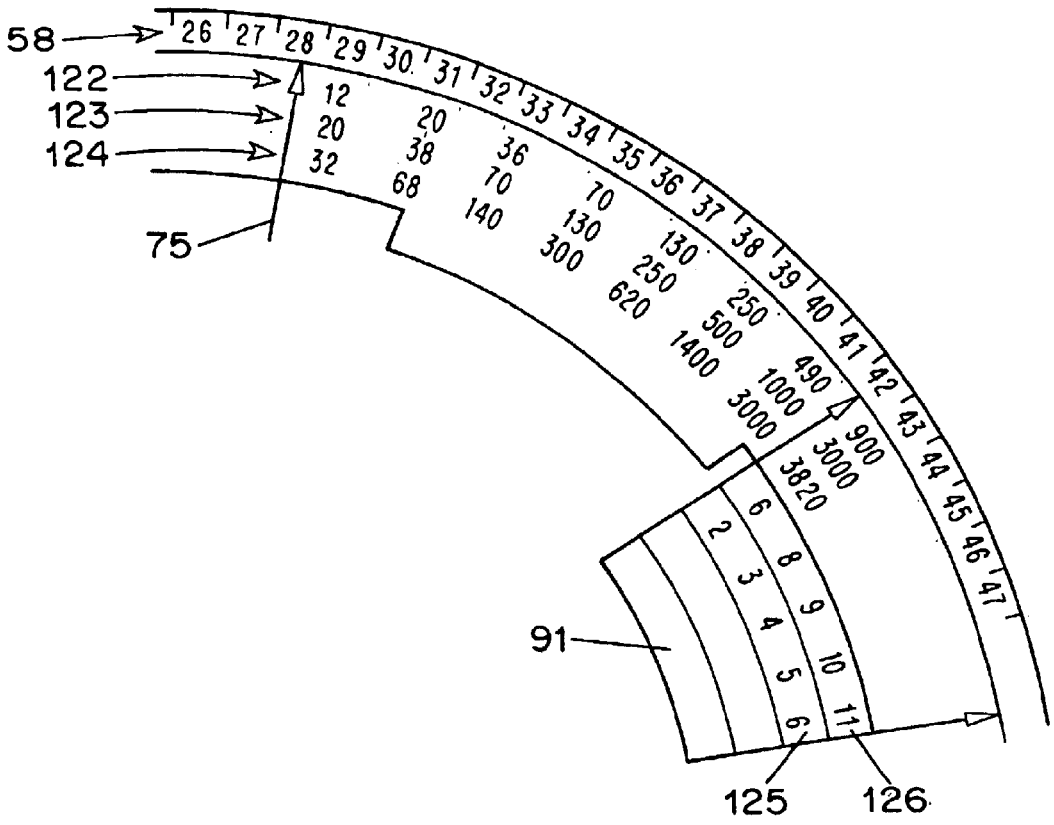
Figure 29D:
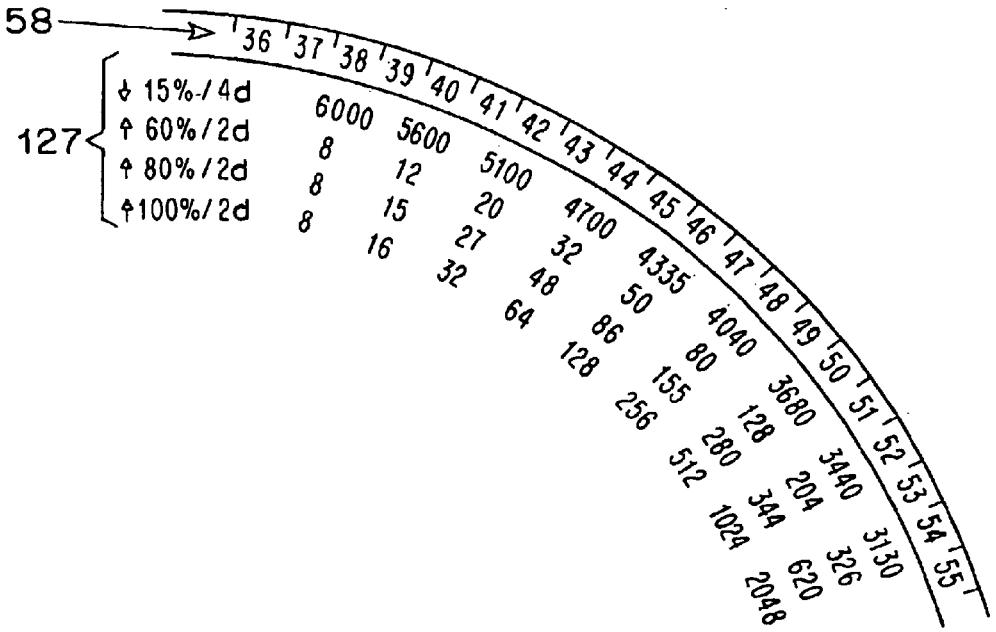

3. Other Special Calculations. Other calculated information can be displayed by the fertility calculator, with some information fixed to an element on the cycle day or ovulation day disc. The weekday disc 60 can be used to avoid scheduling tests and procedures on a weekend. As shown in FIG. 29A, an endometrial biopsy 102 may be done on one of three days, and the weekday plate with weekends shaded is used to schedule the biopsy on May 6 to avoid the weekend. FIG. 29B shows calculating the endometrial biopsy date from either the LH surge 97 of the current menstrual period, or "back calculating" from the expected next menstrual period 75. Another example of a special calculation is for early pregnancy. Once a positive LH surge test is properly aligned, and the patient achieves pregnancy during that cycle, low 122, average 123 and high 124 levels of the β-hCG blood tests can be printed on the appropriate cycle days to be compared to the actual β-hCG levels obtained on those days. The same system can be used to compare expected and actual gestational ultrasound parameters such as fetal crown-rump length 125 (CRL) or gestational sac diameter 126 (FIG. 29C). FIG. 29D shows another special early pregnancy application. Serum β-hCG levels with rates of increases and decrease 127 are printed on an ovulation disc. In use, the first measured β-hCG level is found on the ovulation disc and is aligned with the appropriate cycle day. The next measured β-hCG level is compared to the nearest value printed on the ovulation disc. The decreasing scale is used for methyltrexate therapy cycles as therapy for ectopic pregnancy. The increasing scales are used to determine rate of β-hCG increase in normal pregnancies to determine suspicion level for miscarriage, ectopic pregnancy or multiple pregnancy.

Applications

The interchangeable component design of the Fertility Calculator allows it to be used for a large variety of possible applications. Not only can individual elements be selected, mixed, and matched into a large number of useful domains, but the cycle day and ovulation day discs can be exchanged for other discs with additional domains to greatly extend the capabilities of the calculator. Possible applications of the fertility calculator include, but are not limited to, the following:

1. Infertility Clinical Scheduler. This is the primary application of the calculator. It is used to time or schedule most of the currently used infertility tests, procedures, timed intercourse, and other treatments including timed fertility drug therapies. Each of these tests and treatment procedures can be accurately scheduled on the cycle day, calendar date, and weekday to obtain the most accurate result or highest pregnancy rate. Some fertility tests or treatments must be performed on a specific, exact cycle day in order to work, and the design of the calculator allows this high degree of accuracy. Once the cycle day and ovulation day discs are properly aligned with each other and the calendar date base, all of the selected tests and treatments can be scheduled by reading the marked calendar dates.

Figure 30A:
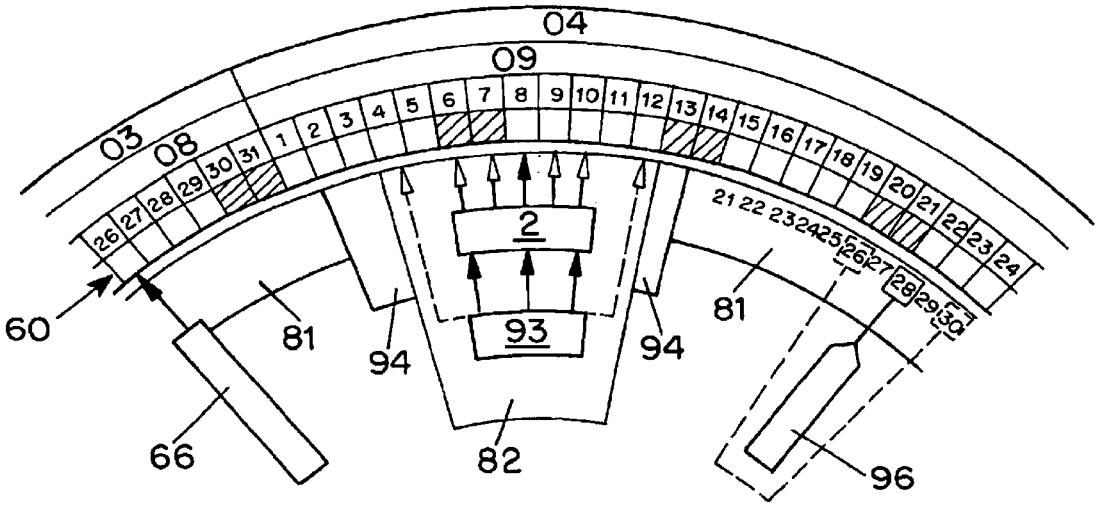
FIGS. 30A and 30B illustrate a conception family planning calculator and the optional intercourse timing marker arm.
Figure 30B:
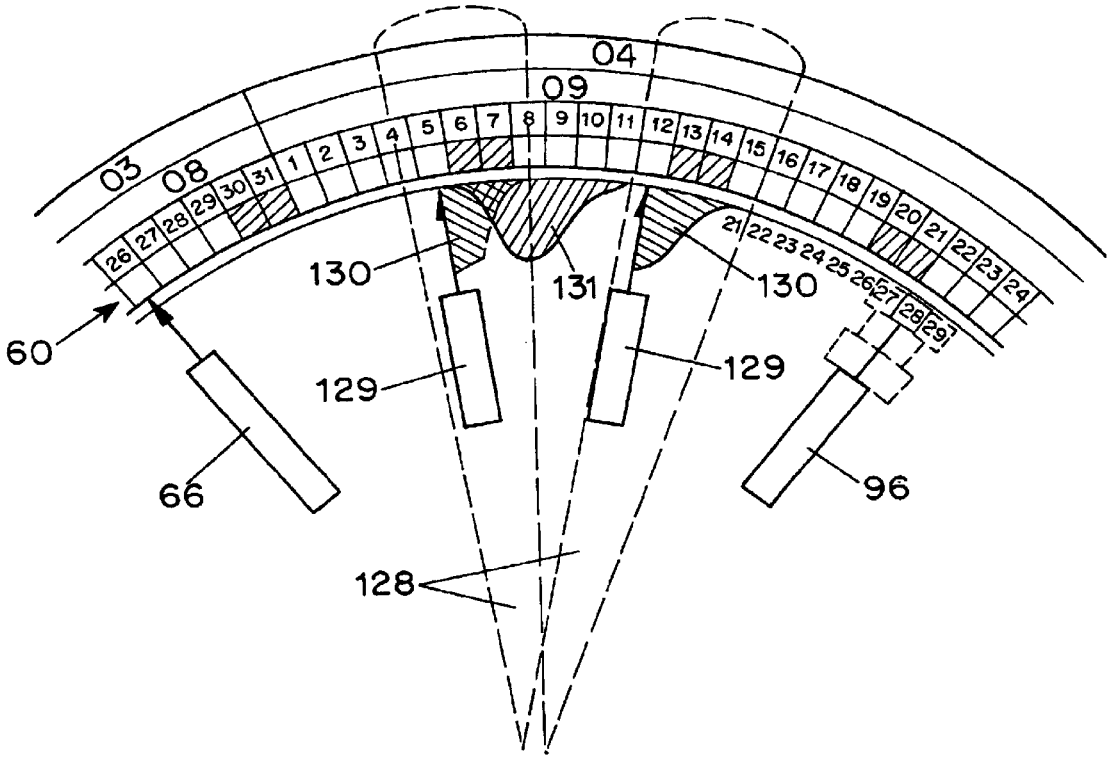
Figure 36:
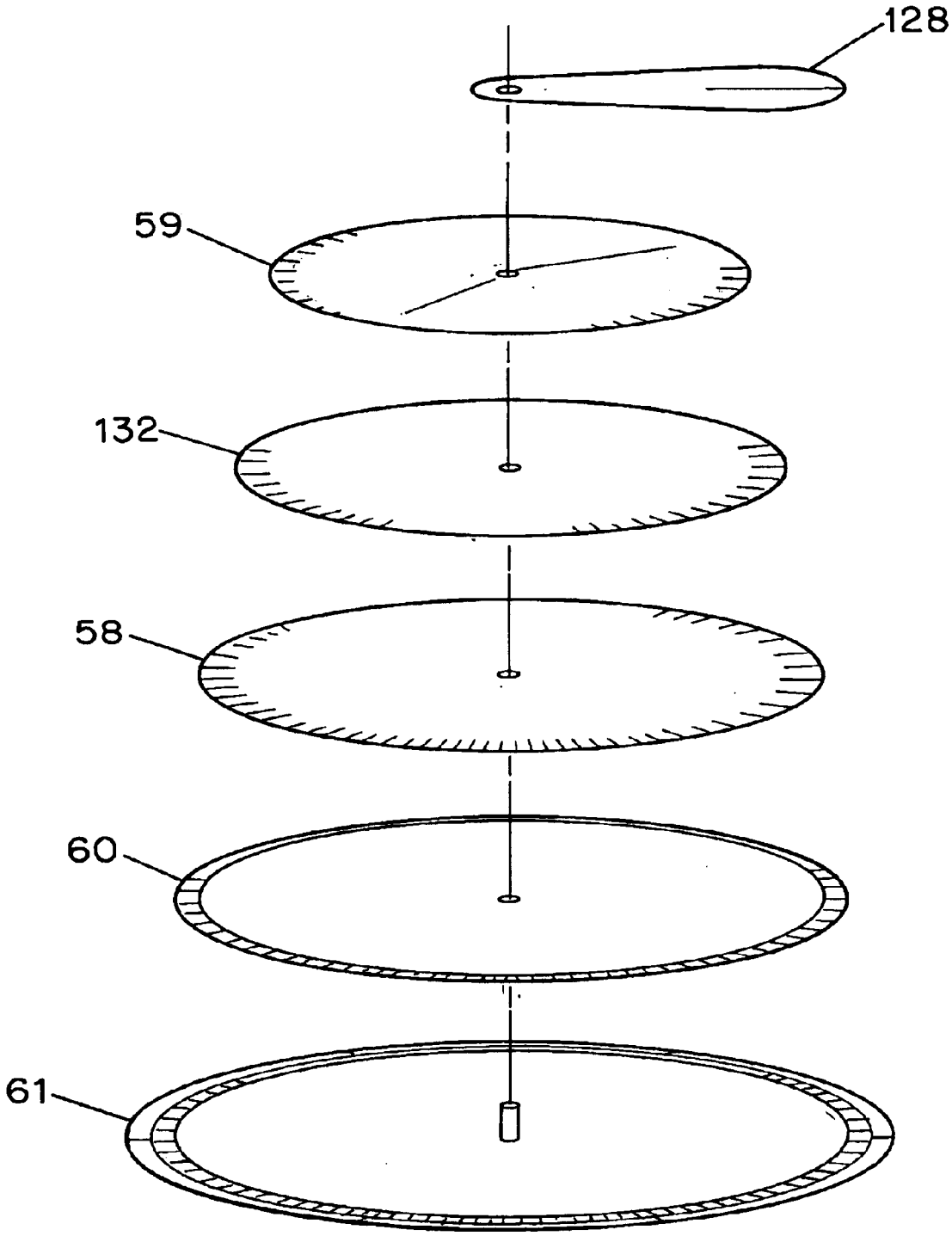
FIG. 36 shows the assembly of a calendar base, weekday disc, menstrual cycle disc, adjusted cycle day disc, ovulation day disc and marker arm.

2. Conception Family Planning. Many couples have no infertility problems or diagnosis, they simply would like to achieve pregnancy at a specific time or during a specific menstrual cycle. Fertile couples can use the fertility calculator to attempt timed pregnancy (or predicted delivery of the baby nine months later) during a vacation, during a time for medical or family leave, to reduce income tax at year's end, or to avoid third trimester during summer heat, etc. Other fertile couples have not been educated in menstrual cycle physiology and could use the calculator to learn the optimal time for intercourse to achieve pregnancy. FIG. 30A illustrates an embodiment of the invention used to maximize the chance of pregnancy. In this embodiment, the ovulation day disc is printed with markers indicating non-fertile times 81, days of likely ovulation 2, days for timed intercourse 93, and a range of average cycle lengths 96. According to the example illustrated in FIG. 30A, for an average cycle length of 28 days with the last menstrual period starting on Tuesday, March 26, timed intercourse should occur on Saturday, April 6, Monday, April 8 and Wednesday, April 10 for the best chance of pregnancy. Another embodiment of the conception family planning calculator is illustrated in FIG. 30B. This embodiment utilizes a transparent marker arm 128 which is attached to the calculator on one end, the other end having a marker labeled "intercourse" 129 which is aligned with the corresponding day on which intercourse occurred or will occur. The marker arm is also marked with a curve labeled "chance of sperm" 130 extending over the space corresponding to up to six days beyond the "intercourse" marker. In this embodiment, the ovulation day disc is marked with an average cycle length indicator 96 and is also marked with a curve labeled "chance of egg" 131. The shape, width, and position of the "chance of egg" curve is determined by the average cycle length and cycle length variability. Several different curves can be printed on one calculator, each separate domain. For planning a pregnancy, the ovulation day disc is positioned such that the average cycle length indicator is aligned with the appropriate day on the cycle day disc. The marker arm is then aligned such that the "chance of sperm" curve overlaps with the "chance of egg" curve on the ovulation day disc. The "intercourse" marker will then be aligned with the appropriate day for intercourse to achieve pregnancy. To avoid pregnancy, the marker arm is aligned such that there is no overlap between the "chance of sperm" and "chance of egg" curves. FIG. 36 illustrates the assembly of a calculator with a calendar disc 61, weekday disc 60, cycle day disc 58, optional adjusted cycle day disc 132, ovulation day disc 59 and marker arm 128.

Figure 31A:
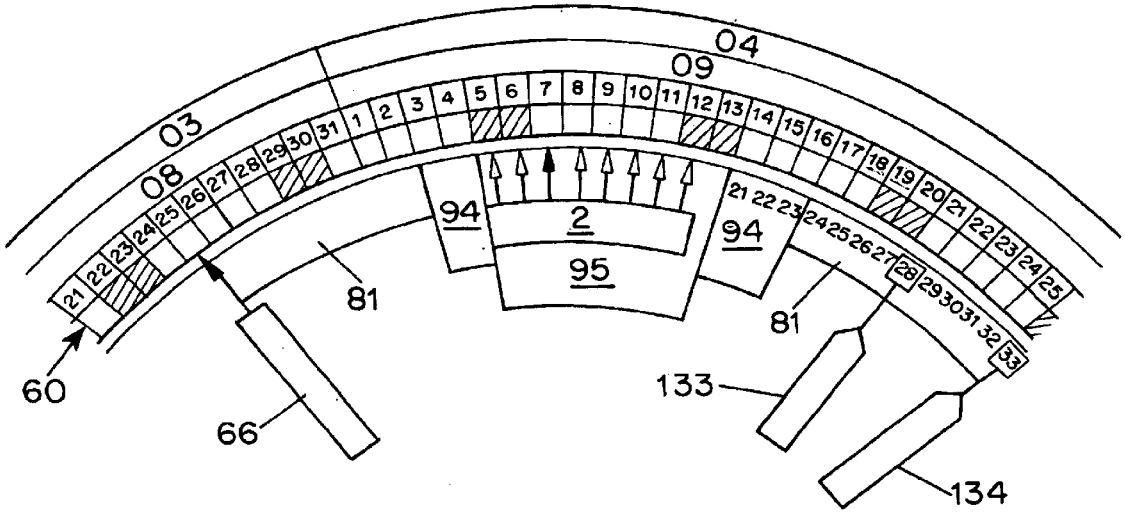
FIGS. 31A and 31B illustrate contraception family planning calculators, with words and with symbols.

3. Contraception Family Planning. Many fertile couples would like to use a very inexpensive method to minimize the change of becoming pregnant. Some have religious restrictions on the use of other forms of medical contraception and are permitted to use "rhythm methods" only. A large portion of the earth's population have no access to standard medical contraception, especially those in Third World countries. The fertility calculator can be used to display the non-fertile "safe" and the fertile "unsafe" calendar dates in order to restrict the time of sexual intercourse to minimize the chance of oocyte-sperm fertilization (FIG. 31A). This is done by supplying the calculator with cycle day discs and ovulation discs containing contraception domains, which can be customized to the individual user by adjusting for her average cycle length, and including her shortest 133 and longest 134 cycle lengths.

Figure 31B:
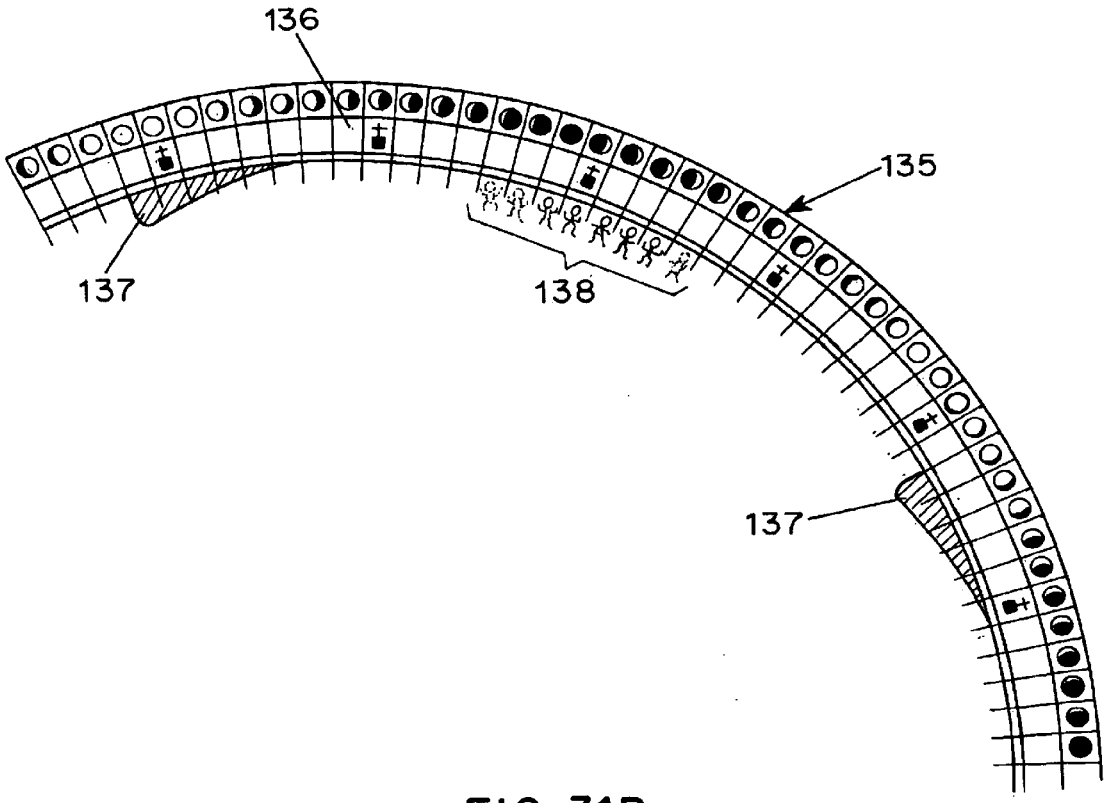

A very large proportion of the human population, especially in Third World countries, are illiterate and innumerate. A special Family Planning calculator can be designed with no written information, which instead uses common intuitive symbols. Illiterate populations are typically from rural agricultural areas, and known the nightly moon phases. Nearly all illiterate populations are very religious and attend a church, mosque, synagogue or other religious ceremony on a regular basis, such as one per week. By aligning religious day symbols with the moon phase, the calendar day and 135 and religious day 136 discs can be permanently taped together. One menstrual period, represented by a colored, preferably red, curve 137 on the cycle day disc, is aligned with the proper day on the religious day disc, and the next menstrual period marked on the ovulation disc is aligned with its proper day. The ovulation disc is printed with symbols 138 indicating the fertile period. In FIG. 31B, the symbols are baby-shaped and are faint at the beginning and ending of the fertile period, and are dark in the middle of the fertile period. The cycle day and ovulation discs are then taped together forming a cycle length relation. The cycle and ovulation discs are moved in unison for subsequent cycles, and the fertile period is marked by the baby-shaped symbols in alignment with the proper moon phase and religious days.

4. Early Pregnancy Scheduler. This is an extension of the infertility test scheduler concept. Because some domains can be 60 to 90 days or more in length, certain first trimester tests and treatments can be displayed on the calculator in order to facilitate scheduling appointments for these tests (FIGS. 29C and 29D). Elements in these domains include serial β-hCG blood pregnancy tests, gestational ultrasounds, alpha-fetoprotein blood tests, progesterone hormone levels, time periods for starting or discontinuing medications (estrogen, progesterone, low-dose aspirin, heparin, etc.), and procedures such as chorionic villus sampling (CVS) or early amniocentesis.

Figure 32:
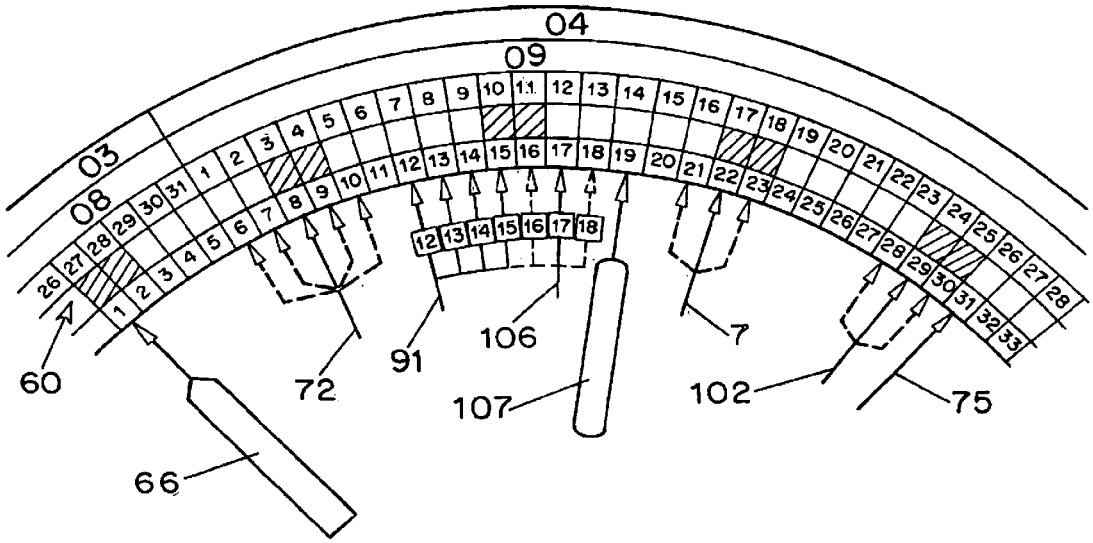
FIG. 32 illustrates a calculator for weekday scheduling.

5. Timer for Weekday Scheduling. Many tests, both related or unrelated to fertility, are scheduled on specific weekdays. For instance, a surgeon only schedules laparoscopy cases on Mondays, and cervical cryosurgery on Thursdays. The weekday disc 60 of the calculator can be used to display the weekdays of every calendar date for several months in the future. The primary use of the weekday scheduler will most likely be to avoid scheduling tests and procedures on weekends (FIG. 32). This applies to the majority of fertility tests and treatments—they have at least a two-day variability so they can be moved off of weekends (Sunday—Monday and Saturday—Friday), but a few fertility procedures require an exact schedule day so 2/7th of the time they will end up on a weekend day. A method of marking Saturdays and Sundays on the weekday disc (for example, gray scale shading) would facilitate the use of this application.

Figure 33:
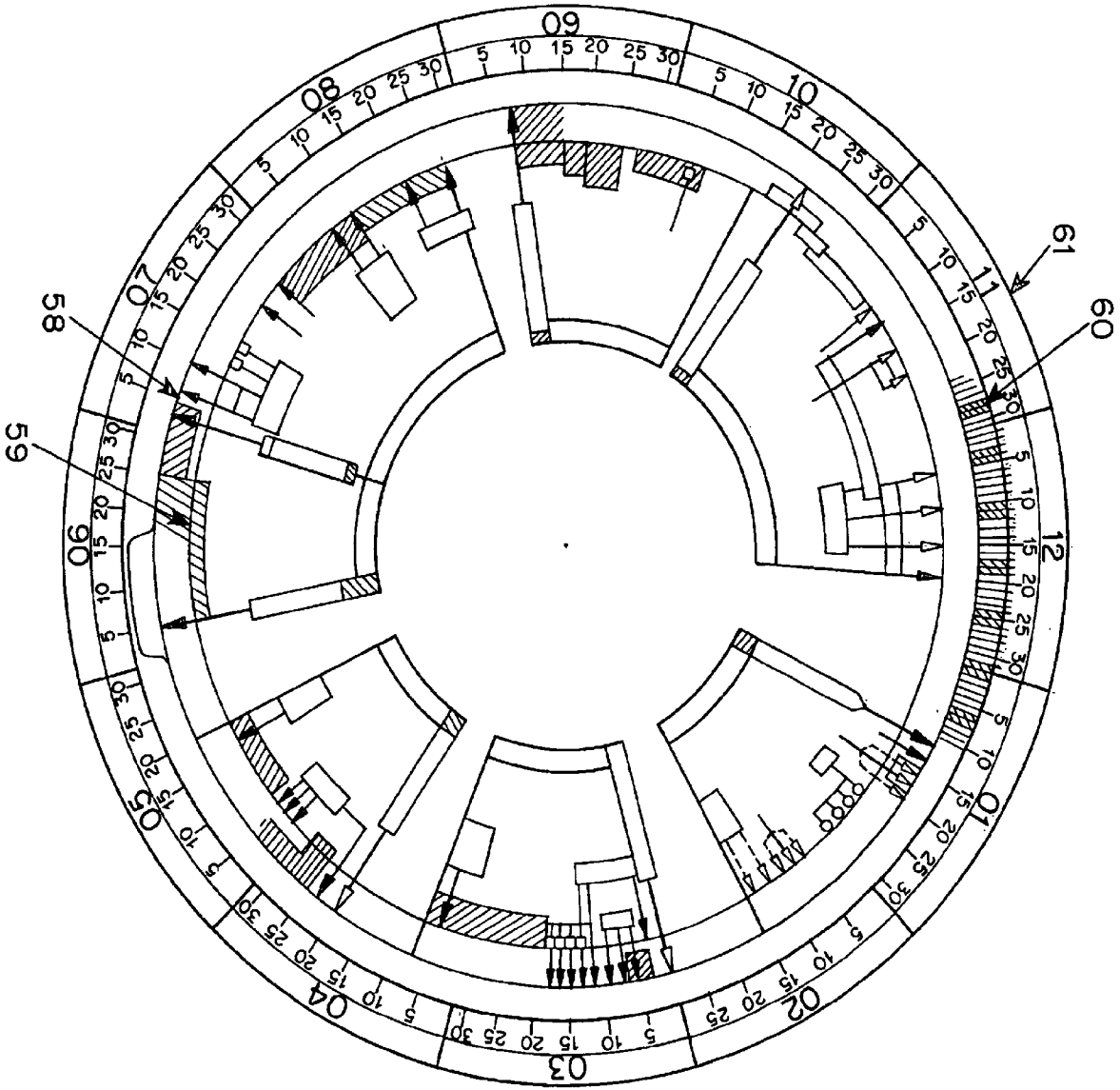
FIG. 33 shows an educational aid calculator with 365 days on one scale.

6. Educational Aid. The diagnostic cycle domains and the menstrual physiology domains will be of particular interest to students of reproductive physiology, health, family planning, sex education, Ob-Gyn, etc. Special elements and domains can be altered or created to demonstrate non-human reproductive cycles (mice, rats, monkeys, horses, etc.) for veterinary students. A version of the calculator containing the usual 153 circumference days, or one containing 365 circumference days constructed with a large diameter, up to several feet, would be easily viewed by a class of students (FIG. 33). It could also be used as a non-portable or less-portable calculator at a central location such as a physician's office or nurses' station.

7. Veterinary Use. The basic design of the Fertility Calculator is not limited to human use. Many other animals have reproductive cycles that vaguely resemble the human menstrual cycle. Elements and domains can be created that are customized to the physiology of the species of interest. Practical applications of the fertility calculator include scheduling tests or reproductive procedures for lab animals (rats, mice, dogs, monkeys, etc.) zoo animals (lions, zebras, panda bears, etc.), and commercial livestock (cattle, sheep, race horses, etc.). The same calendar date bases and weekday discs are used, along with customized cycle day and ovulation day discs containing special elements and domains.

8. Commercial Advertising and Promotional Item. Many fertility tests and treatments use commercially available products. These include commercial LH-surge test kits, commercial labs for β-hCG blood tests, different brands of follicle ultrasound machines, and various commercial lab tests kits for LH, FSH, estrogen, and progesterone hormones. Several pharmaceutical companies manufacture a variety of fertility drugs, often making rival brands in competitive markets. The associated elements printed on the cycle day and ovulation day plates can be labeled with the appropriate commercial product, and the fertility calculation can then be sold or distributed to a target group of consumers (such as Ob-Gyn physicians) as a promotional item. For instance, the drug name "Clomid" would be substituted for the label "clomiphene" on the cycle day plate, or the drug name "Follistim" would be substituted for the label "hFSH." Other examples would include "Profasi hCG", "General Electric Ultrasound", and "Sonora Laboratories LH and FSH tests." Unused or blank space in the center of the Fertility Calculator wheel (near the center pin) or added to the periphery outside the calendar date printing or on the opaque mask, is also available for printing logos, advertisements, or other promotional material.

9. Other Applications. The high resolution, wide spacing of days along the circumference of the calendar date bases provides advantages to other types of data calculations. Alignment discs inside the calendar date base do not necessarily have to be cycle day or ovulation day discs. Instead, numbered days or other domains and elements can be substituted for a large number of applications unrelated to fertility, physiology, or even biology. For instance, a rotating disc containing numbered days labeled with decreasing doses of prednisone can be used to schedule corticosteroid drug tapering in order to prevent adrenal addisonian crisis. Other rotating discs with special domains can be used to display cyclic estrogen and progestin hormone replacement drug days and dosages for menopausal women. Postoperative or injury recovery and exercise schedules displayed on special wheels would be used to physical therapists, etc.

Advantages

A number of advantages are incorporated into the calculator of the invention which distinguish it from similar devices or products. The accuracy, flexibility, and intuitive ease-of-use properties of the calculator results from these advantages, making the invention a significant improvement over similar currently available products. One such advantage is simple, intuitive operation. The calculator is operated simply by rotating one or more independent circular discs into easily marked positions. Once this is done, all event dates are automatically and accurately aligned with their respective calendar date. No keyboard data entry is required, no special test reading skill is needed, and no complicated data window tracking is used.

Another advantage is complete, comprehensive calendar date determination which preserves all month-to-month transitions and includes leap year determinations, will all displayed events accurate to the exact day and date. All calendar month names are clearly used and labeled. The month of February is included in the calculator, and the calculator includes an adjustment for leap years.

The high resolution widely spaced calendar days are the result of the overlapping spiral design of the calendar. Each day occupies 2.35° of arc, allowing easy reading of results and more accurate alignment of all scales. The independently rotating event day scales with their auto-calculating means for aligning with each other are useful tools for accurately sequencing events, but their usefulness can be greatly expanded by the addition of a calendar date scale and weekday scale to display the actual date and day of the week of every event. A 365 circumference day version of the calculator permits accurate alignment of all possible positions of the other rotating scales. However, the narrow spacing of the calendar days (and the associated event day scales) yields difficult to read dates and event markers due to low resolution (each day is less than 1° of arc). This problem was solved by stretching the annual calendar line to over 2½ times its original graphical length, then wrapping the greater portion around the calendar date scale in a spiral fashion, leaving the day markings over 2½ times larger. This results in a high resolution calendar scale, which allows for corresponding expansion of the event day scales, a more accurate and easier to read calculator is created. The only month that does not fit into the high resolution spiral calendar scale is February, so a separate scale with the same resolution size is used for February, its adjoining months added for continuity. The calendar scales have 153 equal day divisions instead of 365.

The accommodation of leap years is a feature derived from the requirement for a separate calendar date scale for the month of February. The rotating calendar scale is circular by definition, so a large amount of additional space remains on the separate 28-day February scale. This additional space along the circumference of the scale will easily accommodate another February month and, with partial overlapping, its adjacent months for leap year continuity. The added February month has 29 days and is used during leap years to maintain high resolution and accuracy of the calculator during any calendar year.

Accurate display of weekdays and weekends is provided by the insertion of an independently rotating weekday scale into the calculator. This scale is labeled with symbols for the days of the week for most of its circumference, and when properly aligned with the other scales, it displays the weekday upon which the calendar dates and events fall. Most events, even if weeks or months in the future, can then easily be scheduled onto specified weekdays or to avoid weekends.

Another advantage of the instant invention is the opaque mask for covering unused portions of the calculator. A circular mask, independently rotating around the center pin, has arc-shaped windows cut out to allow viewing only the active event information. The remaining portions of the circular scales display unneeded information, and to prevent confusion or distraction, are covered by the opaque portions of the mask. A variable range mask allows event information of any arc length to be viewed, adjusting size for different lengths of event groups. The mask can be fixed to the calculator's center pin, or it can be a separate item that can be loosely placed over the calculator when needed.

Figure 35A:
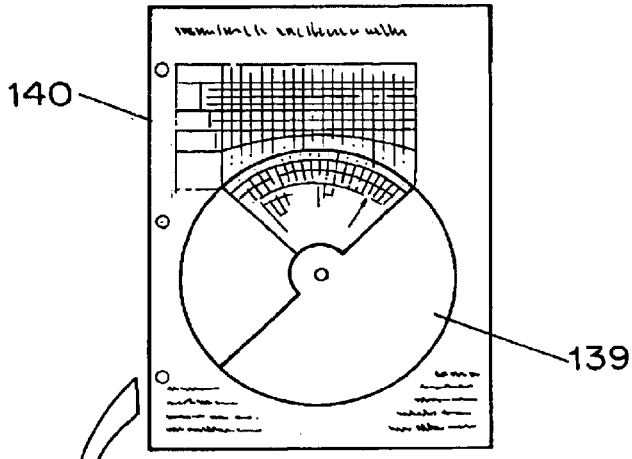
FIGS. 35A–35C illustrate photocopying the disc calendar for a permanent record.
Figure 35B:
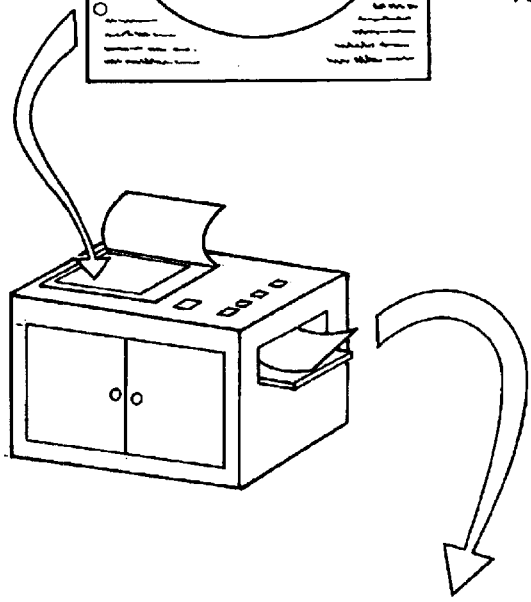
Figure 35C:
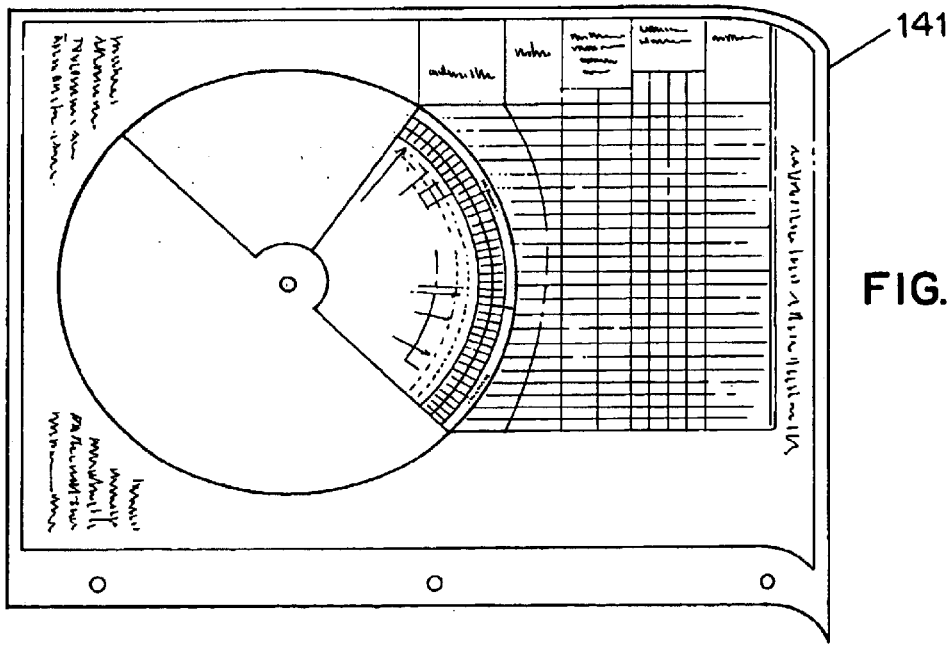

A permanent record of a calculation is obtained by photocopying the calculator. The configuration of the calculator is constantly being changed during use by rotating the various scales relative to each other for each new event calculation or, in the case of medical events, for each new patient. A permanent record 141 of the timed events, including the calendar dates, can be easily made simply by photocopying the flat calculator 139 onto a piece of paper 140 containing the patient's information (FIGS. 35A–35C). In the medical field, this allows individual permanent records to be filed, stored, or placed in medical charts. Use of the opaque mask feature will further facilitate photocopy recording by exposing only the active events on the calculator. If the spiral layer calendar scale is used, it is important to cross off the inappropriate month layers on the photocopied page to avoid confusion. A low profile, flat center pin is preferred for complete contact of the fertility calculator surface with the copy machine glass.

A low resolution 365-day calendar is another embodiment of the calculator, with the entire calendar year wrapped once around the calendar scale. The weekday and event day scales match the same 365 day circumference so that their rotational alignments remain intact. An additional 366-day version, preferably placed on the back side of the 365-day calculator, can be added to allow leap year calculations. This version of the calculator is more difficult to read due to the small arc-size of each day, but this problem can be solved simply by increasing the overall size of the entire calculator. An increase to 2½ times the diameter of the spiral month wrapped calendar scale will yield the same physical size day increments and the same resolution. A calculator this size is less portable, but it can be used as a large display educational device or used in a medical office.

Figure 34A:
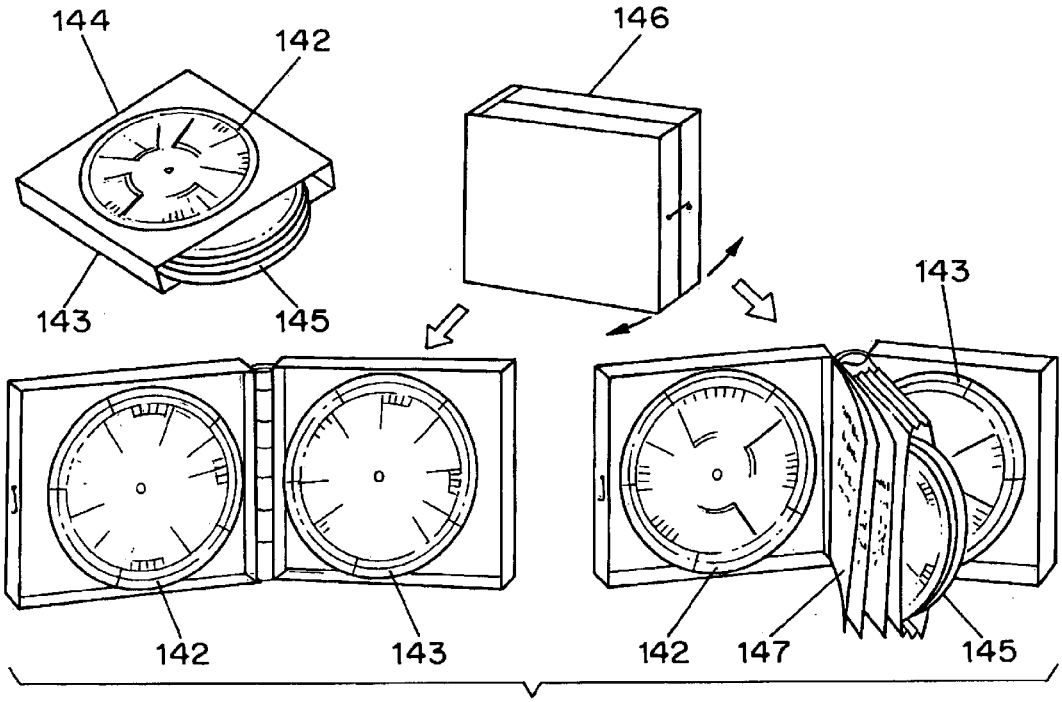
FIG. 34A illustrates a commercial advertising and promotional embodiment of the invention.
Figure 34B:
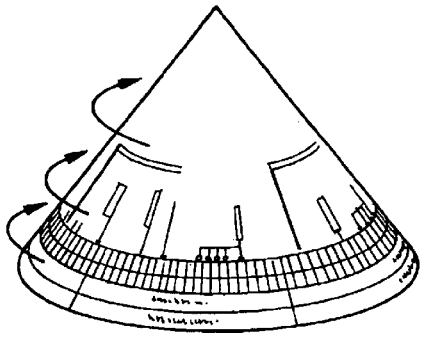
FIG. 34B illustrates a cone-shaped embodiment of the invention.

A further advantage of the invention is its inexpensive construction. The parts of the calculator can easily be mass produced by printing graphic scales onto inexpensive heavy paper, plastic, celluloid, or sheet metal stock, then easily assembled onto a center pin. In one embodiment, the March– January calendar 142 is printed on one side of a box and the February–leap February calendar 143 is printed on the other side of a box 144. Different cycle day and ovulation day discs 145 are contained in the box, and are attached to the calendars printed on the box with a pin or other fastener. A weekday disc may also be included in the box. A further embodiment includes a hinged box 146 with calendars 142, 143 printed on the insides, and a separate holder 147 for cycle day, ovulation and weekday discs 145 (FIG. 34A). Another embodiment of the invention is a cone-shaped calendar (FIG. 34B).

Specific advantages related to use in the field of fertility medicine include having two independently rotating scales, one referencing menstrual cycle day information and the other referencing ovulation related information. This is the greatest advantage to the invention. Nearly all fertility tests and treatments, or menstrual cycle physiologic events, are tied by a specific number of days (length of time) to one of two distinct reference points; the first day of the last menstrual period (LMP) or the day of ovulation. Cycle day tests and events referenced to the LMP can be printed on a scale, with the length of time between each test (or event) from the LMP represented by its proportional distance on the scale. The same can be done for the set of tests and events referenced to the day of ovulation, with the length of time between each test and the ovulation day represented by its proportional distance printed on a separate scale. In general, the LMP referenced set of tests and events is unrelated to the ovulation day referenced set of tests and events in terms of fixed amounts of time because the amount of time between the LMP and the ovulation day varies with each menstrual cycle and between individuals. The two independent scales can be moved relative to each other each menstrual cycle in order to compensate for the variable amount of time between LMP and ovulation day, allowing the relative positions of all the tests and events on both scales to be accurately represented proportional to their proper time and sequence, customized to each cycle.

Another advantage of the fertility calendar is the simple, accurate methods for aligning ovulation with its proper menstrual cycle day. Special automatic calculating symbols for the LH-surge tests and the ultrasound follicle size tests are printed on the cycle day scale and the ovulation day scale. These independently rotating scales can be accurately aligned relative to each other during each menstrual cycle by using ovulation test results. The results of the ovulation prediction tests, either the urine LH test or the ultrasound lead follicle size test, are represented by special symbols printed on the cycle day scale and ovulation day scale. Once the ovulation day scale symbol is properly aligned over the corresponding cycle day scale symbol, the two scales are custom aligned for that particular menstrual cycle, and all of the other tests, treatments, and event markings are automatically positioned in their appropriate relative positions.

The advantage of the transparent ovulation day scale is that it allows marked menstrual cycle events (tests, treatments, physiology phases) on both the cycle day scale and the ovulation day scale to be viewed simultaneously for all possible relative scale positions.

Having interchangeable discs is a feature that greatly expands the range and amount of information that the fertility calculator is capable of processing and displaying. Because the calendar date and weekday scales are unchanging, they are used as fixed, base items. The cycle day and ovulation day scales, however, contain information that varies cycle to cycle. These two independently rotating scales can be removed from the calendar date and weekday scales by lifting them off of the center pin, and then replaced by other cycle day and ovulation day rotating scales that contain different information. Scales that display diagnostic tests can be replaced by scales that display low level fertility drug treatment information. These in turn can be replaced by scales that display in-vitro fertilization and frozen embryo transfer information. The specialized information customized for non-human species, such as reproductive cycle tests for lab animals or livestock, can be interchanged onto the base calendar date and weekday scales for veterinary purposes. This interchangeability feature also allows the addition of new scales in the future containing information for newly developed tests and advancing technology, so that the fertility calculator does not become obsolete.

The advantages of interchangeable discs extends to customizing the calculator for individual users. In particular, the different cycle day and the ovulation day scales allow for customization of the fertility calculator to satisfy the demands and requirements of individual users. Different physicians will use slightly different versions of diagnostic test protocols, low level fertility drug therapy programs, or high tech in-vitro fertilization treatment protocols, and therefore may not be interested in standardized testing and treatment information printed on the cycle day and ovulation day scales. Specific test and treatment protocols customized to a user's requirements can be printed onto new cycle day and ovulation day scales, in any language. Examples of tests and treatments which may be listed on the cycle day and ovulation day scales include LH and FSH blood levels, HSG x-ray, clomiphene and gonadotropin fertility drug scheduling, LH-test or hCG injection times, Post Coital Tests, IntraUterine Inseminations, Clomiphene challenge tests, ultrasound egg captures, laparoscopic G.I.F.T. procedures, embryo transfer times, Mid Luteal Progesterone levels, and endometrial biopsy. The calculator is designed to determine the optimal time and calendar date for all of these procedures, and can be modified to include a large number of other procedures. These customized scales can be easily interchanged onto the fertility calculator for individualized use.

The greatest advantage of the instant invention for fertility calculations lies in its wide application for nearly all fertility tests, treatments, and physiologic phases. The prior art devices merely displayed fertile periods during menstrual cycles whereas the calculator of the instant invention displays the calendar date, weekday, and cycle day of an extensive array of tests and treatments, including HSG x-ray, LH and FSH blood tests, urine LH test timing, hCG injection determination, IntraUterine Inseminations, MidLuteal Progesterone level, endometrial biopsy, and In Vitro Fertilization egg capture and embryo transfer times, among many others. The wide application of numerous tests and treatments extends the possible applications of the calculator beyond that of an infertility scheduler or a conception/contraception family planner. It can also be used as an early pregnancy scheduler, weekday/weekend test timer, educational aid for students, a veterinary calculator modified for various animal reproductive cycles, and an advertising or promotional item for commercial products. Other applications include corticosteroid tapering scheduler, hormone replacement therapy timer, or injury recovery schedule display. Non-medical applications include scheduling events related to banking, law, construction and insurance.

Overall the fertility timing, testing, and treatment calculator of the instant invention satisfies the goal of easily and accurately determining and displaying the calendar date, weekday, and cycle day of nearly all fertility and family planning tests and therapies.

I claim:

1. An apparatus comprising a base, the base comprising a circular display of first markings divided into 153 equiangular parts disposed along substantially the entire periphery of the circular display, the 153 equiangular parts grouped into five segments, the first segment having 31 equiangular parts, the second segment having 30 equiangular parts and being labeled "April" and "September", the third segment having 31 equiangular parts and being labeled "May" and "October", the fourth segment having 30 equiangular parts and being labeled "June" and "November", and the fifth segment having 31 equiangular parts and being labeled "July" and "December", respectively, in clockwise fashion around the circular display.

2. The apparatus of claim 1, wherein the first segment is labeled "March" and "August".

3. The apparatus of claim 1, wherein the first segment is labeled "August" and "January".

4. The apparatus of claim 1, wherein the first segment is labeled "March", "August" and "January".

5. The apparatus of claim 1, wherein the second segment is labeled "February", "September" and "April".

6. The apparatus of claim 1, wherein the base is substantially planar and opaque.

7. The apparatus of claim 1, further comprising one or more discs rotatably joined at a central axis to the circular display portion of the base, wherein the discs have a circular display of markings disposed along at least a section of the periphery thereof, the markings representing activities or events of interest.

8. The apparatus of claim 7, further comprising an additional disc having at least a circular display of markings disposed along at least a portion of the periphery thereof, the markings being divided into equiangular parts labeled with the days of the week.

9. The apparatus of claim 7, wherein the events of interest are related to a series of medical treatments.

10. The apparatus of claim 7, wherein the events of interest are related to banking, law, construction or insurance.

11. The apparatus of claim 1, adapted to determine physiologic phases and optimum time for fertility tests, treatments, and protocols based on menstrual or ovulation physiology, the apparatus further comprising first and second discs adapted to be rotatably joined at a central axis to the circular display on the base, the first disc having at least a circular display of second markings disposed along at least a portion of the periphery thereof, the second markings representing the days of a menstrual cycle, wherein one or more cycles are represented, the cycles having the same or different lengths; the second disc having at least a circular display of third markings disposed along at least a portion of the periphery thereof, the third markings representing events of interest relating to one or more menstrual cycles; wherein in use, the first disc is aligned with the base such that the days of a menstrual cycle are aligned with the appropriate calendar day on the base and the second disc is aligned with the first disc such that events of interest relating to one or more menstrual cycles are aligned with the appropriate cycle day.

12. The apparatus of claim 11, further comprising a third disc having at least a circular display of fourth markings disposed along at least a portion of the periphery thereof, the fourth markings being divided into equiangular parts labeled with the days of the week.

13. The apparatus of claim 12, further comprising a reversible locking means for securing the first, second and third discs to the base, the locking means preventing the discs from rotating once they are aligned.

14. The apparatus of claim 11, wherein the first disc further comprises fifth markings disposed in a circular display, the fifth markings representing initial steps in one or more physiologic phase or fertility test, treatment or protocol, the physiologic phase or fertility test, treatment or protocol having initial and final steps.

15. The apparatus of claim 14, wherein the second disc further comprises sixth markings disposed in a circular display, the sixth markings representing the final steps in the physiologic phase, test, treatment or protocol from the first disc.

16. The apparatus of claim 15, wherein the initial and final steps of a single phase, test, treatment or protocol on the first and second discs are the same color, and each phase, test, treatment and protocol is a different color.

17. The apparatus of claim 14, wherein the first and second discs comprise a matched set, and are exchangeable with other disc sets containing steps for different fertility tests, treatments, protocols and physiologic phases.

18. The apparatus of claim 11, further comprising a mask which covers the unused portions of the calculator once a calculation is made, the mask comprising an opaque disc with a section cut out, the mask being the same size as the circular display on the base, and adapted to be rotatably set in coaxial relation with the base and first and second discs.

19. The apparatus of claim 18, wherein the mask comprises two sections which overlap to create an opening of variable size.

20. The apparatus of claim 11, further comprising an indicator arm for indicating the possibility of pregnancy, the indicator arm comprising a transparent arm extending from the center of the calculator to at least the outer edge of the second disc, the arm adapted to be rotatably set in coaxial relation therewith, the arm having a first marker representing intercourse, and a second marker representing the chance of sperm, wherein the second marker extends from the first marker out to a distance of up to six units, representing up to six days, including the day indicated by the first marker; wherein in use the start of the last menstrual period on the first disc is aligned with the appropriate calendar day on the base, and the indicator arm is positioned such that the first marker is aligned with the day of the month of intercourse, and the possibility of pregnancy is determined by the overlap of the second marker with a chance of egg marker on the first disc, wherein overlap indicates a possibility of pregnancy.

21. The apparatus of claim 11, wherein the fertility tests, treatments, protocols and physiologic phases are selected from the group consisting of last menstrual period, current menstrual period, next menstrual period, follicular phase, luteal phase, estrogen levels, progesterone levels, lutenizing hormone blood levels, follicular stimulating hormone blood levels, lutenizing hormone surge, follicular recruitment, follicular dominance, follicle growth, ovulation, luteogenesis, luteolysis, fertilization of oocyte, non-fertile times, fertile times, maybe fertile times, embryo development, zygote, morula, blastocyst, hatching, implantation, embryo, fetus, blood pregnancy test, urine pregnancy test, early pregnancy ultrasound, embryonic plate, fetal heart motion, limb budding, timed intercourse, start basal body temperature chart, basal body temperature shift, cervical mucus, probable ovulation, average cycle length, no intercourse, start urine lutenizing hormone tests, urine lutenizing hormone positive test, lutenizing hormone and follicular stimulating hormone tests, post coital test, semen analysis, mid-luteal progesterone level, hysterosalpingogram x-ray, endometrial biopsy, Clomiphene, ovarian follicle ultrasound, intra-uterine insemination, intra-cervical insemination, start progesterone suppositories, expected next menstrual period, gestational ultrasound, human chorionic gonadotropin trigger injection, Clomid check exam, ultrasound, ultrasound scale, dexamethasone, hMG injection, Lupron, human follicular stimulating hormone injection, obstetrics visit, step-up human follicular stimulating hormone, estrogen tests, drift days, prior cycle BCPs, prior cycle Lupron, egg capture, in vitro fertilization, embryo transfer, frozen embryo transfer, progesterone injections, estrogen tests with ultrasound, low-dose Lupron, high-dose human follicular stimulating hormone injection, G.I.F.T. laparoscopy, estrogen pill/patch, and thaw embryos.

22. The apparatus of claim 11, wherein the menstrual cycle represented is that of a human.

23. The apparatus of claim 11, wherein the menstrual cycle represented is that of a non-human animal.

24. The apparatus of claim 23, wherein the non-human animal is selected from the group consisting of cattle, horses, pigs, sheep, dogs, rats, mice and monkeys.

25. The apparatus of claim 23, wherein the non-human animal is a zoo animal.

26. The apparatus of claim 11, wherein the base and first disc are opaque and the second disc is substantially transparent.

27. The apparatus of claim 26, adapted to determine physiologic phases and optimum time for fertility tests, treatments and protocols based on menstrual or ovulation physiology, the apparatus further comprising first and second discs adapted to be rotatably joined at a central axis to the circular display on the base, the first disc having at least a circular display of second markings disposed along at least a portion of the periphery thereof, the second markings representing the days of a menstrual cycle, wherein one or more cycles are represented, the cycles having the same or different lengths; the second disc having at least a circular display of third markings disposed along at least a portion of the periphery thereof, the third markings representing events of interest relating to one or more menstrual cycles.

28. The apparatus of claim 27, further comprising a third disc having at least a circular display of fourth markings disposed along at least a portion of the periphery thereof, the fourth markings being divided into equiangular parts labeled with the days of the week.

29. The apparatus of claim 28, further comprising a reversible locking means for securing the first, second and third discs to the base, the locking means preventing the discs from rotating once they are aligned.

30. The apparatus of claim 27, wherein the first disc further comprises fifth markings disposed in a circular display, the fifth markings representing initial steps in one or more physiologic phase or fertility test, treatment or protocol, the physiologic phase or fertility test, treatment or protocol having initial and final steps.

31. The apparatus of claim 27, wherein the second disc further comprises sixth markings disposed in a circular display, the sixth markings representing the final steps in the physiologic phase, test, treatment or protocol from the first disc.

32. The apparatus of claim 31, wherein the initial and final steps of a single phase, test, treatment or protocol on the first and second discs are the same color, and each phase, test, treatment and protocol is a different color.

33. The apparatus of claim 31, wherein the first and second discs comprise a matched set, and are exchangeable with other disc sets containing steps for different fertility tests, treatments, protocols and physiologic phases.

34. The apparatus of claim 27, further comprising a mask which covers the unused portions of the calculator once a calculation is made, the mask comprising an opaque disc with a section cut out, the mask being the same size as the circular display on the base, and adapted to be rotatably set in coaxial relation with the base and first and second discs.

35. The apparatus of claim 34, wherein the mask comprises two sections which overlap to create an opening of variable size.

36. The apparatus of claim 27, further comprising an indicator arm for indicating the possibility of pregnancy, the indicator arm comprising a transparent arm extending from the center of the calculator to at least the outer edge of the second disc, the arm adapted to be rotatably set in coaxial relation therewith, the arm having a first marker representing intercourse, and a second marker representing the chance of sperm, wherein the second marker extends from the first marker out to a distance of up to six units, representing up to six days, including the day indicated by the first marker; wherein in use the start of the last menstrual period on the first disc is aligned with the appropriate calendar day on the base, and the indicator arm is positioned such that the first marker is aligned with the day of the month of intercourse, and the possibility of pregnancy is determined by the overlap of the second marker with a chance of egg marker on the first disc, wherein overlap indicates a possibility of pregnancy.

37. The apparatus of claim 27, wherein the fertility tests, treatments, protocols and physiologic phases are selected from the group consisting of last menstrual period, current menstrual period, next menstrual period, follicular phase, luteal phase, estrogen levels, progesterone levels, lutenizing hormone blood levels, follicular stimulating hormone blood levels, lutenizing hormone surge, follicular recruitment, follicular dominance, follicle growth, ovulation, luteogenesis, luteolysis, fertilization of oocyte, non-fertile times, fertile times, maybe fertile times, embryo development, zygote, morula, blastocyst, hatching, implantation, embryo, fetus, blood pregnancy test, urine pregnancy test, early pregnancy ultrasound, embryonic plate, fetal heart motion, limb budding, timed intercourse, start basal body temperature chart, basal body temperature shift, cervical mucus, probable ovulation, average cycle length, no intercourse, start urine lutenizing hormone tests, urine lutenizing hormone positive test, lutenizing hormone and follicular stimulating hormone tests, post coital test, semen analysis, mid-luteal progesterone level, hysterosalpingogram x-ray, endometrial biopsy, Clomiphene, ovarian follicle ultrasound, intra-uterine insemination, intra-cervical insemination, start progesterone suppositories, expected next menstrual period, gestational ultrasound, human chorionic gonadotropin trigger injection, Clomid check exam, ultrasound, ultrasound scale, dexamethasone, hMG injection, Lupron, human follicular stimulating hormone injection, obstetrics visit, step-up human follicular stimulating hormone, estrogen tests, drift days, prior cycle BCPs, prior cycle Lupron, egg capture, in vitro fertilization, embryo transfer, frozen embryo transfer, progesterone injections, estrogen tests with ultrasound, low-dose Lupron, high-dose human follicular stimulating hormone injection, G.I.F.T. laparoscopy, estrogen pill/patch, and thaw embryos.

38. The apparatus of claim 27, wherein the menstrual cycle represented is that of a human.

39. The apparatus of claim 27, wherein the menstrual cycle represented is that of a non-human animal.

40. The apparatus of claim 39, wherein the non-human animal is selected from the group consisting of cattle, horses, pigs, sheep, dogs, rats, mice and monkeys.

41. The apparatus of claim 39, wherein the non-human animal is a zoo animal.

42. An apparatus comprising a base, the base comprising a circular display of first markings divided into at least 150 equiangular parts disposed along substantially the entire periphery of the circular display, the at least 150 equiangular parts grouped into at least five segments, the first segment having 31 equiangular parts and being labeled "January", the second segment having 28 equiangular parts and being labeled "February", the third segment having 31 equiangular parts and being labeled "March" and "Leap January", the fourth segment having 29 equiangular parts and being labeled "Leap February", and the fifth segment having 31 equiangular parts and being labeled "Leap March", or the first segment having 31 equiangular parts and being labeled "Leap January", the second segment having 29 equiangular parts and being labeled "Leap February", the third segment having 31 equiangular parts and being labeled "Leap March" and "January", the fourth segment having 28 equiangular parts and being labeled "February", and the fifth segment having 31 equiangular parts and being labeled "March", respectively, in clockwise fashion around the circle.

43. The apparatus of claim 42, wherein the circular display of markings is divided into 153 equiangular parts grouped into six segments, wherein a sixth segment comprising three equiangular parts is located between the first and fifth segment.

44. The apparatus of claim 42, wherein the base is substantially planar and opaque.

45. The apparatus of claim 42, further comprising one or more discs rotatably joined at a central axis to the circular display portion of the base, wherein the discs have a circular display of markings disposed along at least a section of the periphery thereof, the markings representing activities or events of interest.

46. The apparatus of claim 45, further comprising an additional disc having at least a circular display of markings disposed along at least a portion of the periphery thereof, the markings being divided into equiangular parts labeled with the days of the week.

47. The apparatus of claim 45, wherein the events of interest are related to a series of medical treatments.

48. The apparatus of claim 45, wherein the events of interest are related to banking, law, construction or insurance.

49. The apparatus of claim 48, wherein the base and first disc are opaque and the second disc is substantially transparent.

50. An apparatus comprising a base, the base comprising at least first and second circular displays of first and second markings, respectively, wherein the first and second circular displays are located either on opposite sides of the base, or next to each other on the same side of the base; the first circular display of first markings divided into 153 equiangular parts disposed along substantially the entire periphery of the circular display, the 153 equiangular parts grouped into five segments, the first segment having 31 equiangular parts, the second segment having 30 equiangular parts and being labeled "April" and "September", the third segment having 31 equiangular parts and being labeled "May" and "October", the fourth segment having 30 equiangular parts and being labeled "June" and "November", and the fifth segment having 31 equiangular parts and being labeled "July" and "December", respectively, in clockwise fashion around the circle; and the second circular display of second markings divided into at least 150 equiangular parts disposed along substantially the entire periphery of the circular display, the at least 150 equiangular parts grouped into at least five segments, the first segment having 31 equiangular parts and being labeled "January", the second segment having 28 equiangular parts and being labeled "February", the third segment having 31 equiangular parts and being labeled "March" and "Leap January", the fourth segment having 29 equiangular parts and being labeled "Leap February", and the fifth segment having 31 equiangular parts and being labeled "Leap March", or the first segment having 31 equiangular parts and being labeled "Leap January", the second segment having 29 equiangular parts and being labeled "Leap February", the third segment having 31 equiangular parts and being labeled "Leap March" and "January", the fourth segment having 28 equiangular parts and being labeled "February", and the fifth segment having 31 equiangular parts and being labeled "March", respectively, in clockwise fashion around the circle.

51. The apparatus of claim 50, wherein the base comprises first and second sides, wherein the first circular display is located on the first side of the base and the second circular display is located on the second side of the base.

52. The apparatus of claim 50, wherein the second circular display of markings is divided into 153 equiangular parts grouped into six segments, wherein a sixth segment comprising three equiangular parts is located between the first and fifth segment.

53. The apparatus of claim 50, wherein the first segment is labeled "March" and "August".

54. The apparatus of claim 50, wherein the first segment is labeled "August" and "January".

55. The apparatus of claim 50, wherein the first segment is labeled "March", "August" and "January".

56. The apparatus of claim 50, wherein the first segment is labeled "February", "September", and "April."

57. The apparatus of claim 50, wherein the base is substantially planar and opaque.

58. The apparatus of claim 50, further comprising one or more discs rotatably joined at a central axis to a circular display portion of the base, wherein the discs have a circular display of markings disposed along at least a section of the periphery thereof, the markings representing activities or events of interest.

59. The apparatus of claim 58, wherein first and second discs are attached to both the first and the second circular display portions of the base.

60. The apparatus of claim 58, further comprising an additional disc having at least a circular display of markings disposed along at least a portion of the periphery thereof, the markings being divided into equiangular parts labeled with the days of the week.

61. The apparatus of claim 58, wherein the events of interest are related to a series of medical treatments.

62. The apparatus of claim 58, wherein the events of interest are related to banking, law, construction or insurance.

63. The apparatus of claim 50, adapted to determine physiologic phases and optimum time for fertility tests, treatments and protocols based on menstrual or ovulation physiology, the apparatus further comprising first and second discs adapted to be rotatably joined at a central axis to the circular display on the base, the first disc having at least a circular display of second markings disposed along at least a portion of the periphery thereof, the second markings representing the days of a menstrual cycle, wherein one or more cycles are represented, the cycles having the same or different lengths; the second disc having at least a circular display of third markings disposed along at least a portion of the periphery thereof, the third markings representing events of interest relating to one or more menstrual cycles.

64. The apparatus of claim 63, further comprising a third disc having at least a circular display of fourth markings disposed along at least a portion of the periphery thereof, the fourth markings being divided into equiangular parts labeled with the days of the week.

65. The apparatus of claim 64, further comprising a reversible locking means for securing the first, second and third discs to the base, the locking means preventing the discs from rotating once they are aligned.

66. The apparatus of claim 63, wherein the first disc further comprises fifth markings disposed in a circular display, the fifth markings representing initial steps in one or more physiologic phase or fertility test, treatment or protocol, the physiologic phase or fertility test, treatment or protocol having initial and final steps.

67. The apparatus of claim 66, wherein the second disc further comprises sixth markings disposed in a circular display, the sixth markings representing the final steps in the physiologic phase, test, treatment or protocol from the first disc.

68. The apparatus of claim 67, wherein the initial and final steps of a single phase, test, treatment or protocol on the first and second discs are the same color, and each phase, test, treatment and protocol is a different color.

69. The apparatus of claim 66, wherein the first and second discs comprise a matched set, and are exchangeable with other disc sets containing steps for different fertility tests, treatments, protocols and physiologic phases.

70. The apparatus of claim 63, further comprising a mask which covers the unused portions of the calculator once a calculation is made, the mask comprising an opaque disc with a section cut out, the mask being the same size as the circular display on the base, and adapted to be rotatably set in coaxial relation with the base and first and second discs.

71. The apparatus of claim 70, wherein the mask comprises two sections which overlap to create an opening of variable size.

72. The apparatus of claim 63, further comprising an indicator arm for indicating the possibility of pregnancy, the indicator arm comprising a transparent arm extending from the center of the calculator to at last the outer edge of the second disc, the arm adapted to be rotatably set in coaxial relation therewith, the arm having a first marker representing intercourse, and a second marker representing the chance of sperm, wherein the second marker extends from the first marker out to a distance of up to six units, representing up to six days, including the day indicated by the first marker; wherein in use the start of the last menstrual period on the first disc is aligned with the appropriate calendar day on the base, and the indicator arm is positioned such that the first marker is aligned with the day of the month of intercourse, and the possibility of pregnancy is determined by the overlap of the second marker with a chance of egg marker on the first disc, wherein overlap indicates a possibility of pregnancy.

73. The apparatus of claim 63, wherein the fertility tests, treatments, protocols and physiologic phases are selected from the group consisting of last menstrual period, current menstrual period, next menstrual period, follicular phase, luteal phase, estrogen levels, progesterone levels, lutenizing hormone blood levels, follicular stimulating hormone blood levels, lutenizing hormone surge, follicular recruitment, follicular dominance, follicle growth, ovulation, luteogenesis, luteolysis, fertilization of oocyte, non-fertile times, fertile times, maybe fertile times, embryo development, zygote, morula, blastocyst, hatching, implantation, embryo, fetus, blood pregnancy test, urine pregnancy test, early pregnancy ultrasound, embryonic plate, fetal heart motion, limb budding, timed intercourse, start basal body temperature chart, basal body temperature shift, cervical mucus, probable ovulation, average cycle length, no intercourse, start urine lutenizing hormone tests, urine lutenizing hormone positive test, lutenizing hormone and follicular stimulating hormone tests, post coital test, semen analysis, mid-luteal progesterone level, hysterosalpingogram x-ray, endometrial biopsy, Clomiphene, ovarian follicle ultrasound, intra-uterine insemination, intra-cervical insemination, start progesterone suppositories, expected next menstrual period, gestational ultrasound, human chorionic gonadotropin trigger injection, Clomid check exam, ultrasound, ultrasound scale, dexamethasone, hMG injection, Lupron, human follicular stimulating hormone injection, obstetrics visit, step-up human follicular stimulating hormone, estrogen tests, drift days, prior cycle BCPs, prior cycle Lupron, egg capture, in vitro fertilization, embryo transfer, frozen embryo transfer, progesterone injections, estrogen tests with ultrasound, low-dose Lupron, high-dose human follicular stimulating hormone injection, G.I.F.T. laparoscopy, estrogen pill/patch, and thaw embryos.

74. The apparatus of claim 63, wherein the menstrual cycle represented is that of a human.

75. The apparatus of claim 63, wherein the menstrual cycle represented is that of a non-human animal.

76. The apparatus of claim 75, wherein the non-human animal is selected from the group consisting of cattle, horses, pigs, sheep, dogs, rats, mice and monkeys.

77. The apparatus of claim 75, wherein the non-human animal is a zoo animal.

78. The apparatus of claim 63, wherein the base and first disc are opaque and the second disc is substantially transparent.

79. An apparatus for displaying information relating to fertility comprising a base and first and second discs, said base and first and second discs rotatably joined at a central axis; the base having at least a circular display of first markings disposed along at least a section of the periphery of the circular display, the first markings divided into equiangular parts, the equiangular parts labeled with calendar days; the first disc having at least a circular display of second markings disposed along at least a portion of the periphery thereof, the second markings representing the days of a menstrual cycle, wherein one or more cycles are represented, the cycles having the same or different lengths; the second disc having at least a circular display of third markings disposed along at least a portion of the periphery thereof, the third markings representing events of interest relating to one or more menstrual cycles, wherein the first disc further comprises fourth markings disposed in a circular display, the fourth markings representing initial steps in one or more physiologic phase or fertility test, treatment or protocol, the physiologic phase or fertility test, treatment or protocol having initial and final steps.

80. The apparatus of claim 79 wherein the second disc further comprises fifth markings disposed in a circular display, the fifth markings representing the final steps in the physiologic phase, test, treatment or protocol from the first disc.

81. The apparatus of claim 80 wherein the fourth markings represent days for performing the lutenizing hormone test, and the fifth markings represent the lutenizing hormone surge and subsequent tests, treatments and protocols.

82. The apparatus of claim 80 wherein the fourth markings represent the day or days for performing follicular ultrasound, and the fifth markings represent various follicle diameters and subsequent tests, treatments and protocols.

83. The apparatus of claim 80 wherein the initial and final steps of a single phase, test, treatment or protocol on the first and second discs are the same color, and each phase, test, treatment and protocol is a different color.

84. The apparatus of claim 80, further comprising an indicator arm for indicating the possibility of pregnancy, the indicator arm comprising a transparent arm extending from the center of the calculator to at least the outer edge of the second disc, the arm adapted to be rotatably set in coaxial relation therewith, the arm having a first marker representing intercourse, and a second marker representing the chance of sperm, wherein the second marker extends from the first marker out to a distance of up to six units, representing up to six days, including the day indicated by the first marker; wherein in use the start of the last menstrual period on the first disc is aligned with the appropriate calendar day on the base, and the indicator arm is positioned such that the first marker is aligned with the day of the month of intercourse, and the possibility of pregnancy is determined by the overlap of the second marker with a chance of egg marker on the first disc, wherein overlap indicates a possibility of pregnancy.

85. The apparatus of claim 80, wherein the first and second discs comprise a matched set, and are exchangeable with other disc sets containing steps for different fertility tests, treatments, protocols and physiological phases.

86. The apparatus of claim 80, wherein the menstrual cycle represented is that of a human.

87. The apparatus of claim 80, wherein the menstrual cycle represented is that of a non-human animal.

88. The apparatus of claim 87, wherein the non-human animal is selected from the group consisting of cattle, horses, pigs, sheep, dogs, rats, mice and monkeys.

89. The apparatus of claim 87, wherein the non-human animal is a zoo animal.

90. An apparatus for displaying information relating to fertility comprising a base and first and second discs, said base and first and second discs rotatably joined at a central axis; the base having at least a circular display of first markings disposed along at least a section of the periphery of the circular display, the first markings divided into equiangular parts, the equiangular parts labeled with calendar days; the first disc having at least a circular display of second markings disposed along at least a portion of the periphery thereof, the second markings representing the days of a menstrual cycle, wherein one or more cycles are represented, the cycles having the same or different lengths; the second disc having at least a circular display of third markings disposed along at least a portion of the periphery thereof, the third markings representing events of interest relating to one or more menstrual cycles, further comprising a third disc having at least a circular display of markings disposed along at least a portion of the periphery thereof, the markings being divided into equiangular parts labeled with the days of the week, further comprising a reversible locking means for securing the first, second and third discs to the base, the locking means preventing the discs from rotating once they are aligned.

91. An apparatus for displaying information relating to fertility comprising a base and first and second discs, said base and first and second discs rotatably joined at a central axis; the base having at least a circular display of first markings disposed along at least a section of the periphery of the circular display, the first markings divided into equiangular parts, the equiangular parts labeled with calendar days; the first disc having at least a circular display of second markings disposed along at least a portion of the periphery thereof, the second markings representing the days of a menstrual cycle, wherein one or more cycles are represented, the cycles having the same or different lengths; the second disc having at least a circular display of third markings disposed along at least a portion of the periphery thereof, the third markings representing events of interest relating to one or more menstrual cycles, wherein the first markings are disposed along the entire periphery of the circular display, the first markings divided into 365 equiangular parts, the equiangular parts labeled with days of the full calendar year, further comprising a second circular display of sixth markings disposed along the entire periphery of the circular display, the sixth markings divided into 366 equiangular parts, the equiangular parts labeled with days of the leap year.

92. The apparatus of claim 91, wherein the base comprises first and second sides, wherein the first circular display is located on the first side of the base and the second circular display is located on the second side of the base.

93. An apparatus for displaying information relating to fertility comprising a base and first and second discs, said base and first and second discs rotatably joined at a central axis; the base having at least a circular display of first markings disposed along at least a section of the periphery of the circular display, the first markings divided into equiangular parts, the equiangular parts labeled with calendar days; the first disc having at least a circular display of second markings disposed along at least a portion of the periphery thereof, the second markings representing the days of a menstrual cycle, wherein one or more cycles are represented, the cycles having the same or different lengths; the second disc having at least a circular display of third markings disposed along at least a portion of the periphery thereof, the third markings representing events of interest relating to one or more menstrual cycles, further comprising a third disc having at least a circular display of markings disposed along at least a portion of the periphery thereof, the markings being divided into equiangular parts labeled with the days of the week, further comprising a mask which covers the unused portions of the calculator once a calculation is made, the mask comprising an opaque disc with a section cut out, the mask being the same size as the circular display on the base, and adapted to be rotatably set in coaxial relation with the base and first and second discs.

94. The apparatus of claim 93, wherein the mask comprises two sections with overlap to create an opening of variable size.

95. An apparatus for displaying information relating to fertility comprising a base and first and second discs, said base and first and second discs rotatably joined at a central axis; the base having at least a circular display of first markings disposed along at least a section of the periphery of the circular display, the first markings divided into equiangular parts, the equiangular parts labeled with calendar days; the first disc having at least a circular display of second markings disposed along at least a portion of the periphery thereof, the second markings representing the days of a menstrual cycle, wherein one or more cycles are represented, the cycles having the same or different lengths; the second disc having at least a circular display of third markings disposed along at least a portion of the periphery thereof, the third markings representing events of interest relating to one or more menstrual cycles, wherein the fertility tests, treatments, protocols and physiologic phases are selected from the group consisting of last menstrual period, current menstrual period, next menstrual period, follicular phase, luteal phase, estrogen levels, progesterone levels, lutenizing hormone blood levels, follicular stimulating hormone blood levels, lutenizing hormone surge, follicular recruitment, follicular dominance, follicle growth, ovulation, luteogenesis, luteolysis, fertilization of oocyte, non-fertile times, fertile times, maybe fertile times, embryo development, zygote, morula, blastocyst, hatching, implantation, embryo, fetus, blood pregnancy test, urine pregnancy test, early pregnancy ultrasound, embryonic plate, fetal heart motion, limb budding, timed intercourse, start basal body temperature chart, basal body temperature shift, cervical mucus, probable ovulation, average cycle length, no intercourse, start urine lutenizing hormone tests, urine lutenizing hormone positive test, lutenizing hormone and follicular stimulating hormone tests, post coital test, semen analysis, mid-luteal progesterone level, hysterosalpingogram x-ray, endometrial biopsy, Clomiphene, ovarian follicle ultrasound, intra-uterine insemination, intra-cervical insemination, start progesterone suppositories, expected next menstrual period, gestational ultrasound, human chorionic gonadotropin trigger injection, Clomid check exam, ultrasound, ultrasound scale, dexamethasone, hMG injection, Lupron, human follicular stimulating hormone injection, obstetrics visit, step-up human follicular stimulating hormone, estrogen tests, drift days, prior cycle BCPs, prior cycle Lupron, egg capture, in vitro fertilization, embryo transfer, frozen embryo transfer, progesterone injections, estrogen tests with ultrasound, low-dose Lupron, high-dose human follicular stimulating hormone injection, G.I.F.T. laparoscopy, estrogen pill/patch, and thaw embryos.

96. An apparatus adapted to determine optimum time for achieving or avoiding pregnancy based on menstrual or ovulation physiology and a calendar of moon phases, wherein the calculator contains only non-letter, non-number symbols, the calculator comprising a base comprising a circular display divided into equiangular parts, each equiangular part representing a day in each moon phase of a full year, the display divided into one or more groups of 29 equiangular parts representing the 29 days of a moon phase; a first disc having the circumference thereof divided into equiangular parts, wherein a symbol representing a significant day which occurs at regular intervals during the moon phase is located in the units at the regular intervals, the first disc being smaller than the circular display on the base, and adapted to be rotatably set in coaxial relation therewith so that the outside edge of the first disc lies inside the units on the base, and such that the symbols representing the significant days are aligned with the appropriate moon phase on the base; a second disc divided into equiangular parts with an annular display of first indicia disposed along substantially the entire periphery thereof, the first indicia representing the days of a menstrual cycle; wherein one or more cycles are represented, the cycles having the same or different lengths, the second disc being smaller than the first disc and adapted to be rotatably set in coaxial relation therewith so that the outside edge of the second disc lies inside the symbols on the first disc; a third disc divided into equiangular parts with an annular display of second and third indicia disposed along substantially the entire periphery thereof, the second indicia representing the days of a menstrual cycle and the third indicia representing a fertile period, the third disc being smaller than the first disc, and adapted to be rotatably set in coaxial relation with the base, first and second discs so that the outside edge of the third disc lies inside the symbols on the first disc; wherein in use the symbol representing a significant day on the first disc is aligned with the appropriate moon phase on the base, and the first disc is affixed to the base, the last menstrual cycle on the second disc is then aligned with the corresponding day on the first disc and base, according to the significant days; the next menstrual cycle on the third disc is then aligned with the corresponding day on the first disc, according to the significant days, causing the third indicia representing a fertile period on the third disc to be aligned with their corresponding day read from the base and first disc.

97. The apparatus of claim 96, further comprising a mask which covers the unused portions of the calculator once a calculation is made, the mask comprising an opaque disc with a section cut out, the mask being the same size as the circular display on the base, and adapted to be rotatably set in coaxial relation with the base and first and second discs.

98. The apparatus of claim 97, wherein the mask comprises two sections which overlap to create an opening of variable size.

99. The apparatus of claim 96, wherein the significant days are religious and are represented by religious symbols.

100. The apparatus of claim 96, wherein the first and second indicia are wedge-shaped symbols with a large end on the first day of the menstrual period, and a tapered end on the last day of the menstrual period.

101. The apparatus of claim 100, wherein the wedge-shaped symbols are colored red.

102. The apparatus of claim 96, wherein the third indicia are baby-shaped symbols, and range from faintly printed through darkly printed and back to faintly printed according to the chance of conception, wherein the darker the symbol the greater chance of conception.

103. The apparatus of claim 96, wherein the base further comprises symbols representing specific times of the year.

104. The apparatus of claim 103, wherein the specific times of the year include planting, harvesting, seasons and religious or tribal ceremonies.

105. The apparatus of claim 96, wherein the base and first and second discs are opaque and the third disc is substantially transparent.

106. The apparatus of claim 96, further comprising a reversible locking means for securing the first, second and third discs to the base, the locking means preventing the discs from rotating once they are aligned.

107. A method for calculating dates and displaying information relating to fertility using a calculator, the calculator comprising a base and first and second discs, said base and first and second discs rotatably joined at a central axis; the base having at least a circular display of first markings disposed along at least a section of the periphery of the circular display, the first markings divided into equiangular parts, the equiangular parts labeled with calendar days; the first disc having at least a circular display of at least second markings disposed along at least a portion of the periphery thereof, the second markings representing the days of a menstrual cycle, wherein one or more cycles are represented, the cycles having the same or different lengths; the second disc having at least a circular display of at least third markings disposed along at least a portion of the periphery thereof, the third markings representing events of interest relating to one or more menstrual cycles; the method comprising rotating the first disc such that the second markings representing the days of a menstrual cycle are aligned with the appropriate calendar day on the base; rotating the second disc such that at least one of the third markings are aligned with the appropriate menstrual cycle day; and reading the calendar days associated with additional events of interest, wherein the events of interest are events relating to the lutenizing hormone (LH) surge, wherein the first disc addition has fourth markings representing menstrual cycle days for performing the lutenizing hormone test, the third markings on the second disc representing lutenizing hormone surge and subsequent tests, treatments and protocols; the method comprising rotating the first disc such that the second markings representing the days of a menstrual cycle are aligned with the appropriate calendar day on the base, rotating the second disc such that the marking representing the lutenizing hormone surge is aligned with the appropriate lutenizing hormone test day, and reading the calendar days associated with the subsequent tests, treatments and protocols.

108. A method for calculating dates and displaying information relating to fertility using a calculator, the calculator comprising a base and first and second discs, said base and first and second discs rotatably joined at a central axis; the base having at least a circular display of first markings disposed along at least a section of the periphery of the circular display, the first markings divided into equiangular parts, the equiangular parts labeled with calendar days; the first disc having at least a circular display of at least second markings disposed along at least a portion of the periphery thereof, the second markings representing the days of a menstrual cycle, wherein one or more cycles are represented, the cycles having the same or different lengths; the second disc having at least a circular display of at least third markings disposed along at least a portion of the periphery thereof, the third markings representing events of interest relating to one or more menstrual cycles; the method comprising rotating the first disc such that the second markings representing the days of a menstrual cycle are aligned with the appropriate calendar day on the base; rotating the second disc such that at least one of the third markings are aligned with the appropriate menstrual cycle day; and reading the calendar days associated with additional events of interest, wherein the events of interest are based on follicle size, wherein the first disc addition has fourth markings representing menstrual cycle days for performing follicular ultrasound, the third markings on the second disc representing various follicle sizes and subsequent tests, treatments and protocols; the method comprising rotating the first disc such that the second markings representing the days of a menstrual cycle are aligned with the appropriate calendar day on the base, rotating the second disc such that the marking representing the appropriate measured follicle size is aligned with the appropriate menstrual cycle day, and reading the calendar days associated with the subsequent tests, treatments and protocols.

109. A method for calculating dates and displaying information relating to fertility using a calculator, the calculator comprising a base and first and second discs, the base comprising at least first and second circular displays of first and second markings, respectively, wherein the first and second discs are adapted to be rotatably joined at a central axis to the first and second circular displays; the first circular display of first markings divided into 153 equiangular parts disposed along substantially the entire periphery of the circular display, the 153 equiangular parts grouped into five segments, the first segment having 31 equiangular parts, the second segment having 30 equiangular parts and being labeled "April" and "September", the third segment having 31 equiangular parts and being labeled "May" and "October", the fourth segment having 30 equiangular parts and being labeled "June" and "November", and the fifth segment having 31 equiangular parts and being labeled "July" and "December", respectively, in clockwise fashion around the circle; and the second circular display of second markings divided into at least 150 equiangular parts disposed along substantially the entire periphery of the circular display, the at equiangular parts grouped into at least five segments, the first segment having 31 equiangular parts and being labeled "January", the second segment having 28 equiangular parts and being labeled "February", the third segment having 31 equiangular parts and being labeled "March" and "Leap January", the fourth segment having 29 equiangular parts and being labeled "Leap February", and the fifth segment having 31 equiangular parts and being labeled "Leap March", or the first segment having 31 equiangular parts and being labeled "Leap January", the second segment having 29 equiangular parts and being labeled "Leap February", the third segment having 31 equiangular parts and being labeled "Leap March" and "January", the fourth segment having 28 equiangular parts and being labeled "February", and the fifth segment having 31 equiangular parts and being labeled "March", respectively, in clockwise fashion around the circle; the first disc having at least a circular display of third markings disposed along at least a portion of the periphery thereof, the third markings representing the days of a menstrual cycle, wherein one or more cycles are represented, the cycles having the same or different lengths; the second disc having at least a circular display of fourth markings disposed along at least a portion of the periphery thereof, the fourth markings representing events of interest relating to one or more menstrual cycles; the method comprising rotating the first disc to align the days of a menstrual cycle with the appropriate calendar days on the first or second circular display; rotating the second disc to align the events of interest with the appropriate menstrual cycle day on the first disc; determining the calendar dates of additional events of interest relating to additional menstrual cycles based on the associated calendar day on the first or second circular display.

110. A method for timing the fertile period using a calculator adapted to determine optimum time for achieving or avoiding pregnancy based on menstrual or ovulation physiology and a calendar of moon phases, wherein the calculator contains only non-letter, non-number symbols, the calculator comprising a base comprising a circular display divided into 365 equiangular parts, each unit representing a day in each moon phase of a full year, a first disc having the circumference thereof divided into 365 equiangular parts, wherein a symbol representing a significant day which occurs in cycles is located in the units at intervals according to the cycle, the first disc being smaller than the circular display on the base, and adapted to be rotatably set in coaxial relation therewith so that the outside edge of the first disc lies inside the units on the base; a second disc divided into 365 equiangular parts with an annular display of first indicia disposed along substantially the entire periphery thereof, the first indicia representing the days of a menstrual cycle; wherein one or more cycles are represented, the cycles having the same or different lengths, the second disc being smaller than the first disc and adapted to be rotatably set in coaxial relation therewith so that the outside edge of the second disc lies inside the symbols on the first disc; a third disc divided into 365 equiangular parts with an annular display of second and third indicia disposed along substantially the entire periphery thereof, the second indicia representing the days of a menstrual cycle and the third indicia representing a fertile period, the third disc being smaller than the first disc, and adapted to be rotatably set in coaxial relation with the base, first and second discs so that the outside edge of the third disc lies inside the symbols on the first disc; the method comprising rotating the first disc such that the symbol representing a significant day on the first disc is aligned with the appropriate moon phase on the base, affixing the first disc to the base to set the calendar, rotating the second disc such that the last menstrual cycle on the second disc is aligned with the corresponding day on the first disc and base, according to the significant days, rotating the third disc such that the next menstrual cycle on the third disc is aligned with the corresponding day on the first disc, according to the significant days, determining the days from the base and first disc which correspond to the third indicia on the third disc representing a fertile period.

* * * * *

UNITED STATES PATENT AND TRADEMARK OFFICE

CERTIFICATE OF CORRECTION

PATENT NO. : 6,886,740 B1
APPLICATION NO. : 09/763250
DATED : May 3, 2005
INVENTOR(S) : Craig It is certified that error appears in the above-identified patent and that said Letters Patent is hereby corrected as shown below:

On title page delete Item (74) and insert item (74)
Margaret Polson: Oppedahl Patent Law Firm LLC Signed and Sealed this Eighteenth Day of May, 2010

David J. Kappos

David J. Kappos
*Director of the United States Patent and Trademark Office*